US011156412B2

(12) United States Patent
Onaka et al.

(10) Patent No.: US 11,156,412 B2
(45) Date of Patent: Oct. 26, 2021

(54) HEAT EXCHANGER AND AIR-CONDITIONING APPARATUS

(71) Applicant: Mitsubishi Electric Corporation, Chiyoda-ku (JP)

(72) Inventors: Yoji Onaka, Chiyoda-ku (JP); Takashi Matsumoto, Chiyoda-ku (JP); Kosuke Miyawaki, Chiyoda-ku (JP); Hiroyuki Okano, Chiyoda-ku (JP); Takanori Koike, Chiyoda-ku (JP); Takeshi Hatomura, Chiyoda-ku (JP); Osamu Morimoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 175 days.

(21) Appl. No.: 16/318,273

(22) PCT Filed: Jul. 28, 2017

(86) PCT No.: PCT/JP2017/027441
§ 371 (c)(1),
(2) Date: Jan. 16, 2019

(87) PCT Pub. No.: WO2018/047511
PCT Pub. Date: Mar. 15, 2018

(65) Prior Publication Data

US 2020/0182564 A1 Jun. 11, 2020

(30) Foreign Application Priority Data

Sep. 12, 2016 (JP) ..... JP2016-177390

(51) Int. Cl.
*F28D 1/053* (2006.01)
*F28D 21/00* (2006.01)
(Continued)

(52) U.S. Cl.
CPC ..... *F28F 9/02* (2013.01); *F25B 39/02* (2013.01); *F25B 39/04* (2013.01); *F25B 41/37* (2021.01);
(Continued)

(58) Field of Classification Search
CPC .. F28F 1/022; F28F 13/08; F28F 27/02; F28F 2250/06; F28F 2210/02; F28F 9/02;
(Continued)

(56) References Cited

U.S. PATENT DOCUMENTS 8,869,545 B2 * 10/2014 Chen ..... F25D 21/002 62/81
2012/0210744 A1 * 8/2012 Nelson ..... F25B 39/028 62/430
(Continued)

FOREIGN PATENT DOCUMENTS

EP 3306232 A1 * 4/2018 ..... F25B 41/40
EP 3306234 A1 * 4/2018 ..... F28F 9/0263
(Continued)

OTHER PUBLICATIONS

Jun Lee, Sang Yong Lee. "Distribution of Two-Phase Annular Flow at Header-channel Junctions." Experimental thermal and fluid science 28.2 (2004) 217-222. (Year: 2004).*
(Continued)

*Primary Examiner* — Christopher R Zerphey
*Assistant Examiner* — Bejeir Brooks
(74) *Attorney, Agent, or Firm* — Xsensus LLP

(57) ABSTRACT

A heat exchanger includes first and second headers connected to end portions of heat transfer tubes. The second header includes a header pipe defining a flow space that communicates with the heat transfer tubes and, when the heat exchanger acts as an evaporator, allows refrigerant in a two-phase gas-liquid state to pass through the flow space
(Continued)

into the heat transfer tubes. A bypass pipe is disposed between an entrance portion and the first header. The entrance portion has an entrance distance L between a connection end portion connected to a refrigerant pipe and a central axis of the bypass pipe. The entrance distance L of the entrance portion satisfies L≥5di, where di is an inner diameter of a flow space of the header pipe on an orthogonal plane orthogonal to a direction of refrigerant flow. The bypass pipe is inserted in the flow space of the entrance portion.

23 Claims, 39 Drawing Sheets

(51) Int. Cl.

| | |
|---|---|
| ***F25B 41/00*** | (2021.01) |
| ***F28F 1/02*** | (2006.01) |
| ***F28F 27/02*** | (2006.01) |
| ***F28F 9/18*** | (2006.01) |
| ***F24F 1/14*** | (2011.01) |
| ***F28F 9/02*** | (2006.01) |
| ***F25B 39/02*** | (2006.01) |
| ***F25B 39/04*** | (2006.01) |
| ***F28F 9/04*** | (2006.01) |
| ***F25B 41/37*** | (2021.01) |

(52) U.S. Cl.
CPC ..... *F28F 9/04* (2013.01); *F25B 39/028* (2013.01); *F25B 2400/0409* (2013.01); *F25B 2400/23* (2013.01)

(58) Field of Classification Search
CPC ..... F28D 1/053; F28D 1/05316; F28D 2021/0068; F28D 2021/0071; F28D 2021/0085
See application file for complete search history.

(56) References Cited

U.S. PATENT DOCUMENTS

| | | | | |
|---|---|---|---|---|
| 2013/0061623 | A1* | 3/2013 | Yamashita | F25B 13/00 62/238.7 |
| 2013/0312944 | A1* | 11/2013 | Gao | F28F 9/027 165/175 |
| 2015/0027672 | A1 | 1/2015 | Jindou et al. | |
| 2016/0047580 | A1* | 2/2016 | Cho | F28F 9/0275 62/529 |
| 2016/0298887 | A1* | 10/2016 | Alahyari | F28F 9/0273 |
| 2017/0082332 | A1 | 3/2017 | Onaka et al. | |
| 2017/0205128 | A1* | 7/2017 | Onaka | F25B 31/008 |
| 2018/0292096 | A1* | 10/2018 | Onaka | F24F 1/18 |
| 2020/0182564 | A1* | 6/2020 | Onaka | F28F 9/18 |

FOREIGN PATENT DOCUMENTS

| | | | | | |
|---|---|---|---|---|---|
| GB | 2543206 | A | | 4/2017 | |
| GB | 2543206 | A | * | 4/2017 | F25B 13/00 |
| JP | 2690234 | B2 | * | 12/1997 | F28D 1/053 |
| JP | 2000-205685 | A | | 7/2000 | |
| JP | 2000205685 | A | * | 7/2000 | F25B 13/00 |
| JP | 2007139231 | A | * | 11/2005 | F25B 13/00 |
| JP | 2012021682 | A | * | 7/2010 | F25B 13/00 |
| JP | 2010266197 | A | * | 11/2010 | F28D 1/053 |
| JP | 2012-21682 | A | | 2/2012 | |
| JP | 5626254 | B2 | | 11/2014 | |
| JP | WO 2016/016999 | A1 | | 2/2016 | |
| JP | WO 2016/017430 | A1 | | 2/2016 | |
| WO | WO-2011099067 | A1 | * | 8/2011 | F25B 13/00 |
| WO | WO-2014136366 | A1 | * | 9/2014 | F28F 9/0214 |
| WO | WO 2015/178097 | A1 | | 11/2015 | |

OTHER PUBLICATIONS

Vist, Sivert, 2004. Two-Phase Flow Distribution In Heat Exchanger Manifolds. Ph.D. Norges teknisk-naturvitenskapelige universitet (Norway). (Year: 2004).*

Jun Lee. "Optimum Channel Intrusion Depth for Uniform Flow Distribution at Header-Channel Junctions." Journal of mechanical science and technology 24.7 (2010): 1411-1416. (Year: 2010).*

Yang Zou & Pega S. Hrnjak, Effects of fluid properties on two-phase flow and refrigerant distribution in the vertical header of a reversible microchannel heat exchanger—Comparing R245fa, R134a, R410A, and R32, 70 Applied Thermal Engineering 966-976 (2014). (Year: 2014).*

Ho-Won Byun & Nae-Hyun Kim, Two-phase refrigerant distribution in an intermediate header of a parallel flow minichannel heat exchanger, 59 International Journal of Refrigeration 14-28 (2015) (Year: 2015).*

English machine translation of JP2000205685A, accessed Nov. 2020. (Year: 2020).*

English machine translation of JP2010266197A, accessed Nov. 2020. (Year: 2020).*

English machine translation of JP2012021682A, accessed Nov. 2020. (Year: 2020).*

English machine translation of WO2011099067A1, accessed Nov. 2020. (Year: 2020).*

English machine translation of WO2014136366A1, accessed Nov. 2020. (Year: 2020).*

English machine translation of JP2007139231A, accessed Nov. 2020. (Year: 2020).*

English machine translation of JP2690234B2, accessed Nov. 2020. (Year: 2020).*

International Search Report dated Oct. 10, 2017 in PCT/JP2017/027441 filed on Jul. 28, 2017.

Zou, Y. et al., "Effects of fluid properties on two-phase flow and refrigerant distribution in the vertical header of a reversible microchannel heat exchanger—Comparing R245fa, R134a, R410A, and R32," Applied Thermal Engineering, vol. 70, 2014, pp. 966-976.

Byun, H.-W. et al., "Two-phase refrigerant distribution in an intermediate header of a parallel flow minichannel heat exchanger," International Journal of Refrigeration, vol. 59, 2015, pp. 14-28.

* cited by examiner

HEAT EXCHANGER AND AIR-CONDITIONING APPARATUS

TECHNICAL FIELD

The present invention relates to a heat exchanger and an air-conditioning apparatus that include a header through which refrigerant in a two-phase gas-liquid state flows when the heat exchanger acts as an evaporator.

BACKGROUND ART

In conventional air-conditioning apparatuses, liquid refrigerant condensed in a heat exchanger equipped to an indoor unit and acting as a condenser is reduced in pressure by an expansion device. The refrigerant is thus caused to change into a two-phase gas-liquid state in which the refrigerant contains both gas refrigerant and liquid refrigerant. The resulting refrigerant then flows into a heat exchanger equipped to an outdoor unit and acting as an evaporator. When refrigerant flows in a two-phase gas-liquid state into the heat exchanger acting as an evaporator, the distribution of refrigerant to the heat exchanger deteriorates. In one exemplary method for addressing this problem, to improve refrigerant distribution performance, a header is used as a distribution unit for the heat exchanger equipped to the outdoor unit, and structural objects such as partitions and eject ports are provided inside the header.

However, the improvement in distribution performance attained by the above-mentioned addition of structural objects to the interior of the header is small relative to the significant associated increase in cost. The addition of structural objects is also accompanied by a significant increase in pressure loss in the header, causing a decrease in energy efficiency. Another issue to consider is that in the outdoor unit of an air-conditioning apparatus, there is more airflow in areas closer to the fan. Thus, in the case of a top-flow fan, more refrigerant is distributed in the lower portion of the header, which is located farther from the fan than is the upper portion of the header, than in the upper portion of the header. In this case, a further deterioration occurs in refrigerant distribution performance and in the heat exchange performance of the heat exchanger, causing a further decrease in energy efficiency.

A technique described below has been proposed to address the above-mentioned problems. With this technique, the heat exchanger of the outdoor unit is divided into upper and lower heat exchangers, and the diameter of a header connected to the heat exchanger that is located closer to the fan and receives more airflow is set smaller than the diameter of a header connected to the heat exchanger that is located farther from the fan and receives less airflow, so that more liquid refrigerant is distributed to the upper portion of the header (see, for example, Patent Literature 1).

As another method, there has been proposed a technique with which the insertion length of branch tubes into the flow path of the header is adjusted to vary the flow resistance in the header to thereby improve distribution performance (see, for example, Patent Literature 2).

CITATION LIST

Patent Literature

Patent Literature 1: International Publication No. 2015/178097

Patent Literature 2: Japanese Patent No. 5626254

SUMMARY OF INVENTION

Technical Problem

A problem with the conventional techniques disclosed in Patent Literatures 1 and 2 is that, due to the dependency of distribution performance on refrigerant flow rate or refrigerant flow velocity, distribution performance can be improved only over a narrow, limited range of refrigerant flow rate or refrigerant flow velocity. Consequently, for operation at various refrigerant flow rates varied suitably to the environmental load, as is the case with the actual operation of air-conditioning apparatuses, improvement in distribution performance may not be attained in some operating conditions.

The present invention has been made to address the above-mentioned problem, and it is an object of the present invention to provide a heat exchanger and an air-conditioning apparatus that provide improved distribution performance over a wide operating range and consequently improved energy efficiency.

Solution to Problem

A heat exchanger according to an embodiment of the present invention includes a plurality of heat transfer tubes, a first header connected to one end portion of each of the plurality of heat transfer tubes, a second header connected to the other end portion of each of the plurality of heat transfer tubes, and a plurality of fins joined to each of the plurality of heat transfer tubes. The heat exchanger constitutes a portion of a refrigeration cycle circuit in which refrigerant circulates. The second header includes a header pipe. The header pipe defines a flow space. The flow space is communicated with the plurality of heat transfer tubes and, when the heat exchanger acts as an evaporator, allows refrigerant in a two-phase gas-liquid state to pass through the flow space and to flow out into the plurality of heat transfer tubes. The header pipe has an entrance portion. The entrance portion is a portion of the header pipe between a connection end portion connected to a refrigerant pipe and one of the plurality of heat transfer tubes into which refrigerant in a two-phase gas-liquid state first flows. A bypass pipe is disposed between the entrance portion and the first header and configured to bypass refrigerant. The bypass pipe protrudes into the header pipe to be connected to the header pipe. The bypass pipe is provided with a flow control mechanism configured to control a flow rate of refrigerant.

An air-conditioning apparatus according to another embodiment of the present invention includes a compressor, an indoor heat exchanger, an expansion device, and an outdoor heat exchanger, and has a refrigeration cycle circuit in which refrigerant circulates. The outdoor heat exchanger is the heat exchanger mentioned above.

Advantageous Effects of Invention

According to an embodiment of the present invention, the bypass pipe is disposed between the entrance portion and the first header and configured to bypass refrigerant. The bypass pipe is provided with the flow control mechanism configured to control the flow rate of refrigerant. Consequently, gas refrigerant is directed to the bypass pipe from the second header through which refrigerant in a two-phase gas-liquid state flows. As a result, the flow of refrigerant through the header pipe of the second header can be adjusted to follow, for example, an annular or churn flow pattern, in which a large amount of gas refrigerant is distributed close to the center of the main tube of the first header and a large amount of liquid refrigerant is distributed close to the wall surface of the main tube of the first header. The distribution of refrigerant to each heat transfer tube can therefore be improved, leading to improved efficiency of the heat exchanger. Improved distribution performance over a wide operating range is thus provided, leading to improved energy efficiency.

DESCRIPTION OF EMBODIMENTS

Figure 1:
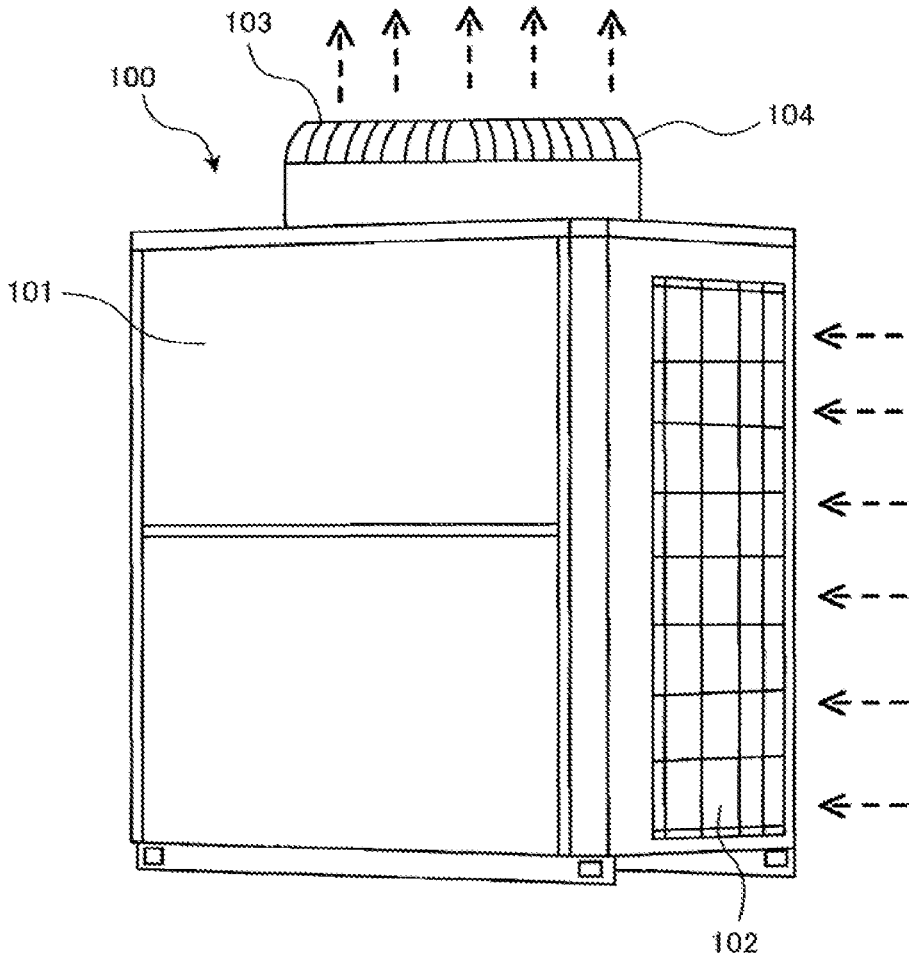
FIG. 1 is a side view of an outdoor unit of an air-conditioning apparatus, according to Embodiment 1 of the present invention.

Embodiments of the present invention will be described below. The drawings are merely illustrative of one example of the present invention, and the present invention is not limited to the drawings. Elements designated by the same reference signs in the drawings represent the same or corresponding elements through the specification. Further, in the drawings that follow, the relative sizes of various components may not be actual ones.

Embodiment 1

Figure 2:
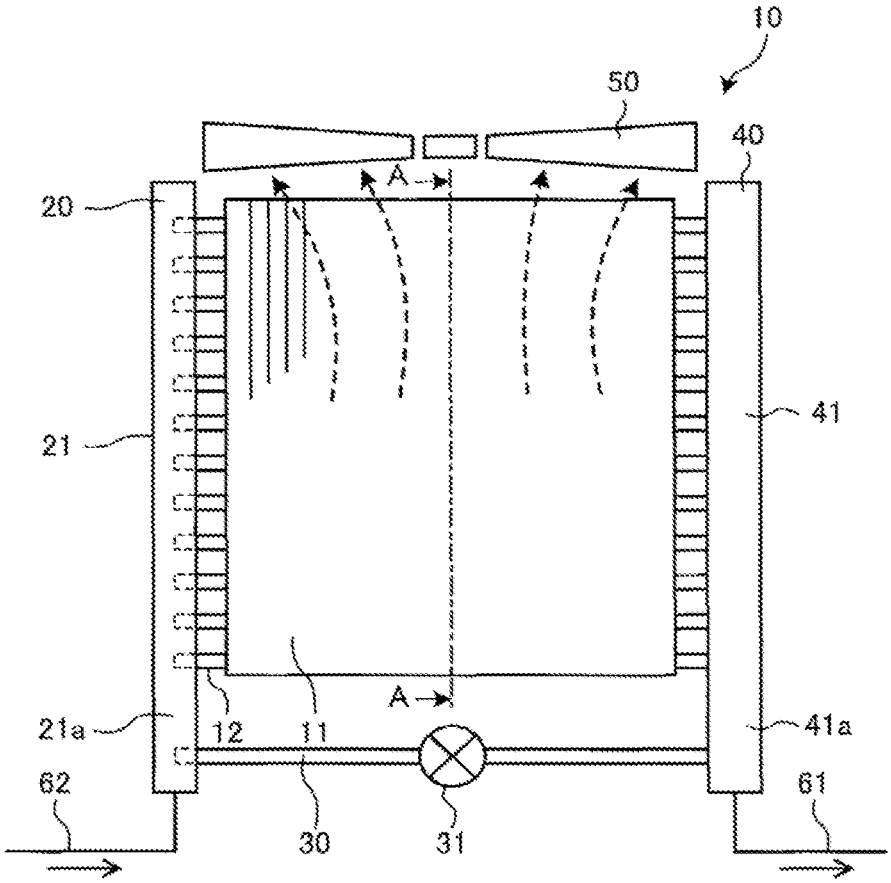
FIG. 2 is a schematic side view of an outdoor heat exchanger, according to Embodiment 1 of the present invention.
Figure 3:
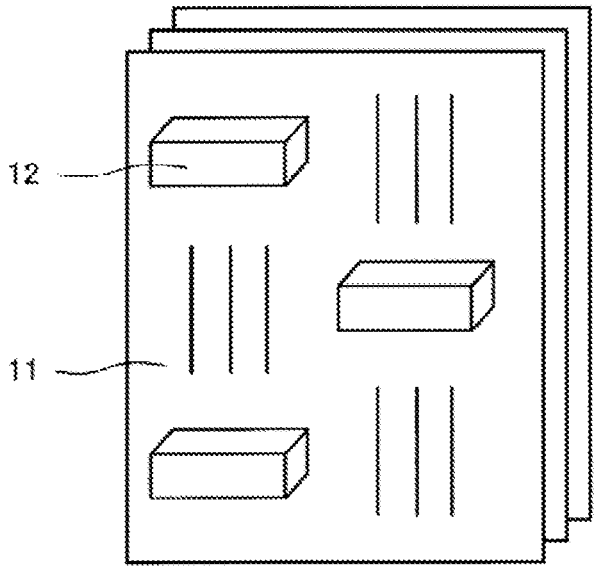
FIG. 3 is a perspective view of an exemplary cross-section of an outdoor heat exchanger taken along a line A-A of FIG. 2, according to Embodiment 1 of the present invention.
Figure 4:
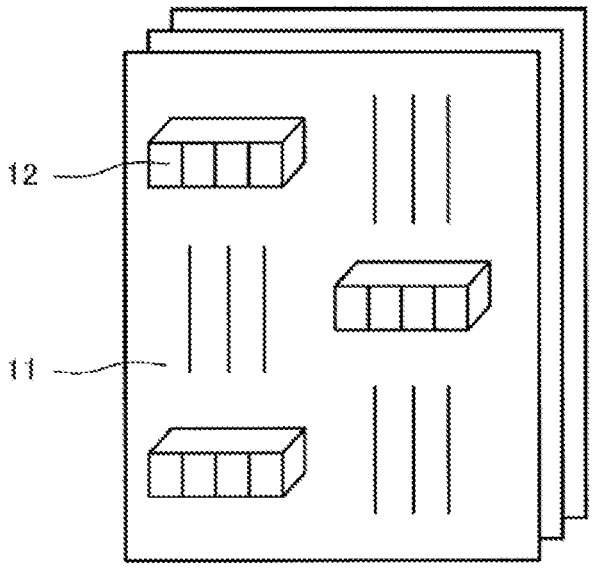
FIG. 4 is a perspective view of another exemplary cross-section of an outdoor heat exchanger taken along the line A-A of FIG. 2, according to Embodiment 1 of the present invention.
Figure 5:
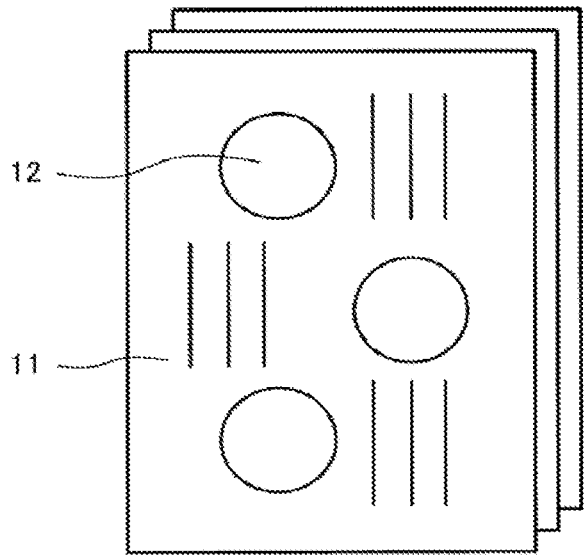
FIG. 5 is a perspective view of another exemplary cross-section of an outdoor heat exchanger taken along the line A-A of FIG. 2, according to Embodiment 1 of the present invention.

FIG. 1 is a side view of an outdoor unit 100 of an air-conditioning apparatus, according to Embodiment 1 of the present invention. FIG. 2 is a schematic side view of an outdoor heat exchanger 10, according to Embodiment 1 of the present invention. FIG. 3 is a perspective view of an exemplary cross-section of the outdoor heat exchanger 10 taken along the line A-A of FIG. 2, according to Embodiment 1 of the present invention. FIG. 4 is a perspective view of another exemplary cross-section of the outdoor heat exchanger 10 taken along the line A-A of FIG. 2, according to Embodiment 1 of the present invention. FIG. 5 is a perspective view of another exemplary cross-section of the outdoor heat exchanger 10 taken along the line A-A of FIG. 2, according to Embodiment 1 of the present invention.

The solid and broken arrows in the drawings respectively represent the flow of refrigerant and the flow of air in the outdoor unit 100 of the air-conditioning apparatus during heating operation.

As illustrated in FIG. 1, the outdoor unit 100 of the air-conditioning apparatus according to Embodiment 1 is equipped with the outdoor heat exchanger 10 illustrated in FIG. 2. The outdoor unit 100 of the air-conditioning apparatus is of a top-flow type. A refrigeration cycle circuit is formed by circulating refrigerant between the outdoor unit 100 and an indoor unit (not illustrated). The outdoor unit 100 is used as, for example, the outdoor unit of a multi-air-conditioning apparatus for building applications, and installed in areas such as building rooftop.

The outdoor unit 100 includes a casing 101 formed in a box-like shape. The outdoor unit 100 includes an air inlet 102 defined by an opening on a side face of the casing 101. The outdoor unit 100 includes the outdoor heat exchanger 10 illustrated in FIG. 2 disposed inside the casing 101 along the air inlet 102. The outdoor unit 100 includes an air outlet 103 defined by an opening on the top face of the casing 101. The outdoor unit 100 is provided with a fan guard 104 disposed to cover the air outlet 103 in such a manner that passage of air through the fan guard 104 can be allowed. The outdoor unit 100 is provided with a top-flow fan 50 illustrated in FIG. 2 disposed inside the fan guard 104 to suck in outside air from the air inlet 102 and discharge the outside air from the air outlet 103.

The outdoor heat exchanger 10 equipped to the outdoor unit 100 of the air-conditioning apparatus allows outside air sucked in through the air inlet 102 by the fan 50 to exchange heat with refrigerant. As illustrated in FIG. 2, the outdoor heat exchanger 10 is disposed below the fan 50. The outdoor heat exchanger 10 includes a plurality of fins 11 aligned at intervals, and a plurality of heat transfer tubes 12 in which refrigerant flows and that penetrate the fins 11 in the direction in which the fins 11 are aligned. The heat transfer tubes 12 are arranged to protrude from each of the fins 11 of both ends.

The outdoor heat exchanger 10 corresponds to a heat exchanger according to the present invention.

A first header 40 is connected to one end portion of each of the heat transfer tubes 12. A second header 20 is connected to the other end portion of each of the heat transfer tubes 12.

An outlet pipe 61 is connected to a lower portion of the first header 40. An inlet pipe 62 is connected to a lower portion of the second header 20.

As illustrated in FIG. 2, in Embodiment 1, a plurality of branch tubes as components of the second header 20 are each formed by extending a portion of a corresponding one of the heat transfer tubes 12, which are components of the outdoor heat exchanger 10. The use of a portion of each heat transfer tube 12 as the branch tube eliminates the need for a joint to connect the branch tube with the heat transfer tube 12, thus allowing for space saving and reduced pressure loss.

However, the branch tubes as components of the second header 20 are not limited to this configuration and may be separate from the heat transfer tubes 12, which are components of the outdoor heat exchanger 10.

The second header 20 has the heat transfer tubes 12, and a header pipe 21. The header pipe 21 extends in the vertical direction. The second header 20 is a vertical header extending in the vertical direction.

When the outdoor heat exchanger 10 acts as an evaporator, refrigerant in a two-phase gas-liquid state containing both gas refrigerant and liquid refrigerant flows through the inlet pipe 62 to enter the outdoor heat exchanger 10 from the lower end portion of the header pipe 21 of the second header 20. The refrigerant having entered the header pipe 21 is distributed to the heat transfer tubes 12. At this time, the heat transfer tubes 12 are inserted in the header pipe 21 up to a point close to the center of the inner diameter of the header pipe 21. This configuration helps improve refrigerant distribution performance.

The header pipe 21 has an entrance portion 21*a*. The entrance portion 21*a* refers to a portion of the header pipe 21 extending from the lower end portion connected to the inlet pipe 62, which serves as a refrigerant pipe, to the lowermost one of the heat transfer tubes 12 into which refrigerant in a two-phase gas-liquid state first flows.

A bypass pipe 30 is disposed between the entrance portion 21*a* of the second header 20 and the first header 40 and configured to bypass refrigerant. The bypass pipe 30 connects the entrance portion 21*a* of the second header 20 with an entrance portion 41*a* of the first header 40 located at the same height as the entrance portion 21*a*. The bypass pipe 30 thus extends straight in the horizontal direction.

The bypass pipe 30 is provided with a flow control valve 31 to control the flow rate of refrigerant. The flow control valve 31 is, for example, an electronic expansion valve or solenoid valve whose opening degree is variable.

The flow control valve 31 corresponds to a flow control mechanism according to the present invention.

Instead of the flow control valve 31, for example, a capillary tube and a check valve may be used.

The heat transfer tubes 12 of the outdoor heat exchanger 10 according to Embodiment 1 may be flat tubes with a flat cross-section as illustrated in FIG. 3. Alternatively, the heat transfer tubes 12 may be flat perforated tubes with a flat cross-section that have a plurality of holes defined in the flat perforated tubes as illustrated in FIG. 4. Further, the heat transfer tubes 12 are not limited to flat tubes but may be, for example, circular tubes with a circular cross-section as illustrated in FIG. 5. That is, the shape of the heat transfer tubes 12 is not limited. Each of the heat transfer tubes 12 may be grooved to have a grooved surface for increased heat transfer area. Alternatively, each heat transfer tube 12 may be formed with a smooth surface to reduce an increase in pressure loss.

The following description is given of a case in which a circular tube with a circular cross-section is used as each heat transfer tube 12.

Next, the following describes the flow of refrigerant in heating operation of the outdoor unit 100 of the air-conditioning apparatus according to Embodiment 1.

In heating operation, refrigerant in a two-phase gas-liquid state flows through the inlet pipe 62 into the second header 20. In the second header 20, as the refrigerant travels upward from the lower end portion of the header pipe 21, the refrigerant is distributed to each of the heat transfer tubes 12 intersecting the header pipe 21 at right angles. In the outdoor heat exchanger 10, the refrigerant distributed to each of the heat transfer tubes 12 receives heat from ambient air and evaporates, thus changing to a state in which the refrigerant contains a large amount of gas refrigerant or gas. Individual streams of refrigerant subjected to heat exchange are combined at the first header 40, and the resulting refrigerant exits through the outlet pipe 61.

Figure 6:
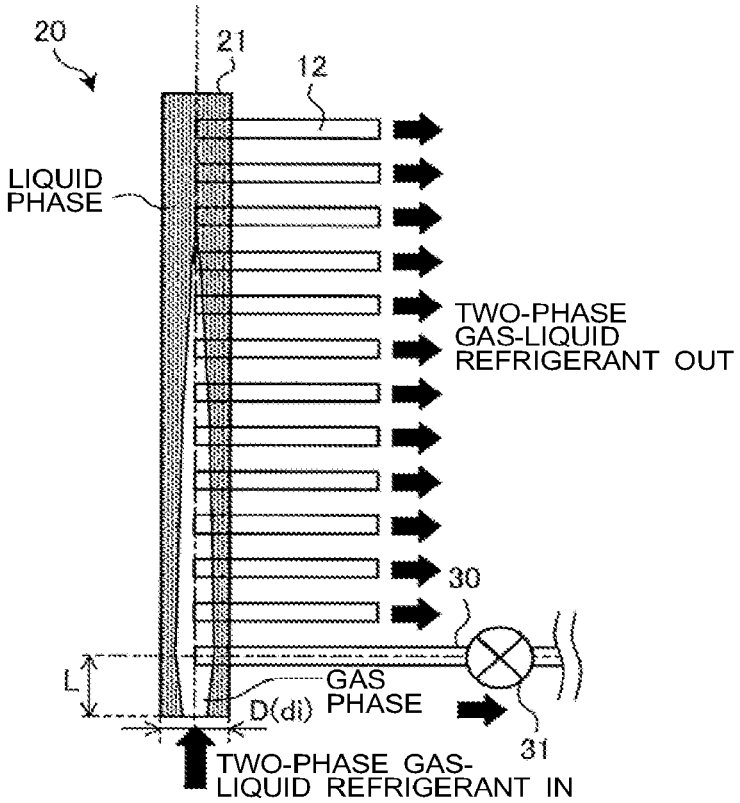
FIG. 6 is a schematic illustration of a second header, according to Embodiment 1 of the present invention.

The second header 20 is described below. FIG. 6 is a schematic illustration of the second header 20, according to Embodiment 1 of the present invention. As illustrated in FIG. 6, the second header 20 includes the header pipe 21, and the heat transfer tubes 12 that also serve as branch tubes.

The header pipe 21 extends vertically and has a circular shape in horizontal cross-section. A connection end portion of the header pipe 21, which is the lower end portion in the lower portion of the entrance portion 21*a* of the header pipe 21, is connected to the inlet pipe 62, which is a refrigerant pipe of the refrigeration cycle circuit.

The header pipe 21 defines a flow space. The flow space is communicated with the heat transfer tubes 12 and, when the outdoor heat exchanger 10 acts as an evaporator, allows refrigerant in a two-phase gas-liquid state to pass through the flow space and to flow out into the heat transfer tubes 12.

The distal ends of most of the heat transfer tubes 12 are communicated with the header pipe 21 in such a manner that the distal ends protrude toward the center of the inner diameter of the header pipe 21.

Next, the following describes the flow of refrigerant in a two-phase gas-liquid state flowing in the second header 20.

Refrigerant in a two-phase gas-liquid state enters from the lower portion of the header pipe 21, and travels against gravity as an upward flow. The refrigerant in a two-phase gas-liquid state having entered the header pipe 21 is distributed to each of the heat transfer tubes 12 sequentially from the lower portion of the header pipe 21.

At this time, when the flow pattern of the refrigerant in a two-phase gas-liquid state entering the second header 20 is annular or churn, a distribution as illustrated in FIG. 6 is made in which a large amount of gas phase is concentrated in the central portion of the header pipe 21 and a large amount of liquid phase is concentrated in the annular part of the header pipe 21.

Figure 7:
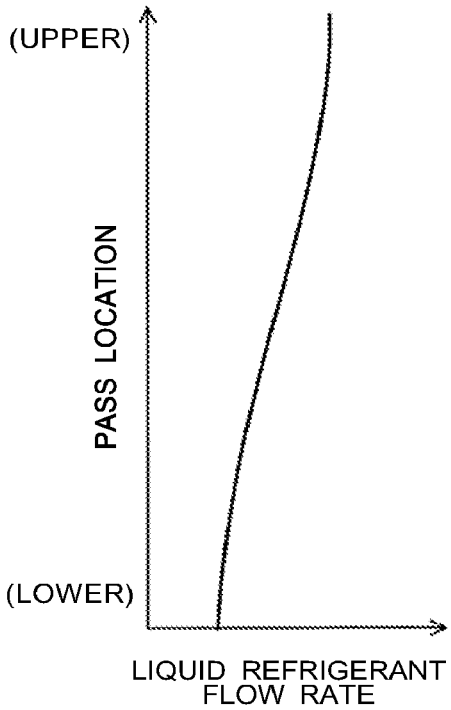
FIG. 7 illustrates the flow rate of liquid refrigerant at pass location in a header pipe, according to Embodiment 1 of the present invention.

FIG. 7 illustrates the flow rate of liquid refrigerant at pass location in the header pipe 21, according to Embodiment 1 of the present invention. As illustrated in FIG. 7, it is possible to obtain a liquid flow distribution that, in the lower portion of the header pipe 21, a large amount of gas refrigerant is distributed to the heat transfer tubes 12, whereas in the upper portion of the header pipe 21, a large amount of liquid refrigerant is distributed to the heat transfer tubes 12. Accomplishing such a liquid flow distribution makes it possible to address problems uniquely associated with headers, such as liquid refrigerant not flowing to the upper portion of the header pipe 21 due to gravity. This effect helps improve refrigerant distribution performance, leading to enhanced efficiency of the outdoor heat exchanger 10 and consequently enhanced energy efficiency.

Most preferably, the distal end portion of the heat transfer tube 12 is located in the header pipe 21 substantially at the center of the header pipe 21. On the basis of the results of an experiment conducted by the inventors, however, when the quality of refrigerant entering the header pipe 21 satisfies the condition of $0.05 \leq x \leq 0.30$, and the flow pattern of the refrigerant is annular or churn, it suffices that the distal end portion of the heat transfer tube 12 penetrates the liquid phase of refrigerant flowing in the header pipe 21. That is, the distal end portion of the heat transfer tube 12 may be located within a certain range of area in the vicinity of the center of the header pipe 21.

Figure 8:
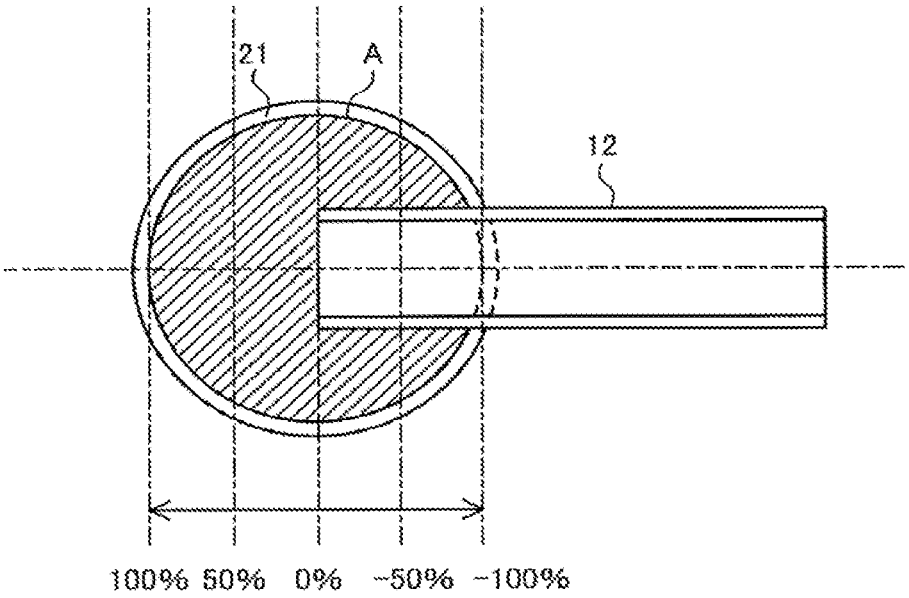
FIG. 8 illustrates an exemplary location of the distal end portion of a heat transfer tube in a header pipe, according to Embodiment 1 of the present invention.
Figure 9:
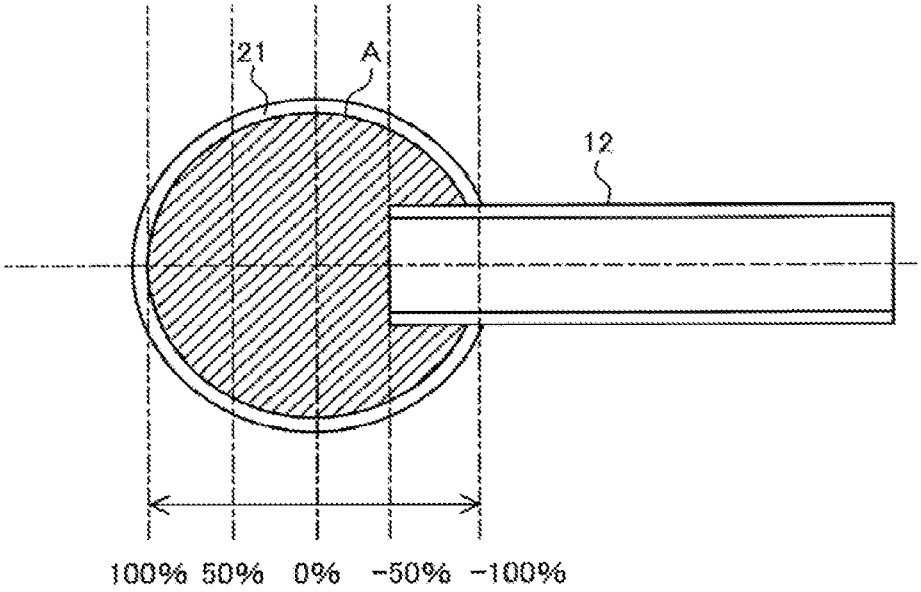
FIG. 9 illustrates another exemplary location of the distal end portion of a heat transfer tube in a header pipe, according to Embodiment 1 of the present invention.
Figure 10:
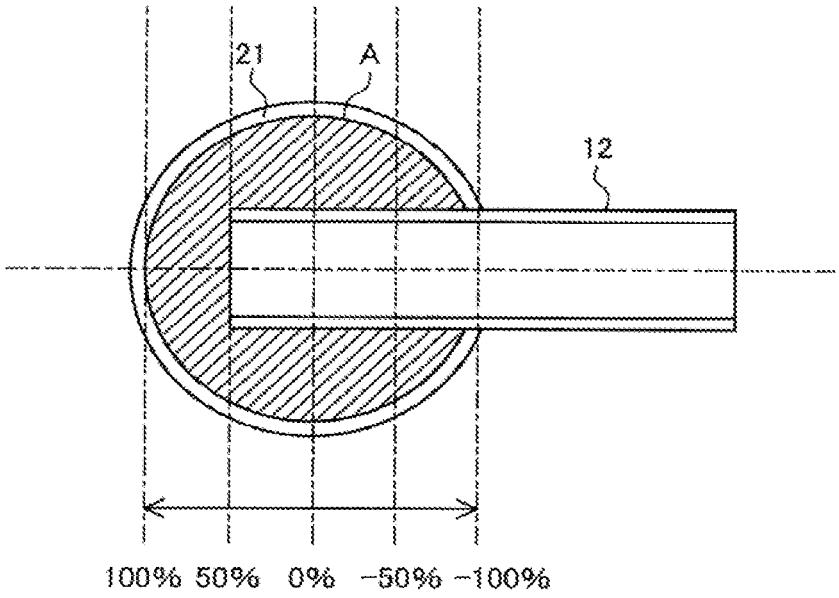
FIG. 10 illustrates another exemplary location of the distal end portion of a heat transfer tube in a header pipe, according to Embodiment 1 of the present invention.

FIG. 8 illustrates an exemplary location of the distal end portion of the heat transfer tube 12 in the header pipe 21, according to Embodiment 1 of the present invention. FIG. 9 illustrates another exemplary location of the distal end portion of the heat transfer tube 12 in the header pipe 21, according to Embodiment 1 of the present invention. FIG. 10 illustrates another exemplary location of the distal end portion of the heat transfer tube 12 in the header pipe 21, according to Embodiment 1 of the present invention.

The expression "close to the center" as used herein means that, as illustrated in FIGS. 8, 9, and 10, where the center position of the flow space of the header pipe 21 on the horizontal plane is defined as 0%, and the wall surface position of the flow space of the header pipe 21 on the horizontal plane is defined as ±100%, the distal end portion of each of the heat transfer tubes 12 is connected to lie within the area of ±50%.

In this regard, "A" in each of FIGS. 8, 9, and 10 represents effective channel cross-sectional area [$mm^2$] in the horizontal cross-section taken at the position where the heat transfer tube 12 is inserted. In this case, the effective channel cross-sectional area A of the header pipe 21 is sized in diameter to allow the flow of refrigerant to have an annular or churn flow pattern.

A flow pattern is determined by reference to the flow pattern map of Taitel, which is known as a flow pattern map for vertical upward flow, and set on the basis of the reference gas apparent velocity $U_{GS}$ [m/s] at the maximum value within the variation range of refrigerant flow rate $M_R$ [kg/h], which is the flow rate of refrigerant through the flow space of the header pipe 21.

Figure 11:
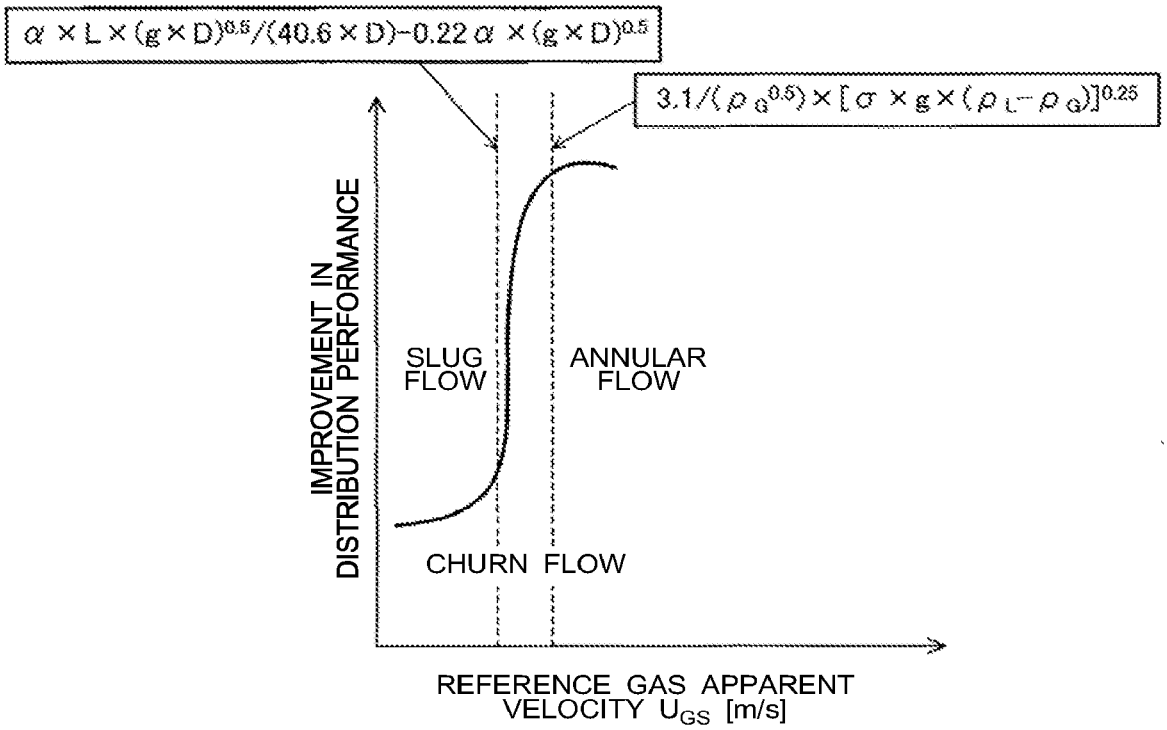
FIG. 11 illustrates the relationship between reference gas apparent velocity $U_{GS}$ of refrigerant and improvement in distribution performance, according to Embodiment 1 of the present invention.

FIG. 11 illustrates the relationship between reference gas apparent velocity $U_{GS}$ of refrigerant and improvement in distribution performance, according to Embodiment 1 of the present invention.

As illustrated in FIG. 11, the reference gas apparent velocity $U_{GS}$ [m/s] of refrigerant at the maximum value within the variation range of the refrigerant flow rate $M_R$ [kg/h], which is the flow rate of refrigerant through the header pipe 21, satisfies the condition of $U_{GS} \geq \alpha \times L \times (g \times D)^{0.5}/(40.6 \times D) - 0.22\alpha \times (g \times D)^{0.5}$, where $\alpha$ is the refrigerant void fraction, L is the entrance distance [m], g is the acceleration of gravity [$m/s^2$], and D is the inner diameter illustrated in FIG. 6, which is the inner diameter of the flow space of the header pipe 21 on an orthogonal plane orthogonal to the direction of refrigerant flow.

The refrigerant void fraction $\alpha$ is defined as $\alpha = x/[x+(\rho_G/\rho_L)\times(1-x)]$, where x is the refrigerant quality, $\rho_G$ is the refrigerant gas density [$kg/m^3$], and $\rho_L$ is the refrigerant liquid density [$kg/m^3$]. The entrance distance L [m] is defined as the distance illustrated in FIG. 6 between the connection end portion of the header pipe 21 connected to the inlet pipe 62, and the central axis of the bypass pipe 30 inserted in the header pipe 21.

More preferably, the reference gas apparent velocity $U_{GS}$ [m/s] satisfies the condition of $U_{GS} \geq 3.1/(\rho_G^{0.5}) \times [\sigma \times g \times (\rho_L - \rho_G)]^{0.25}$, where $\rho_G$ is the refrigerant gas density [$kg/m^3$], $\rho_L$ is the refrigerant liquid density [$kg/m^3$], $\sigma$ is the refrigerant surface tension [N/m], and g is the acceleration of gravity [$m/s^2$].

The refrigerant void fraction $\alpha$ can be directly measured by, for example, a measurement using electrical resistance, or observation based on visualization. The refrigerant void fraction $\alpha$ can be also calculated by using the void fraction of uniform flow as $\alpha = x/[x+(\rho_G/\rho_L)\times(1-x)]$.

Figure 12:
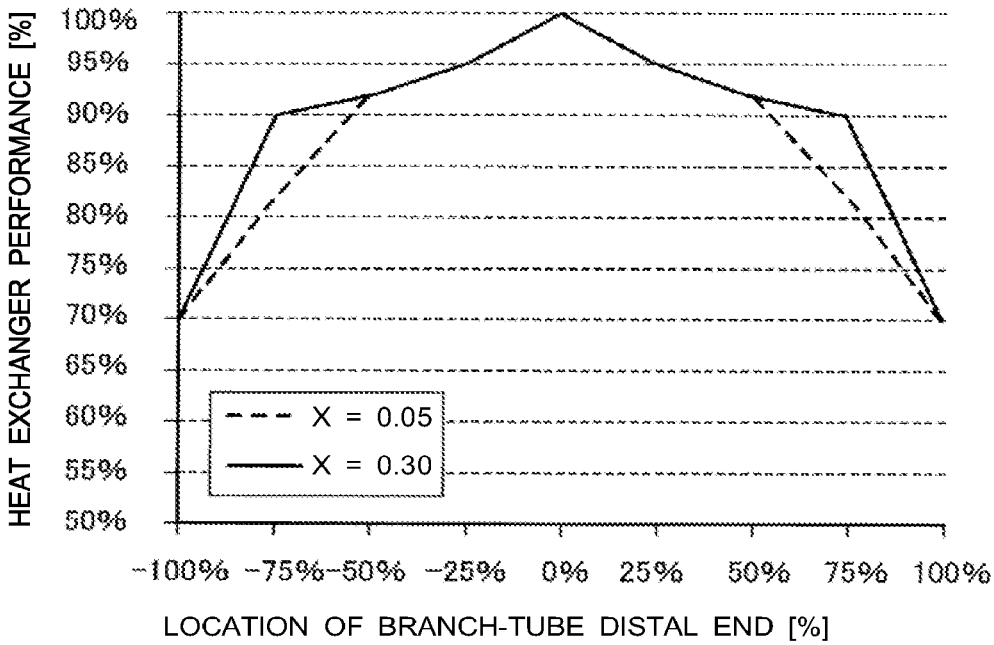
FIG. 12 illustrates the relationship between the location of the distal end portion of a heat transfer tube and heat exchanger performance, according to Embodiment 1 of the present invention.

FIG. 12 illustrates the relationship between the location of the distal end portion of the heat transfer tube 12 and the performance of the outdoor heat exchanger 10, according to Embodiment 1 of the present invention. FIG. 12 illustrates exemplary results of an experiment conducted by the inventors.

As illustrated in FIGS. 8, 9, and 10, the location of the distal end portion of the heat transfer tube 12 in this case represents the location where the center position of the flow space of the header pipe 21 on the horizontal plane is defined as 0%, and the wall surface position of the flow space of the header pipe 21 on the horizontal plane is defined as ±100%.

Where the quality x is defined as x=0.30, the performance of the outdoor heat exchanger 10 sharply deteriorates when the distal end portion of the heat transfer tube 12 is located outside ±75%.

Where the quality x is defined as x=0.05, the quality is lower and hence the liquid phase is thicker than where the quality x is defined as x=0.30. Consequently, the performance of the outdoor heat exchanger 10 sharply deteriorates when the distal end portion of the heat transfer tube 12 is located in an area outside ±50%. By contrast, when the distal end portion of the heat transfer tube 12 is located within the area of ±50%, the deterioration in the performance of the outdoor heat exchanger 10 is small.

Thus, when the case of the quality x=0.05 is considered in which the liquid phase is thick, an improvement in distribution performance is obtained by positioning the distal end portion of the heat transfer tube 12 within ±50%.

When the distal end portion of the heat transfer tube 12 is positioned within ±50%, a large amount of liquid refrigerant can be distributed to the upper portion of the second header 20. However, when the distal end portion of the heat transfer tube 12 is positioned at the center of the inner diameter of the header pipe 21, that is, at the 0% position, such a configuration is more desirable as liquid refrigerant can be directed to the upper portion of the header pipe 21 over a wider range of refrigerant flow rate.

On the basis of the results of an experiment and analysis conducted by the inventors, when the flow pattern is annular or churn, the thickness $\delta$ [m] of the liquid phase is approximated relatively well as $\delta = G \times (1-x) \times D/(4\rho_L \times U_{LS})$, where $U_{LS}$ is the liquid apparent velocity [m/s] representing the maximum value within the variation range of the refrigerant flow rate $M_R$, which is the flow rate [kg/h] of refrigerant through the flow space of the header pipe 21, x is the refrigerant quality, G is the refrigerant flow velocity [$kg/(m^2s)$], $\rho_L$ is the refrigerant liquid density [$kg/m^3$], and D is the inner diameter [m] of the header pipe.

Thus, when the distal end portions of most of the heat transfer tubes 12 are connected to the header pipe 21 in such a manner that the distal end portions are protruded into the header pipe 21 at least by an amount exceeding the value $\delta$ determined by the above-mentioned equation, and penetrate the liquid phase of two-phase gas-liquid refrigerant to reach the gas phase, such a configuration is desirable as more effective bypassing of gas refrigerant can be allowed to some extent.

The liquid apparent velocity $U_{LS}$ [m/s] is defined as $U_{LS} = G(1-x)/\rho_L$. The refrigerant flow velocity G [$kg/(m^2s)$] is defined on the basis of the inner diameter D [m] of the header pipe 21. The refrigerant flow velocity G is defined as $G = M_R/(3{,}600 \times (D/2)^2 \times 3.14)$, where $M_R$ is the flow rate [kg/h] of refrigerant entering the header pipe 21.

The foregoing description is directed to the case in which the horizontally-extending central axis of the heat transfer tube 12 and the vertically-extending central axis of the header pipe 21 intersect. However, for example, the horizontally-extending central axis of the heat transfer tube 12 may be shifted from the vertically-extending central axis of the header pipe 21.

Figure 13:
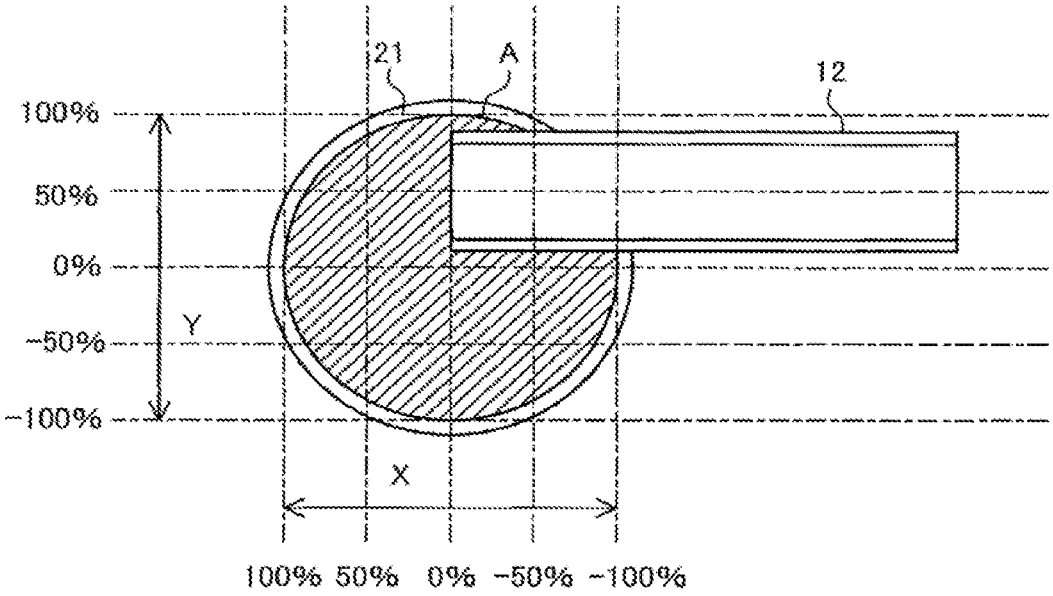
FIG. 13 illustrates an exemplary location of the distal end portion of a heat transfer tube in a header pipe, according to Embodiment 1 of the present invention.
Figure 14:
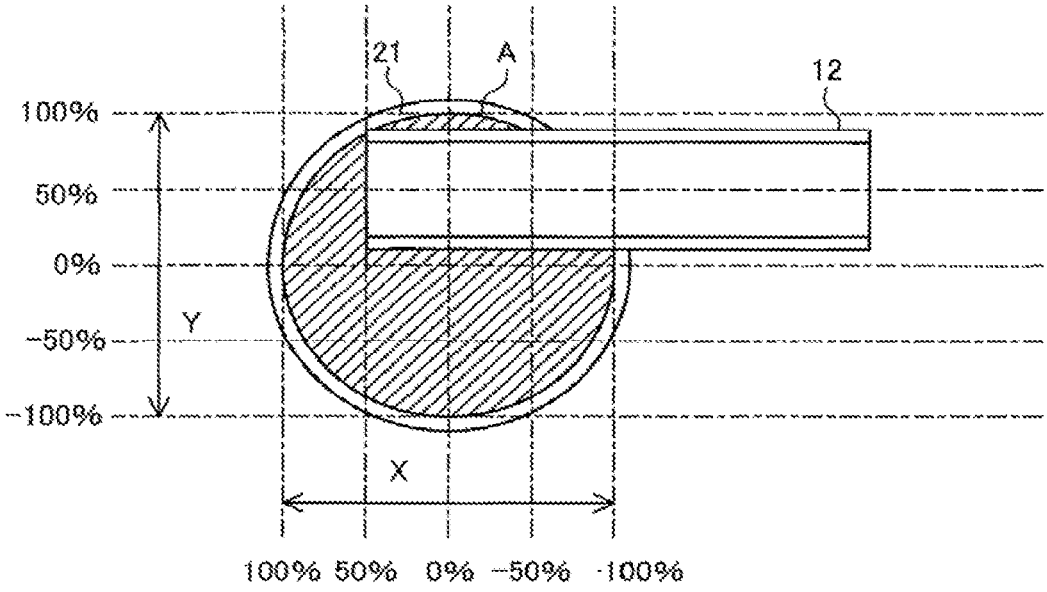
FIG. 14 illustrates another exemplary location of the distal end portion of a heat transfer tube in a header pipe, according to Embodiment 1 of the present invention.

FIG. 13 illustrates an exemplary location of the distal end portion of the heat transfer tube 12 in the header pipe 21, according to Embodiment 1 of the present invention. FIG. 14 illustrates another exemplary location of the distal end portion of the heat transfer tube 12 in the header pipe 21, according to Embodiment 1 of the present invention.

In this case, the center position of the flow space of the header pipe 21 on the horizontal plane is defined as 0%. The wall surface position of the flow space of the header pipe 21 on the horizontal plane is defined as ±100%. The direction of insertion of the heat transfer tubes 12 on the horizontal plane is defined as X-direction. The width direction of the heat transfer tubes 12 orthogonal to the X-direction on the horizontal plane is defined as Y-direction.

A case is considered in which, as illustrated in FIG. 13, the central axis of the heat transfer tube 12 is shifted in the Y-direction. In this regard, the maximum improvement in distribution performance is obtained when the distal end portion of the heat transfer tube 12 is located at the 0% position in the X-direction and the central axis of the heat transfer tube 12 is located at the 0% position in the Y-direction.

However, as long as the central axis of the heat transfer tube 12 is located within ±50%, an improvement in distribution performance can be obtained by utilizing the characteristics of annular or churn flow pattern.

As illustrated in FIG. 14, where the central axis of the heat transfer tube 12 is located within the area of ±50% in the Y-direction and, at the same time, the distal end portion of the heat transfer tube 12 is located within the area of ±50%, such a configuration is desirable as the protrusion length can be easily controlled by connecting the heat transfer tube 12 in such a manner that a portion of the heat transfer tube 12 comes into contact with the inner wall of the header pipe 21.

Where the central axis of the heat transfer tube 12 is located within ±25% in the Y-direction and, at the same time, the distal end portion of the heat transfer tube 12 is located within the area of ±25%, stable improvement in distribution performance is obtained even for low refrigerant quality conditions.

Preferably, all of the heat transfer tubes 12 are inserted into the header pipe 21 by the same amount. However, the amount of insertion may not be the same for all of the heat transfer tubes 12 as long as the distal end portion of each heat transfer tube 12 or the central axis of each heat transfer tube 12 is located within the area of ±50%.

In Embodiment 1, the heat transfer tubes 12 inserted into the header pipe 21 are the heat transfer tubes of the outdoor heat exchanger 10. In this regard, the heat transfer tubes serving as branch tubes may not necessarily be the heat transfer tubes of the heat exchanger. As each branch tube is substituted for by a portion of a corresponding one of the heat transfer tubes in some cases, its inner surface may be machined to have a heat transfer-facilitating feature such as a groove.

Figure 15:
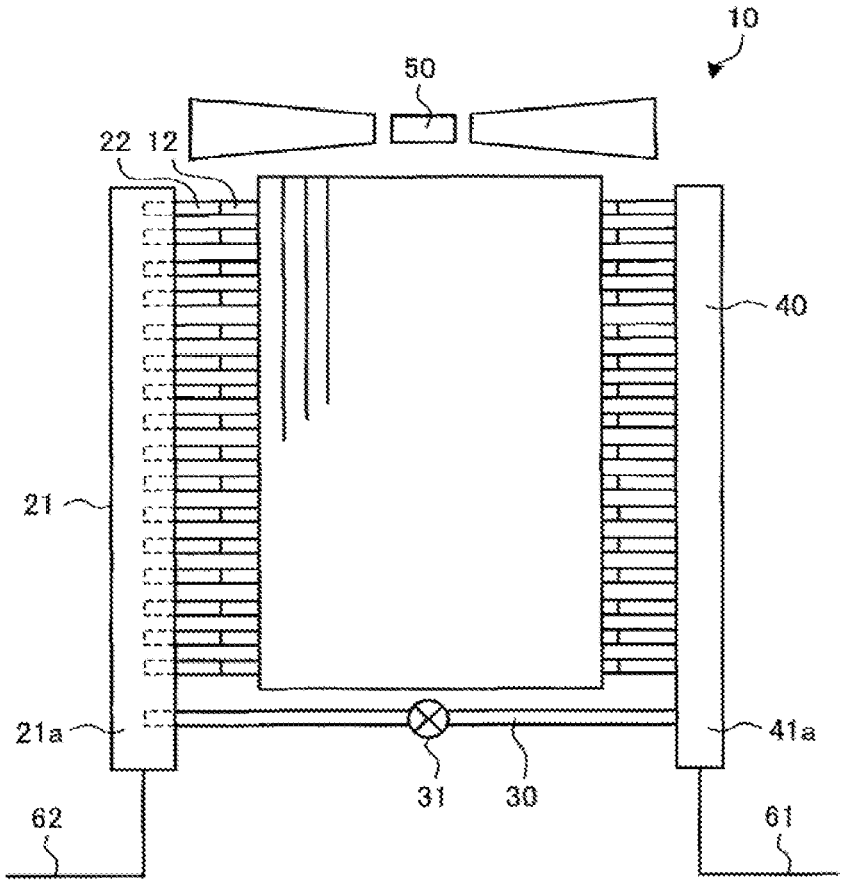
FIG. 15 is a schematic side view of an exemplary outdoor heat exchanger, according to Embodiment 1 of the present invention.

FIG. 15 is a schematic side view of an example of the outdoor heat exchanger 10, according to Embodiment 1 of the present invention. As illustrated in FIG. 15, an alternative arrangement is possible in which each heat transfer tube 12 is first connected to a branch tube 22 that is in the form of a circular tube, and then the branch tube 22 in the form of a circular tube is inserted into the header pipe 21.

In Embodiment 1, the bypass pipe 30 is connected between the entrance portion 21*a* of the header pipe 21 of the second header 20 and the entrance portion 41*a* of the first header 40. The flow control valve 31 is provided to the bypass pipe 30.

The flow control valve 31 is controlled so that the flow control valve 31 allows flow of refrigerant through the bypass pipe 30 only when the outdoor heat exchanger 10 acts as an evaporator, and that the flow control valve 31 closes to prevent flow of refrigerant through the bypass pipe 30 when the outdoor heat exchanger 10 acts as a condenser.

As with the distal end portion of the heat transfer tube 12, the distal end portion of the bypass pipe 30 is connected at a position close to the center of the inner diameter of the header pipe 21 of the second header 20. When refrigerant enters the header pipe 21 as an annular or churn flow, a large amount of gas refrigerant is distributed close to the center of the inner diameter of the header pipe 21. For this reason, connecting the bypass pipe 30 as described above allows gas refrigerant to be preferentially bypassed into the bypass pipe 30. Gas refrigerant, which hardly contributes to heat exchange, is thus bypassed preferentially. This configuration helps reduce pressure loss in the outdoor heat exchanger 10. Further, the opening degree of the flow control valve 31, which is disposed at a portion of the bypass pipe 30, is adjusted to control the distribution of refrigerant to the heat transfer tubes 12, thus allowing for improved efficiency of the outdoor heat exchanger 10.

Desirably, the distal end portion of the bypass pipe 30 is located in the central portion of the entrance portion 21*a* of the header pipe 21 of the second header 20 where a large amount of gas refrigerant is distributed.

The expression "located in the central portion" as used herein means that, as in the case of the heat transfer tube 12 illustrated in FIGS. 8, 9, and 10, where the center position of the flow space of the header pipe 21 on the horizontal plane is defined as 0%, and the wall surface position of the flow space of the header pipe 21 on the horizontal plane is defined as ±100%, the distal end portion of the bypass pipe 30 is connected in such a manner that the distal end portion is located within the area of ±50%.

The maximum improvement in distribution performance for the heat transfer tubes 12 is obtained when the distal end portion of the bypass pipe 30 is located at the 0% position.

However, as long as the distal end portion of the bypass pipe 30 is located within the area of ±50%, it is possible to obtain an improvement in distribution performance for the heat transfer tubes 12 by utilizing the characteristics of annular or churn flow pattern.

Moreover, when the distal end portion of the bypass pipe 30 is located within the area of ±25%, it is possible to obtain stable improvement in distribution performance for the heat transfer tubes 12 even under low refrigerant quality conditions.

The center position of the flow space of the header pipe 21 on the horizontal plane is defined as 0%. The wall surface position of the flow space of the header pipe 21 on the horizontal plane is defined as ±100%. The direction of insertion of the bypass pipe 30 on the horizontal plane is defined as X-direction. The width direction of the bypass pipe 30 orthogonal to the X-direction on the horizontal plane is defined as Y-direction.

As with the heat transfer tube 12 illustrated in each of FIGS. 13 and 14, the central axis of the bypass pipe 30 may be located within the area of ±50% in the Y-direction and, at the same time, the distal end portion of the bypass pipe 30 may be located within the area of ±50%. As a consequence, the distal end portion of the bypass pipe 30 is inserted in the flow space of the entrance portion 21*a* of the header pipe 21 at a location where a large amount of the gas phase of refrigerant is distributed.

Figure 16:
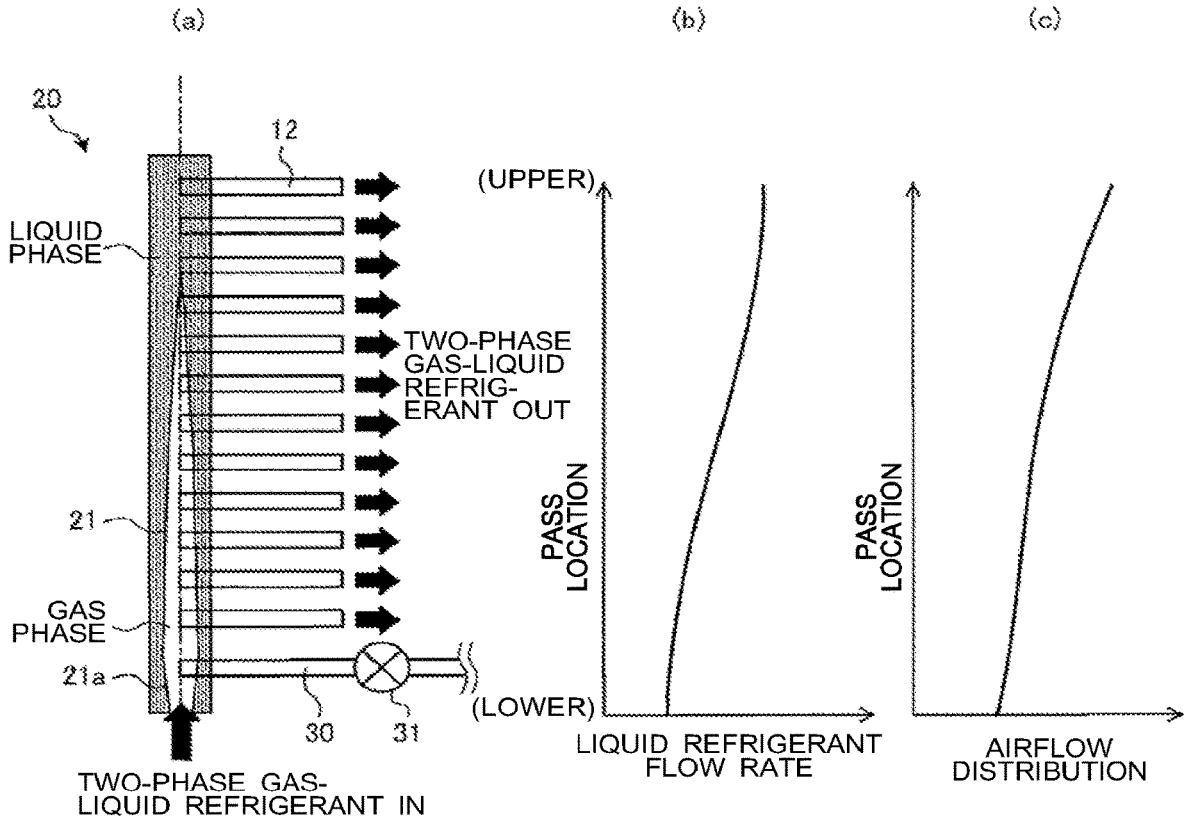
FIG. 16 represents illustrations according to Embodiment 1 of the present invention, collectively depicting a second header and the relationship between the flow rate of liquid refrigerant and airflow distribution in an outdoor heat exchanger, of which FIG. 16(*a*) schematically illustrates the second header, FIG. 16(*b*) illustrates the relationship between pass location and the flow rate of liquid refrigerant, and FIG. 16(*c*) illustrates the relationship between pass location and airflow distribution.

FIG. 16 represents illustrations according to Embodiment 1 of the present invention, collectively depicting the second header 20 and the relationship between the flow rate of liquid refrigerant and airflow distribution in the outdoor heat exchanger 10, of which FIG. 16(*a*) schematically illustrates the second header 20, FIG. 16(*b*) illustrates the relationship between pass location and the flow rate of liquid refrigerant, and FIG. 16(*c*) illustrates the relationship between pass location and airflow distribution.

As illustrated in FIG. 16, a large amount of liquid refrigerant is directed to flow to the upper portion of the header pipe 21. This configuration allows refrigerant to be distributed along an airflow distribution provided by the top-flow fan 50 in which there is more airflow in the upper portion. This configuration helps improve the efficiency of the outdoor heat exchanger 10.

The foregoing description is directed to the outdoor heat exchanger of a top-flow type with the fan 50 disposed above the outdoor heat exchanger 10. However, the heat exchanger is not limited to this configuration. For example, the present invention may be applied to an outdoor heat exchanger equipped with a side-flow fan, which is a fan attached to the side face of the heat exchanger. A problem with this type of outdoor heat exchanger is that, under conditions in which the amount of refrigerant flow through the header pipe 21 is small, liquid refrigerant does not flow to the upper portion of the header pipe 21. The present invention is able to address this problem, thus improving the efficiency of the heat exchanger.

On the basis of an experiment conducted by the inventors, the effective channel cross-sectional area [$mm^2$] of the header pipe 21, which corresponds to "A" illustrated in FIGS. 8, 9, 10, 13, and 14, is defined as "A". In this case, desirably, the quality x of refrigerant flowing through the header pipe 21 satisfies the condition of $0.05 \leq x \leq 0.30$. The maximum flow rate [kg/h] of refrigerant through the second header 20 is defined as $M_R$. $M_R$ is the refrigerant flow rate [kg/h] whose representative value is the maximum value within the variation range of the flow rate of refrigerant through the header pipe 21 and that is the refrigerant flow rate under rated heating operation condition when the outdoor heat exchanger 10 acts as an evaporator.

Figure 17:
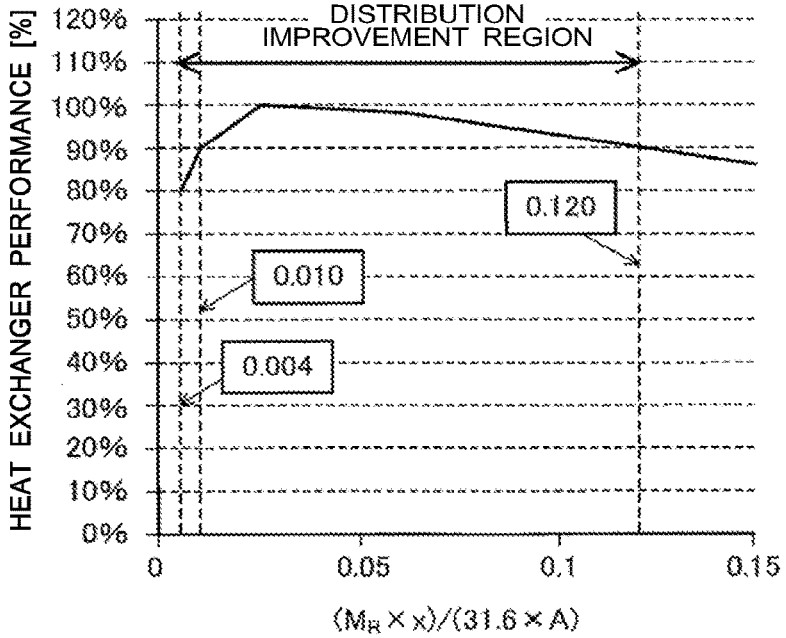
FIG. 17 illustrates the relationship between a parameter of $(M_R \times x)/(31.6 \times A)$, which is related to the thickness of a liquid phase, and heat exchanger performance, according to Embodiment 1 of the present invention.

FIG. 17 illustrates the relationship between a parameter of $(M_R \times x)/(31.6 \times A)$, which is related to the thickness of the liquid phase, and the performance of the outdoor heat exchanger 10, according to Embodiment 1 of the present invention.

As illustrated in FIG. 17, desirably, the parameter of $(M_R \times x)/(31.6 \times A)$, which is related to the thickness of the liquid phase of refrigerant in a two-phase gas-liquid state, satisfies the condition of $0.004 \leq (M_R \times x)/(31.6 \times A) \leq 0.120$.

This is because satisfying this condition makes it possible to keep performance degradation of the outdoor heat exchanger 10 within 20%.

More desirably, the parameter of $(M_R \times x)/(31.6 \times A)$ related to the thickness of the liquid phase satisfies the condition of $0.010 \leq (M_R \times x)/(31.6 \times A) \leq 0.120$.

This is because satisfying this condition makes it possible to attain a marked improvement in distribution performance over a wide range of operating conditions.

Figure 18:
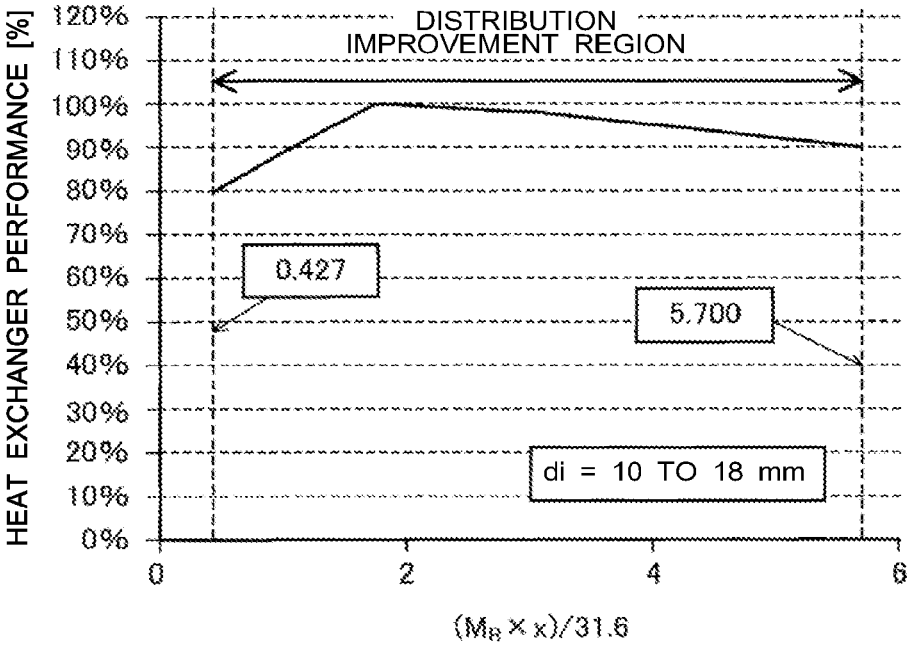
FIG. 18 illustrates the relationship between a parameter of $(M_R \times x)/31.6$, which is related to the thickness of a liquid phase, and heat exchanger performance, according to Embodiment 1 of the present invention.

FIG. 18 illustrates the relationship between a parameter of $(M_R \times x)/31.6$, which is related to the thickness of the liquid phase, and the performance of the outdoor heat exchanger 10, according to Embodiment 1 of the present invention.

As illustrated in FIG. 18, desirably, the inner diameter di of the header pipe 21 is in the range of 10 mm≤di≤18 mm, the heat transfer tubes 12 have the same length, and the parameter of $(M_R \times x)/31.6$ related to the thickness of the liquid phase satisfies the condition of $0.427 \leq (M_R \times x)/31.6 \leq 5.700$.

This is because satisfying this condition makes it possible to keep performance degradation of the outdoor heat exchanger 10 within 20%.

Figure 19:
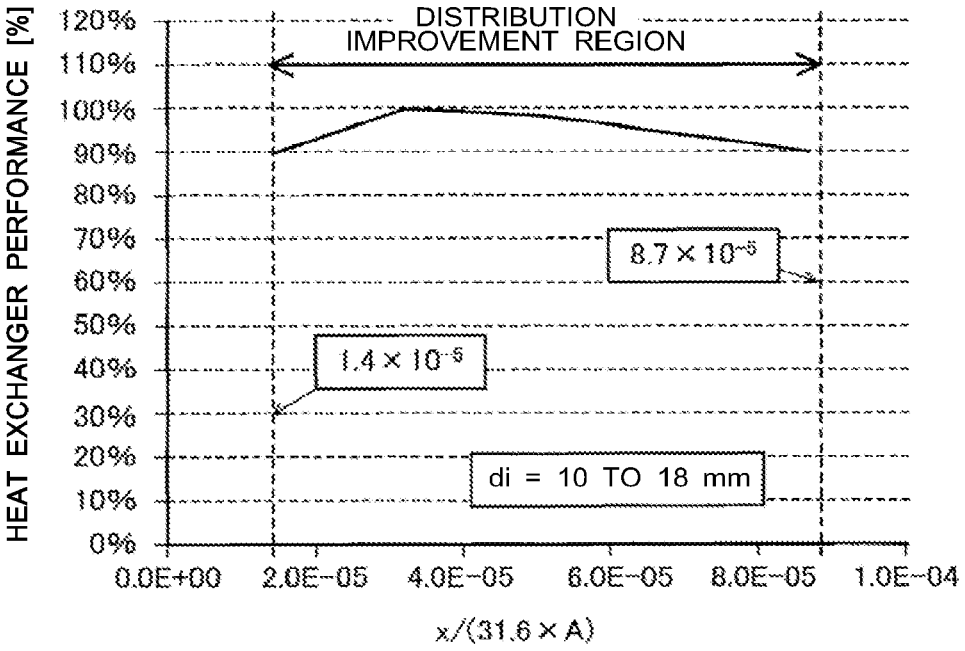
FIG. 19 illustrates the relationship between a parameter of $x/(31.6 \times A)$, which is related to the thickness of a liquid phase, and heat exchanger performance, according to Embodiment 1 of the present invention.

FIG. 19 illustrates the relationship between a parameter of $x/(31.6 \times A)$, which is related to the thickness of the liquid phase, and the performance of the outdoor heat exchanger 10, according to Embodiment 1 of the present invention.

As illustrated in FIG. 19, desirably, the inner diameter di of the header pipe 21 is in the range of 10 mm≤di≤18 mm, the heat transfer tubes 12 have the same length, and the parameter of $x/(31.6 \times A)$ related to the thickness of the liquid phase satisfies the condition of $1.4 \times 10^{-5} \leq x/(31.6 \times A) \leq 8.7 \times 10^{-5}$.

This is because satisfying this condition makes it possible to keep performance degradation of the outdoor heat exchanger 10 within 20%.

Figure 20:
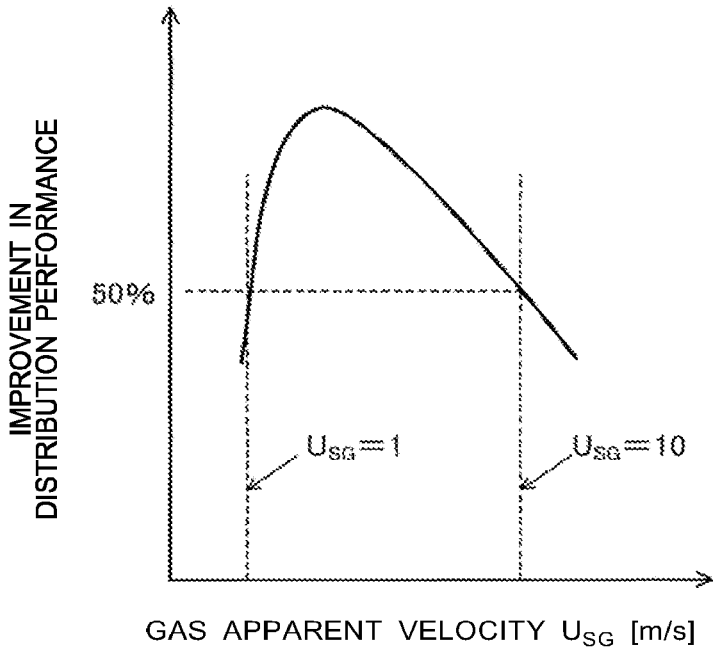
FIG. 20 illustrates the relationship between gas apparent velocity $U_{SG}$ and improvement in distribution performance, according to Embodiment 1 of the present invention.

FIG. 20 illustrates the relationship between gas apparent velocity $U_{SG}$ [m/s] and improvement in distribution performance, according to Embodiment 1 of the present invention.

As illustrated in FIG. 20, desirably, the gas apparent velocity $U_{SG}$ satisfies the range condition of $1 \leq U_{SG} \leq 10$.

Satisfying this range condition makes it possible to keep performance degradation due to poor distribution within ½ for the second header 20.

The gas apparent velocity $U_{SG}$ [m/s] in this case is defined as $U_{SG}=(G \times x)/\rho_G$, where G is the flow velocity of refrigerant [$kg/(m^2s)$] through the header pipe 21, x is the refrigerant quality, and $\rho_G$ is the refrigerant gas density [$kg/m^3$].

The refrigerant flow velocity G [$kg/(m^2s)$] is defined as $G=M_R/(3{,}600 \times A \times 10^{-6})$, where $M_R$ is the maximum flow rate [kg/h] of refrigerant through the second header 20, and A is the effective channel cross-sectional area [$mm^2$] of the header pipe 21.

Figure 21:
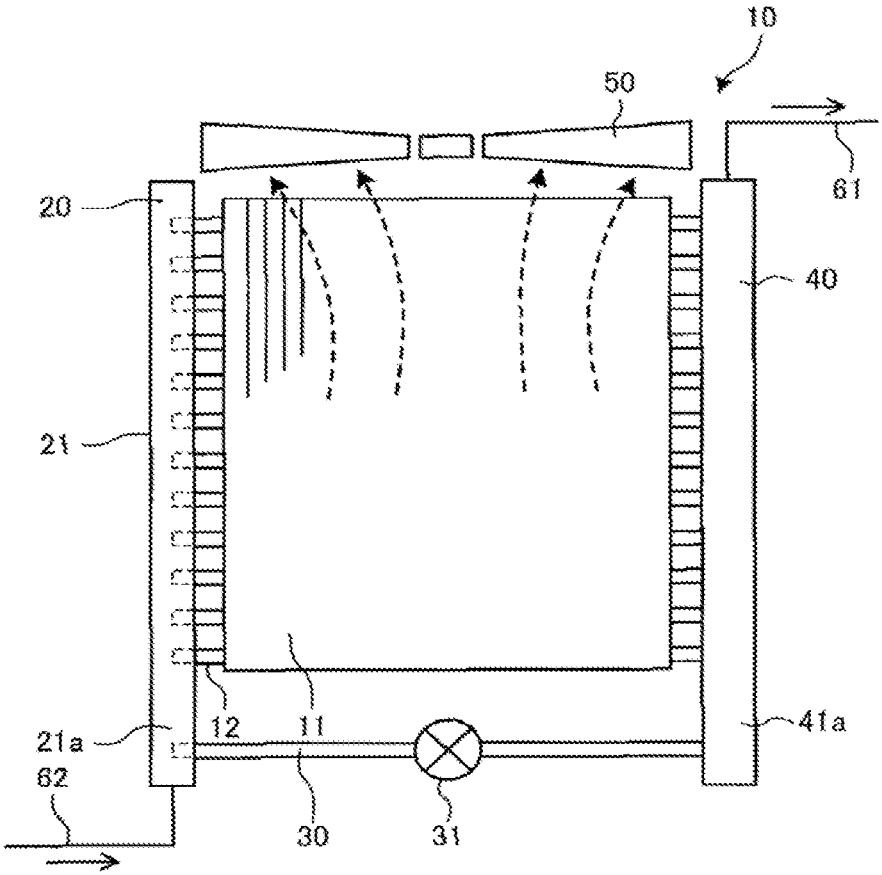
FIG. 21 is a schematic side view of another exemplary outdoor heat exchanger, according to Embodiment 1 of the present invention.

FIG. 21 is a schematic side view of another example of the outdoor heat exchanger 10, according to Embodiment 1 of the present invention.

As illustrated in FIG. 21, the outlet pipe 61 may be connected not to the lower portion of the first header 40 but to the upper portion of the first header 40.

Such a configuration is more desirable as the flow of liquid refrigerant to the upper portion of the header pipe 21 of the second header 20 can be facilitated.

The type of refrigerant flowing through the second header 20 is not particularly limited. However, using R32, R410A, or $CO_2$, which has a high gas density, as a refrigerant is desirable as the performance of the outdoor heat exchanger 10 is increased.

It is desirable to use a refrigerant mixture of two or more refrigerants with different boiling points selected from the group consisting of, but not limited to, an olefin-based refrigerant such as R1234yf and R1234ze(E), an HFC refrigerant such as R32, a hydrocarbon refrigerant such as propane and isobutane, $CO_2$, and dimethyl ether (DME). This is because using such a refrigerant mixture increases the improvement in the performance of the outdoor heat exchanger 10 that can be obtained by improved distribution performance.

According to Embodiment 1, the outdoor heat exchanger 10 includes the plurality of heat transfer tubes 12. The outdoor heat exchanger 10 includes the first header 40 connected to one end portion of each of the heat transfer tubes 12. The outdoor heat exchanger 10 includes the second header 20 connected to the other end portion of each of the heat transfer tubes 12. The outdoor heat exchanger 10 includes the plurality of fins 11 joined to each of the heat transfer tubes 12. The outdoor heat exchanger 10 constitutes a portion of a refrigeration cycle circuit in which refrigerant circulates. The second header 20 has the plurality of branch tubes 22 each connected to a corresponding one of the heat transfer tubes 12, or the plurality of heat transfer tubes 12 extended to serve as the plurality of branch tubes. The second header 20 includes the header pipe 21. The header pipe 21 defines a flow space. The flow space is communicated with the heat transfer tubes 12 or the branch tubes 22 and, when the outdoor heat exchanger 10 acts as an evaporator, allows refrigerant in a two-phase gas-liquid state to pass through the flow space and to flow out into the heat transfer tubes 12 or the branch tubes 22. The header pipe 21 has the entrance portion 21*a*. The entrance portion 21*a* is a portion of the header pipe 21 extending from the connection end portion of the header pipe 21 connected to the inlet pipe 62, which is a refrigerant pipe, to one of the heat transfer tubes 12 or the branch tubes 22 into which the refrigerant in a two-phase gas-liquid state first flows. The bypass pipe 30 is disposed between the entrance portion 21*a* of the second header 20 and the first header 40 and configured to bypass refrigerant. The bypass pipe 30 is provided with the flow control valve 31 to control the flow rate of refrigerant.

With this configuration, gas refrigerant is directed to the bypass pipe 30 from the second header 20 through which refrigerant in a two-phase gas-liquid state flows. Consequently, the flow of refrigerant in the header pipe 21 of the second header 20 can be adjusted to follow an annular or churn flow pattern, thus improving the distribution of refrigerant to each of the heat transfer tubes 12 or each branch tube 22. Efficiency of the outdoor heat exchanger 10 is thus improved. Distribution performance can therefore be improved over a wide operating range, leading to improved energy efficiency.

That is, for the second header 20 with the heat transfer tubes 12 or the branch tubes 22 inserted at one end to the central portion of the header pipe 21, gas refrigerant is directed to the bypass pipe 30. The flow of refrigerant in the header pipe 21 can be thus adjusted to follow an annular or churn flow pattern. As a result, refrigerant flows in the header pipe 21 in such a manner that gas refrigerant is concentrated in the central portion of the header pipe 21 and liquid refrigerant is concentrated in the annular portion of the header pipe 21. Refrigerant can be thus distributed in such a manner that a large amount of gas refrigerant can be allowed to selectively flow from the lower portion of the header pipe 21. Thus, a distribution ratio that the amount of liquid refrigerant being distributed increases progressively from the lower portion toward the upper portion of the header pipe 21. Consequently, refrigerant can be distributed along the distribution of airflow provided by the top-flow fan 50, leading to enhanced performance of the outdoor heat exchanger 10. In this regard, the flow rate of refrigerant varies greatly with factors such as the operating condition of or load on the outdoor heat exchanger 10. By contrast, the quality of refrigerant can be controlled by the opening degree of an expansion valve attached to the upper portion of the outdoor unit 100. The distribution of refrigerant can be thus improved to suit the top-flow fan 50 over a wide range of operating conditions. The efficiency of the outdoor heat exchanger 10 can therefore be improved over a wide operating range. Although the above-mentioned improvement effect is particularly pronounced for the fan 50 that is of a top-flow type, side-flow fans also suffer from the same problem as top-flow fans in that liquid refrigerant does not readily flow to the upper portion of the header pipe. Thus, also for side-flow fans, the present invention makes it possible to facilitate flow of liquid refrigerant to the upper portion to thereby improve the distribution of refrigerant, leading to improved performance of the outdoor heat exchanger 10.

According to Embodiment 1, the second header 20 is a vertical header that extends in the vertical direction.

This configuration provides the following effect. That is, for the second header 20 with the heat transfer tubes 12 or the branch tubes 22 inserted at one end to the central portion of the header pipe 21, gas refrigerant is directed to the bypass pipe 30. The flow pattern of refrigerant in the header pipe 21, which extends in the vertical direction, can be thus adjusted to follow an annular or churn flow pattern. As a result, refrigerant flows in the header pipe 21 in such a manner that gas refrigerant is concentrated in the central portion of the header pipe 21 and liquid refrigerant is concentrated in the annular portion of the header pipe 21. Refrigerant can be thus distributed in such a manner that a large amount of gas refrigerant can be allowed to selectively flow from the lower portion of the header pipe 21. Thus, a distribution ratio that the amount of liquid refrigerant being distributed increases progressively from the lower portion toward the upper portion of the header pipe 21.

According to Embodiment 1, the bypass pipe 30 has a distal end portion inserted in the flow space of the entrance portion 21*a* of the header pipe 21. The distal end portion of the bypass pipe 30 is connected in such a manner that the distal end portion penetrates the liquid phase of refrigerant in a two-phase gas-liquid state flowing in the header pipe 21 and reaches the gas phase of the refrigerant.

In this regard, the thickness of the liquid phase δ [m] is defined as $\delta = G \times (1-x) \times D/(4\rho_L \times U_{LS})$, where $U_{LS}$ is the liquid apparent velocity [m/s] at the maximum value within the variation range of the refrigerant flow rate $M_R$, which is the flow rate [kg/h] of refrigerant through the flow space of the header pipe 21, x is the refrigerant quality, G is the refrigerant flow velocity [kg/(m$^2$s)], $\rho_L$ is the refrigerant liquid density [kg/m$^3$], and D is the inner diameter [m] of the flow space of the header pipe 21 on an orthogonal plane orthogonal to the direction of refrigerant flow. The liquid apparent velocity $U_{LS}$ [m/s] is defined as $U_{LS} = G\ (1-x)/\rho_L$. The refrigerant flow velocity G [kg/(m$^2$s)] is defined as $G = M_R/(3{,}600 \times (D/2)^2 \times 3.14)$.

With this configuration, the distal end portion of the bypass pipe 30 penetrates the liquid phase of refrigerant in a two-phase gas-liquid state flowing in the header pipe 21 and reaches the gas phase of the refrigerant. Gas refrigerant is thus directed to the bypass pipe 30 from the second header 20 through which the refrigerant in a two-phase gas-liquid state flows. Consequently, the flow of refrigerant in the header pipe 21 of the second header 20 can be adjusted to follow an annular or churn flow pattern, thus improving the distribution of refrigerant to each heat transfer tube 12 or each branch tube 22. Efficiency of the outdoor heat exchanger 10 is thus improved.

According to Embodiment 1, the bypass pipe 30 has a distal end portion inserted in the flow space of the header pipe 21. The center position of the flow space of the header pipe 21 in an orthogonal plane orthogonal to the direction of refrigerant flow is defined as 0%. The wall surface position of the flow space of the header pipe 21 on the orthogonal plane is defined as ±100%. In this case, the distal end portion of the bypass pipe 30 is located within the area of ±50%.

This configuration makes it possible to obtain an improvement in the distribution of refrigerant to the heat transfer tubes 12 by utilizing the characteristics of annular or churn flow pattern.

According to Embodiment 1, the center position of the flow space of the header pipe 21 on an orthogonal plane orthogonal to the direction of refrigerant flow is defined as 0%. The wall surface position of the flow space of the header pipe 21 on the orthogonal plane is defined as ±100%. The direction of insertion of the bypass pipe 30 on the orthogonal plane is defined as X-direction. The width direction of the bypass pipe 30 orthogonal to the X-direction on the orthogonal plane is defined as Y-direction. In this case, the distal end portion of the bypass pipe 30 is located within the area of ±50% in the X-direction. The central axis of the bypass pipe 30 is located within the area of ±50% in the Y-direction.

This configuration makes it possible to obtain an improvement in the distribution of refrigerant to the heat transfer tubes 12 by utilizing the characteristics of annular or churn flow pattern.

According to Embodiment 1, the bypass pipe 30 has a distal end portion inserted in the flow space of the header pipe 21. The center position of the flow space of the header pipe 21 on an orthogonal plane orthogonal to the direction of refrigerant flow is defined as 0%. The wall surface position of the flow space of the header pipe 21 on the orthogonal plane is defined as ±100%. In this case, the distal end portion of the bypass pipe 30 is located within the area of ±25%.

This configuration makes it possible to obtain stable improvement in the distribution of refrigerant to the heat transfer tubes 12 even under low refrigerant quality conditions.

According to Embodiment 1, the bypass pipe 30 has a distal end portion inserted in the flow space of the header pipe 21. The distal end portion of the bypass pipe 30 is located in the central portion of the flow space of the header pipe 21 on an orthogonal plane orthogonal to the direction of refrigerant flow.

With this configuration, the distal end portion of the bypass pipe 30 is inserted in the central portion of the flow path inside the header pipe 21. Consequently, when the flow pattern of refrigerant is annular or churn, gas refrigerant can be selectively bypassed to the bypass pipe 30. This operation makes it possible to control the state of refrigerant flow to thereby achieve improved distribution of refrigerant. Further, gas refrigerant, which hardly contributes to heat exchange, is bypassed to the bypass pipe 30. This operation helps reduce pressure loss in the outdoor heat exchanger 10, leading to enhanced efficiency of the outdoor heat exchanger 10.

According to Embodiment 1, the flow control valve 31 allows refrigerant to pass through the bypass pipe 30 when the outdoor heat exchanger 10 acts as an evaporator. The flow control valve 31 does not allow refrigerant to pass through the bypass pipe 30 when the outdoor heat exchanger 10 acts as a condenser.

With this configuration, the flow control valve 31 allows gas refrigerant to be bypassed through the bypass pipe 30 when the outdoor heat exchanger 10 acts as an evaporator. Consequently, the flow of refrigerant in the header pipe 21 of the second header 20 can be adjusted to follow an annular or churn flow pattern, thus improving the distribution of refrigerant to each heat transfer tube 12 or each branch tube 22. Efficiency of the outdoor heat exchanger 10 is thus improved.

The flow control valve 31 does not allow refrigerant to be bypassed through the bypass pipe 30 when the outdoor heat exchanger 10 acts as a condenser. This configuration allows more gas refrigerant to be directed into the outdoor heat exchanger 10 from the first header 40, thus improving the distribution of refrigerant to each heat transfer tube 12 or each branch tube. Efficiency of the outdoor heat exchanger 10 is thus improved.

According to Embodiment 1, each of the heat transfer tubes 12 or the branch tubes 22 has a distal end portion inserted in the flow space of the header pipe 21. The center position of the flow space of the header pipe 21 on an orthogonal plane orthogonal to the direction of refrigerant flow is defined as 0%. The wall surface position of the flow space of the header pipe 21 on the orthogonal plane is defined as ±100%. In this case, the distal end portions of most of the heat transfer tubes 12 or the branch tubes 22 are located within the area of ±50%.

With this configuration, gas refrigerant is bypassed through the bypass pipe 30, thus allowing the flow of refrigerant in the header pipe 21 to be adjusted to follow an annular or churn flow pattern. For annular or churn flow, a large amount of gas refrigerant is distributed close to the center of the header pipe 21, and a large amount of liquid refrigerant is distributed close to the annular portion of the header pipe 21. As the distal end portions of the heat transfer tubes 12 or the branch tubes 22 are positioned within the area of ±50 as described above, a large amount of gas refrigerant is selectively distributed in the lower portion of the header pipe 21, thus facilitating the flow of liquid refrigerant to the upper portion of the header pipe 21. This configuration leads to improved refrigerant distribution performance, and consequently, improved efficiency of the outdoor heat exchanger 10.

According to Embodiment 1, with rated heating operation being defined as maximum refrigerant flow rate condition, under the maximum refrigerant flow rate condition, the quality x of refrigerant flowing through the header pipe 21 satisfies the condition of $0.05 \leq x \leq 0.30$. Further, the flow pattern is annular or churn.

With this configuration, gas refrigerant is bypassed through the bypass pipe 30, thus allowing the flow of refrigerant in the header pipe 21 to be adjusted to follow an annular or churn flow pattern. For annular or churn flow, a large amount of gas refrigerant is distributed close to the center of the header pipe 21, and a large amount of liquid refrigerant is distributed close to the annular portion of the header pipe 21. As a result, a large amount of gas refrigerant is selectively distributed in the lower portion of the header pipe 21, thus facilitating the flow of liquid refrigerant to the upper portion of the header pipe 21. This configuration leads to improved refrigerant distribution performance, and consequently, improved efficiency of the outdoor heat exchanger 10.

According to Embodiment 1, with rated heating operation being defined as maximum refrigerant flow rate condition, under the maximum refrigerant flow rate condition, the quality x of refrigerant flowing through the header pipe 21 satisfies the condition of $0.05 \leq x \leq 0.30$. The reference gas apparent velocity $U_{GS}$ [m/s] at the maximum value within the variation range of the refrigerant flow rate $M_R$ [kg/h], which represents the flow rate of refrigerant through the header pipe 21, satisfies the condition of $U_{GS} \geq \alpha \times L \times (g \times D)^{0.5}/(40.6 \times D) - 0.22\alpha \times (g \times D)^{0.5}$, where $\alpha$ is the refrigerant void fraction, L is the entrance distance [m], g is the acceleration of gravity [m/s$^2$], and D is the inner diameter of the flow space of the header pipe 21 on an orthogonal plane orthogonal to the direction of refrigerant flow.

The refrigerant void fraction $\alpha$ is defined as $\alpha=x/[x+(\rho_G/\rho_L)\times(1-x)]$, where x is the refrigerant quality, $\rho_G$ is the refrigerant gas density [kg/m$^3$], and $\rho_L$ is the refrigerant liquid density [kg/m$^3$]. The entrance distance L is defined as the distance between the connection end portion of the header pipe 21 connected to the inlet pipe 62, and the central axis of the bypass pipe 30 inserted in the header pipe 21.

With this configuration, in the header pipe 21 through which refrigerant in a two-phase gas-liquid state flows upward, the refrigerant flow follows an annular or churn flow pattern. For annular or churn flow, a large amount of gas refrigerant is distributed close to the center of the header pipe 21, and a large amount of liquid refrigerant is distributed close to the annular portion of the header pipe 21. Thus, when the condition of $U_{GS}\geq\alpha\times L\times(g\times D)^{0.5}/(40.6\times D)-0.22\alpha\times(g\times D)^{0.5}$ is satisfied, a large amount of gas refrigerant is selectively distributed in the lower portion of the header pipe 21, thus facilitating the flow of liquid refrigerant to the upper portion of the header pipe 21. This configuration helps improve the distribution performance of the second header 20 and consequently improve the efficiency of the outdoor heat exchanger 10, leading to enhanced energy efficiency.

According to Embodiment 1, the reference gas apparent velocity $U_{GS}$ [m/s] satisfies the condition of $U_{GS}\geq3.1/(\rho_G^{0.5})\times[\sigma\times g\times(\rho_L-\rho_G)]^{0.25}$, where $\rho_G$ is the refrigerant gas density [kg/m$^3$], $\rho_L$ is the refrigerant liquid density [kg/m$^3$], $\sigma$ is the refrigerant surface tension [N/m], and g is the acceleration of gravity [m/s$^2$].

With this configuration, in the header pipe 21 through which refrigerant in a two-phase gas-liquid state flows upward, the refrigerant flow follows an annular or churn flow pattern. For such annular or churn flow, a large amount of gas refrigerant is distributed close to the center of the header pipe 21, and a large amount of liquid refrigerant is distributed close to the annular portion of the header pipe 21. Thus, when the condition of $U_{GS}\geq3.1/(\rho_G^{0.5})\times[\sigma\times g\times(\rho_L-\rho_G)]^{0.25}$ is satisfied, a large amount of gas refrigerant is selectively distributed in the lower portion of the header pipe 21, thus facilitating the flow of liquid refrigerant to the upper portion of the header pipe 21. This configuration helps improve the distribution performance of the second header 20 and consequently improve the efficiency of the outdoor heat exchanger 10, leading to enhanced energy efficiency.

According to Embodiment 1, the center position of the flow space of the header pipe 21 on an orthogonal plane orthogonal to the direction of refrigerant flow is defined as 0%. The wall surface position of the flow space of the header pipe 21 on the orthogonal plane is defined as ±100%. The direction of insertion of the heat transfer tubes 12 or the branch tubes 22 on the orthogonal plane is defined as X-direction. The width direction of the heat transfer tubes 12 or the branch tubes 22 orthogonal to the X-direction on the orthogonal plane is defined as Y-direction. In this case, the distal end portions of most of the heat transfer tubes 12 or the branch tubes 22 are located within the area of ±50% in the X-direction. The central axes of most of the heat transfer tubes 12 or the branch tubes 22 are located within the area of ±50% in the Y-direction.

With this configuration, a large amount of gas refrigerant is selectively distributed in the lower portion of the header pipe 21, thus facilitating the flow of liquid refrigerant to the upper portion of the header pipe 21. This configuration leads to improved refrigerant distribution performance, and consequently, improved efficiency of the outdoor heat exchanger 10.

According to Embodiment 1, the distal end portions of most of the heat transfer tubes 12 or the branch tubes 22 are located within the area of ±25% in the X-direction. The central axes of most of the heat transfer tubes 12 or the branch tubes 22 are located within the area of ±25% in the Y-direction.

This configuration makes it possible to obtain stable improvement in the distribution of refrigerant even under low refrigerant quality conditions, leading to improved efficiency of the outdoor heat exchanger 10.

According to Embodiment 1, the distal end portions of most of the heat transfer tubes 12 or the branch tubes 22 are located at the 0% position in the X-direction. The central axes of most of the heat transfer tubes 12 or the branch tubes 22 are located at the 0% position in the Y-direction.

This configuration makes it possible to obtain a particularly great improvement in the distribution of refrigerant, leading to improved efficiency of the outdoor heat exchanger 10.

According to Embodiment 1, the effective channel cross-sectional area [mm$^2$] of the header pipe 21 is defined as "A". The quality of part of refrigerant separated at the bypass pipe 30 and flowing in the header pipe 21 during rated heating operation is defined as x. The flow rate of refrigerant [kg/h] is defined as $M_R$. In this case, the quality x of refrigerant satisfies the condition of $0.05\leq x\leq0.30$. The parameter of $(M_R\times x)/(31.6\times A)$ related to the thickness of the liquid phase satisfies the condition of $0.004\leq(M_R\times x)/(31.6\times A)\leq0.120$.

This configuration makes it possible to reduce the flow resistance difference between the heat transfer tubes 12 or the branch tubes 22, thus providing refrigerant distribution performance optimized for the distribution of airflow provided by the top-flow fan 50. This effect helps improve the efficiency of the outdoor heat exchanger 10.

According to Embodiment 1, the parameter of $(M_R\times x)/(31.6\times A)$ related to the thickness of the liquid phase satisfies the condition of $0.010\leq(M_R\times x)/(31.6\times A)\leq0.120$.

This configuration allows for further reduction in the flow resistance difference between the heat transfer tubes 12 or the branch tubes 22, thus providing refrigerant distribution performance further optimized for the distribution of airflow provided by the top-flow fan 50. This effect helps further improve the efficiency of the outdoor heat exchanger 10.

According to Embodiment 1, the effective channel cross-sectional area [mm$^2$] of the header pipe 21 is defined as "A". The quality of part of refrigerant separated at the bypass pipe 30 and flowing in the header pipe 21 during rated heating operation is defined as x. The flow rate of refrigerant [kg/h] is defined as $M_R$. The inner diameter [mm] of the flow space of the header pipe 21 on an orthogonal plane orthogonal to the direction of refrigerant flow is defined as di. In this case, the quality x of refrigerant satisfies the condition of $0.05\leq x\leq0.30$. The heat transfer tubes 12 have the same length. The inner diameter di satisfies the condition of $10\leq di\leq18$. The parameter of $(M_R\times x)/31.6$ related to the thickness of the liquid phase satisfies the condition of $0.427\leq(M_R\times x)/31.6\leq5.700$.

This configuration provides refrigerant distribution performance optimized for the distribution of airflow provided by the top-flow fan 50, leading to improved efficiency of the outdoor heat exchanger 10.

According to Embodiment 1, the effective channel cross-sectional area [mm$^2$] of the header pipe 21 is defined as "A". The quality of part of refrigerant separated at the bypass pipe 30 and flowing in the header pipe 21 during rated heating operation is defined as x. The inner diameter [mm] of the flow space of the header pipe 21 on an orthogonal plane orthogonal to the direction of refrigerant flow is defined as di. In this case, the quality x of refrigerant satisfies the condition of $0.05 \leq x \leq 0.30$. The heat transfer tubes 12 have the same length. The inner diameter di satisfies the condition of $10 \leq di \leq 18$. The parameter of $x/(31.6 \times A)$ related to the thickness of the liquid phase satisfies the condition of $1.4 \times 10^{-5} \leq x/(31.6 \times A) \leq 8.7 \times 10^{-5}$.

This configuration provides refrigerant distribution performance optimized for the distribution of airflow provided by the top-flow fan 50, leading to improved efficiency of the outdoor heat exchanger 10.

According to Embodiment 1, the effective channel cross-sectional area [$mm^2$] of the header pipe 21 is defined as "A". The quality of part of refrigerant separated at the bypass pipe 30 and flowing in the header pipe 21 during rated heating operation is defined as x. The flow rate of refrigerant [kg/h] is defined as $M_R$. In this case, the quality x of refrigerant satisfies the condition of $0.05 \leq x \leq 0.30$. The gas apparent velocity $U_{SG}$ [m/s] of part of refrigerant separated at the bypass pipe 30 and flowing in the header pipe 21 satisfies the condition of $1 \leq U_{SG} \leq 10$.

The gas apparent velocity $U_{SG}$ [m/s] in this case is defined as $U_{SG}=(G \times x)/\rho_G$, where G is the flow velocity of part of refrigerant [kg/($m^2$s)] separated at the bypass pipe 30 and flowing in the header pipe 21, x is the refrigerant quality, and $\rho_G$ is the refrigerant gas density [kg/$m^3$]. The refrigerant flow velocity G [kg/($m^2$s)] of part of refrigerant is separated at the bypass pipe 30 and flows in the header pipe 21 is defined as $M_R/(3{,}600 \times A \times 10^{-6})$.

This configuration provides refrigerant distribution performance optimized for the distribution of airflow provided by the top-flow fan 50, leading to improved efficiency of the outdoor heat exchanger 10.

According to Embodiment 1, the second header 20 includes the plurality of branch tubes 22 each connected to a corresponding one of the heat transfer tubes 12. The flow space of the header pipe 21 is communicated with the branch tubes 22.

With this configuration, the heat transfer tubes 12 and the branch tubes 22 are connected to each other, and the second header 20 is connected to the outdoor heat exchanger 10. Consequently, the second header 20 and the outdoor heat exchanger 10 can be fabricated as separate components through different manufacturing processes, thus allowing for easy fabrication.

According to Embodiment 1, R32, R410A, or $CO_2$ is used as a refrigerant.

With this configuration, a refrigerant with high gas density is used. This configuration allows for greater improvement in the refrigerant distribution performance of the second header 20.

According to Embodiment 1, a refrigerant mixture of two or more refrigerants with different boiling points selected from the group consisting of an olefin-based refrigerant, an HFC refrigerant, a hydrocarbon refrigerant, $CO_2$, and DME is used as a refrigerant.

This configuration helps mitigate differences in refrigerant density distribution resulting from deterioration of refrigerant distribution performance. This effect increases the improvement in refrigerant distribution performance, leading to improved efficiency of the outdoor heat exchanger 10.

Embodiment 2

Embodiment 2 of the present invention will be described below. In the following, a description will not be given of features overlapping those of Embodiment 1, and portions identical or corresponding to those of Embodiment 1 will be designated by the same reference signs.

Figure 22:
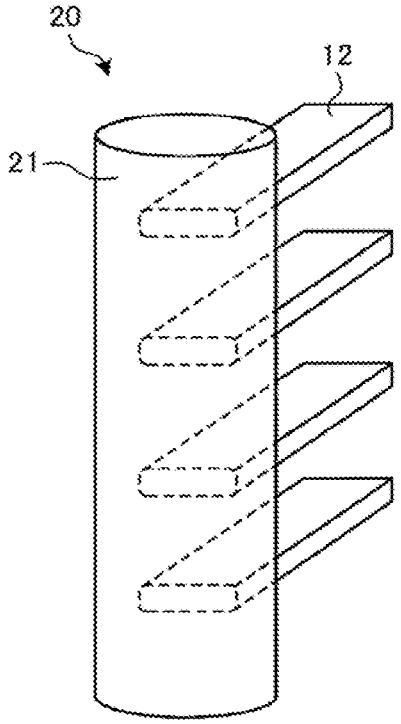
FIG. 22 is a perspective view of a second header, according to Embodiment 2 of the present invention.
Figure 23:
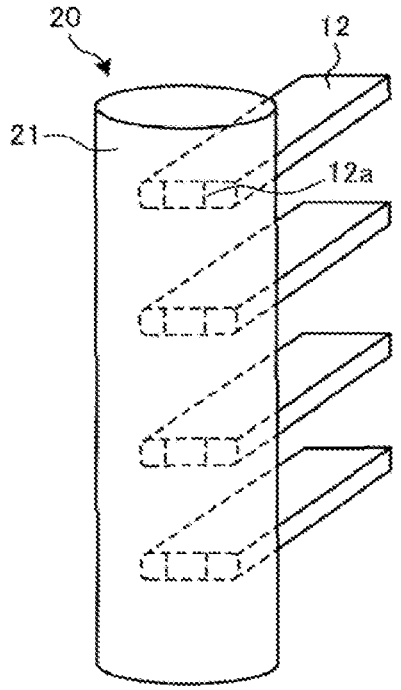
FIG. 23 is a perspective view of an exemplary second header, according to Embodiment 2 of the present invention.

FIG. 22 is a perspective view of the second header 20, according to Embodiment 2 of the present invention. FIG. 23 is a perspective view of an example of the second header 20, according to Embodiment 2 of the present invention.

In Embodiment 2, the heat transfer tube 12 is in the form of a flat tube as illustrated in FIG. 22. Alternatively, the heat transfer tube 12 is in the form of a flat perforated tube as illustrated in FIG. 23. For the flat perforated tube configuration, partitions 12*a* are disposed inside the flat tube to define a plurality of holes.

As illustrated in FIGS. 22 and 23, each of the heat transfer tubes 12 is in the form of a flat tube or flat perforated tube. The heat transfer tubes 12 are directly connected to the header pipe 21. Employing such a configuration is desirable as the outdoor heat exchanger 10 can be constructed from a reduced number of components.

More desirably, as with the header pipe 21 according to Embodiment 1 formed as a circular tube, the heat transfer tube 12 formed as a flat tube or flat perforated tube is projected to a position close to the center of the inner diameter of the header pipe 21. This is because employing such a configuration not only improves refrigerant distribution performance but also improves brazing at the connection portion between the heat transfer tube 12 formed as a flat tube or flat perforated tube and the header pipe 21.

The expression "close to the center of the inner diameter" as used herein is defined in the same manner as in Embodiment 1. That is, the center of the inner diameter of the header pipe 21 is defined as 0%, and the position of the inner wall surface of the header pipe 21 is defined as ±100%. In this case, the above expression means that the distal end portion of the heat transfer tube 12 is located at least within the range of ±50%. More desirably, the distal end portion of the heat transfer tube 12 is located within the range of ±25%. Still more desirably, the distal end portion of the heat transfer tube 12 is located substantially at the center (0%) position of the header pipe 21.

For cases where the heat transfer tubes 12 in the form of flat tubes or flat perforated tubes are used, the number of heat transfer tubes 12 is typically greater than that when circular heat transfer tubes 12 are used. For this reason, the improvement in refrigerant distribution performance, which is obtained by inserting the heat transfer tubes 12 into the header pipe 21 in such a manner that the heat transfer tube 12 is located close to the center of the header pipe 21, becomes particularly more pronounced.

In Embodiment 2, the presence of the bypass pipe 30 positioned in the entrance portion 21*a* (not illustrated), which is located in the lower portion of the header pipe 21, makes it possible to control the state of refrigerant in a two-phase gas-liquid state in a portion of the header pipe 21 upper than the entrance portion 21*a*. This configuration makes it possible to reduce pressure loss in the heat transfer tube 12 of the outdoor heat exchanger 10, and also to control the distribution of refrigerant. The efficiency of the outdoor heat exchanger 10 can therefore be improved.

As with Embodiment 1, the bypass pipe 30 connected to the entrance portion 21*a* of the header pipe 21 is controlled so that refrigerant is bypassed only when the outdoor heat exchanger 10 is used as an evaporator. When the outdoor heat exchanger 10 is used as a condenser, the flow control valve 31 is controlled so that the flow control valve 31 closes and refrigerant is not bypassed through the bypass pipe 30.

According to Embodiment 2, each of the heat transfer tubes 12 or the branch tubes is in the form of a flat tube.

This configuration increases the influence of surface tension at the branching location between the header pipe 21 and the heat transfer tube 12 or the branch tube. This effect facilitates uniform flow of liquid refrigerant into the heat transfer tube 12 or the branch tube, leading to greater improvement in the efficiency of the outdoor heat exchanger 10.

According to Embodiment 2, each of the heat transfer tubes 12 or the branch tubes is in the form of a flat perforated tube.

This configuration increases the influence of surface tension at the branching location between the header pipe 21 and the heat transfer tube 12 or the branch tube. This effect facilitates uniform flow of liquid refrigerant into the heat transfer tube 12 or the branch tube, leading to greater improvement in the efficiency of the outdoor heat exchanger 10.

Embodiment 3

Embodiment 3 of the present invention will be described below. In the following, a description will not be given of features overlapping those of Embodiments 1 and 2, and portions identical or corresponding to those of Embodiments 1 and 2 will be designated by the same reference signs.

Figure 24:
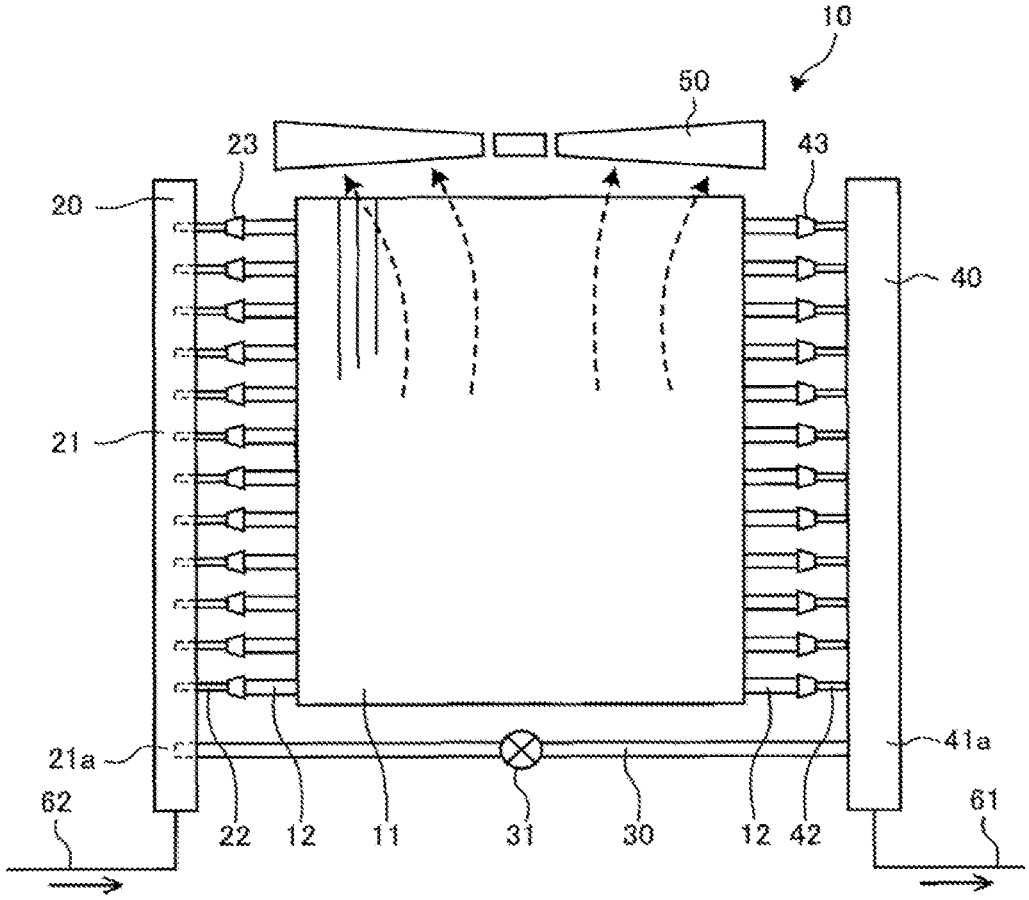
FIG. 24 is a schematic side view of an outdoor heat exchanger, according to Embodiment 3 of the present invention.
Figure 25:
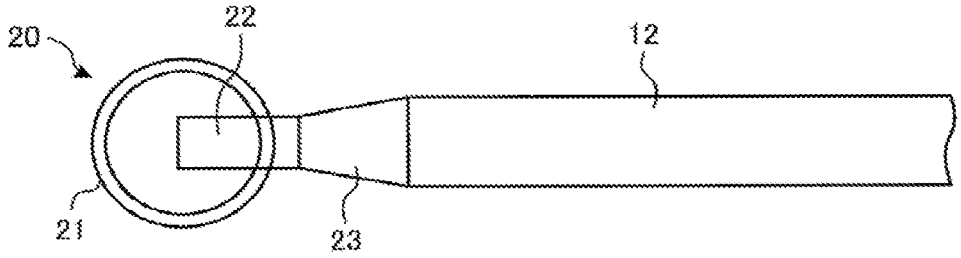
FIG. 25 is a top view of a second header and a heat transfer tube, according to Embodiment 3 of the present invention.

FIG. 24 is a schematic side view of the outdoor heat exchanger 10, according to Embodiment 3 of the present invention. FIG. 25 is a top view of the second header 20 and the heat transfer tube 12, according to Embodiment 3 of the present invention.

In Embodiment 3, the heat transfer tube 12 is in the form of a flat tube, and the heat transfer tube 12 and the branch tube 22 of the second header 20 are connected to each other by a tube-shape transforming joint 23.

As illustrated in FIGS. 24 and 25, the heat transfer tube 12 and the branch tube 22 of the second header 20 are connected to each other by the tube-shape transforming joint 23 while having their tube shapes transformed by the tube-shape transforming joint 23.

The tube-shape transforming joint 23 is able to change the tube shape of the branch tube 22. Alternatively, the tube-shape transforming joint 23 is able to reduce tube size. This configuration helps reduce the influence on flow pattern exerted by the distal end portion of the branch tube 22 inserted up to a position close to the center of the inner diameter of the header pipe 21.

As illustrated in FIG. 25, the tube-shape transforming joint 23 transforms the heat transfer tube 12 having a flat shape into the branch tube 22 having a circular shape, and the branch tube 22 is inserted into the header pipe 21. This configuration helps increase the effective channel cross-sectional area of the header pipe 21 as compared to when the heat transfer tube 12 having a flat shape is directly inserted into the header pipe 21. Such a configuration is desirable as the flow resistance can be reduced at the location where the branch tube 22 is inserted, leading to stable flow pattern and consequently greater improvement in refrigerant distribution performance.

As illustrated in FIG. 24, for the first header 40 as well, the heat transfer tube 12 and a branch tube 42 of the first header 40 are likewise connected to each other by a tube-shape transforming joint 43. The use of the tube-shape transforming joint 43 increases the effective channel cross-sectional area of a header pipe 41 of the first header 40. This configuration helps reduce pressure loss in the first header 40. This configuration also helps in miniaturization of the first header 40.

In Embodiment 3, the tube-shape transforming joint 23 is used for most of the heat transfer tubes 12. However, the tube-shape transforming joint may be used for only some of the heat transfer tubes.

The foregoing description of Embodiment 3 is directed to an example of the tube-shape transforming joint that transforms a flat heat transfer tube into a circular branch tube. However, an alternative configuration may use, for example, a tube-shape transforming joint that transforms a circular heat transfer tube into a circular branch tube with a reduced diameter. Any tube-shape transforming joint may be used as long as the tube-shape transforming joint is able to increase the effective channel cross-sectional area of the header pipe for cases where the distal end portion of the branch tube is inserted into the header pipe. Hence, the type of the tube-shape transforming joint to be used is not limited.

According to Embodiment 3, the tube-shape transforming joint 23 is disposed between the heat transfer tube 12 and the branch tube 22 to transform the tube shape of the heat transfer tube 12 into the tube shape of the distal end portion of the branch tube 22 inserted in the header pipe 21.

This configuration helps increase the effective channel cross-sectional area of the header pipe 21, thus reducing performance degradation of the outdoor heat exchanger 10 resulting from an increase in pressure loss in the header pipe 21.

Embodiment 4

Embodiment 4 of the present invention will be described below. In the following, a description will not be given of features overlapping those of Embodiments 1 to 3, and portions identical or corresponding to those of Embodiments 1 to 3 will be designated by the same reference signs.

Figure 26:
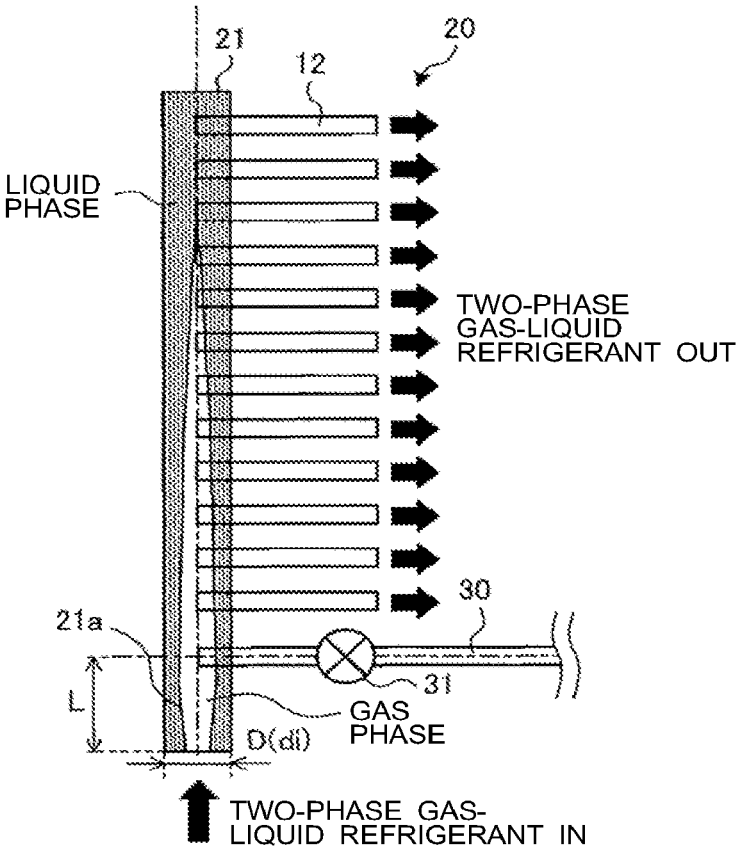
FIG. 26 is a schematic illustration of a second header, according to Embodiment 4 of the present invention.
Figure 27:
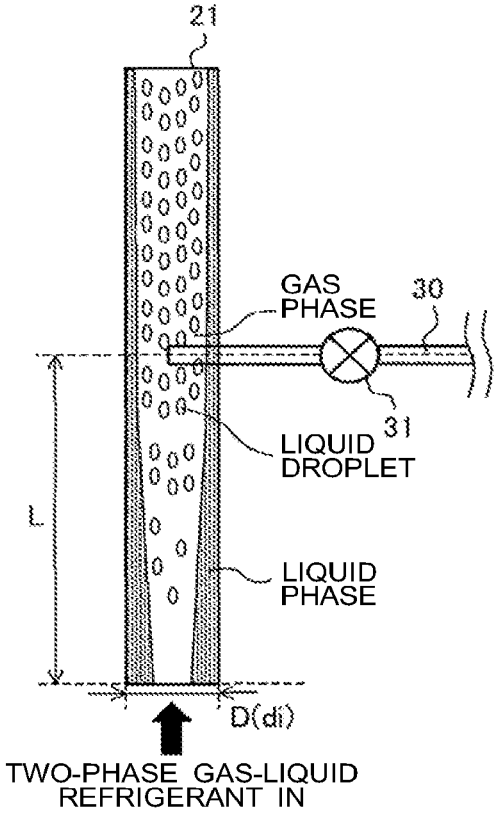
FIG. 27 is a schematic illustration of development of an annular flow in an entrance portion located in the lower portion of a header pipe, according to Embodiment 4 of the present invention.

FIG. 26 is a perspective view of the second header 20, according to Embodiment 4 of the present invention. FIG. 27 is a schematic illustration of development of an annular flow in the entrance portion 21*a* located in the lower portion of the header pipe 21, according to Embodiment 4 of the present invention.

In Embodiment 4, the radius of the header pipe 21 of the second header 20 is defined as di [mm]. The entrance distance, which is the distance in the entrance portion 21*a* of the second header 20 between the lowermost end portion connected to the inlet pipe 62 and the central axis of the bypass pipe 30, is defined as entrance distance L [m]. In this case, the entrance distance L satisfies the condition of $L \geq 5di$.

As illustrated in FIG. 26, the entrance distance L satisfies the condition of $L \geq 5di$.

When the outdoor heat exchanger 10 acts as an evaporator, the flow control valve 31 is opened to allow refrigerant to be passed through the bypass pipe 30 in the entrance portion 21*a* and then bypassed to the first header 40. At this time, the distal end portion of the bypass pipe 30 is inserted in the header pipe 21 at a position close to the center of the inner diameter of the header pipe 21. Consequently, when the flow of refrigerant entering the header pipe 21 is annular or churn, a large amount of gas refrigerant is distributed close to the center of the inner diameter of the header pipe 21. As a result, gas refrigerant is preferentially bypassed through the bypass pipe 30.

As gas refrigerant, which hardly contributes to heat exchange, is bypassed through the bypass pipe 30, reduction of in-tube pressure loss in the outdoor heat exchanger 10 can be expected. On the basis of an experiment conducted by the inventors, when the entrance distance L satisfies the condition of L≥5di as in Embodiment 4, the liquid film thickness of refrigerant in a two-phase gas-liquid state tends to become stable as illustrated in FIG. 27. This effect allows for stable bypassing of gas refrigerant through the bypass pipe 30, leading to reduced pressure loss in the outdoor heat exchanger 10. Such a configuration is more desirable also as stable control of the distribution of refrigerant in the header pipe 21 is allowed, leading to improved efficiency of the outdoor heat exchanger 10.

Figure 28:
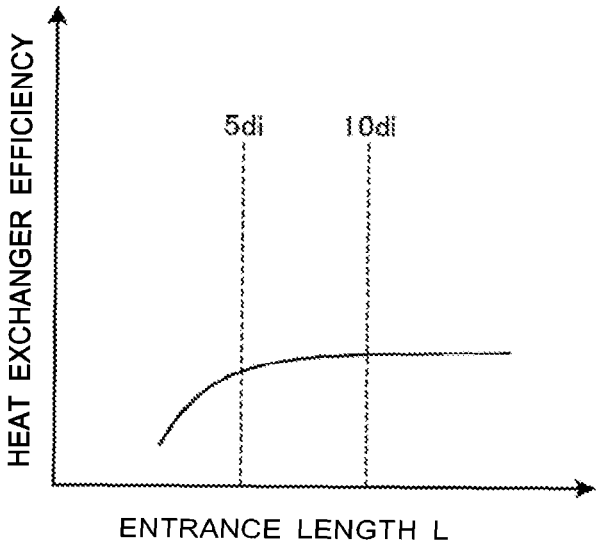
FIG. 28 is an exemplary graph of experimental data representing an exemplary relationship between entrance distance and heat exchanger efficiency, according to Embodiment 4 of the present invention.

FIG. 28 is an exemplary graph of experimental data representing an exemplary relationship between entrance distance L and heat exchanger efficiency, according to Embodiment 4 of the present invention.

As illustrated in FIG. 28, in the flow pattern of refrigerant in the header pipe 21, as the entrance distance L increases, more gas refrigerant tends to be distributed close to the center of the header pipe. This effect reduces the amount of liquid refrigerant flowing into the bypass pipe 30, leading to enhanced heat exchanger efficiency. It can be appreciated, however, that when the entrance distance L is defined as L≥5di, heat exchanger efficiency hardly differs from that when the entrance distance L is equal to 10 di, which is typically considered to be a sufficient entrance distance.

More desirably, the entrance distance L between the lowermost end portion of the header pipe 21 and the central axis of the bypass pipe 30 satisfies the condition of L≥10di, as sufficient development of the flow of two-phase gas-liquid refrigerant in the header pipe 21 can be allowed.

According to Embodiment 4, the entrance portion 21*a* has the entrance distance L [m], which is the distance between the connection end portion connected to the refrigerant pipe and the central axis of the bypass pipe 30. The entrance distance L [m] of the entrance portion 21*a* satisfies the condition of L≥5di, where di is the inner diameter [mm] of the flow space of the header pipe 21 on an orthogonal plane orthogonal to the direction of refrigerant flow. Where the center position of the flow space of the header pipe 21 on the orthogonal plane orthogonal to the direction of refrigerant flow is defined as 0%, and the wall surface position of the flow space of the header pipe 21 on the horizontal plane is defined as ±100%, the distal end portion of the bypass pipe 30 inserted in the header pipe 21 is located within the area of ±50%. The bypass pipe 30 has a distal end portion inserted in the flow space of the entrance portion 21*a* of the header pipe 21 at a position where a large amount of the gas phase of refrigerant is distributed.

This configuration allows for development of the flow pattern of refrigerant, thus increasing the improvement in the distribution of refrigerant that can be provided by the protrusion of the heat transfer tube 12 or the branch tube into the header pipe 21. Consequently, the efficiency of the outdoor heat exchanger 10 can be improved.

Embodiment 5

Embodiment 5 of the present invention will be described below. In the following, a description will not be given of features overlapping those of Embodiments 1 to 4, and portions identical or corresponding to those of Embodiments 1 to 4 will be designated by the same reference signs.

Figure 29:
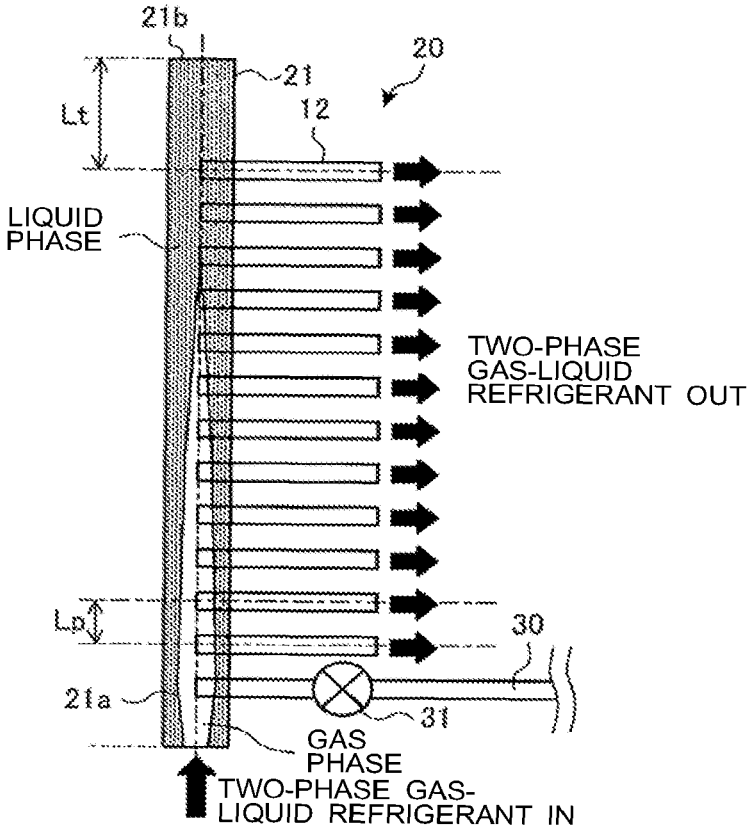
FIG. 29 is a schematic illustration of a second header, according to Embodiment 5 of the present invention.

FIG. 29 is a perspective view of the second header 20, according to Embodiment 5 of the present invention.

As illustrated in FIG. 29, the pitch length between the central axes of adjacent heat transfer tubes 12 is defined as Lp. The distance between an upper end portion 21*b*, which is the closed end portion of the header pipe 21 of the second header 20 opposite from the lowermost end portion connected to the inlet pipe 62, and the central axis of the uppermost one of the heat transfer tubes 12 into which two-phase gas-liquid refrigerant flows last, is defined as stagnation region length Lt. In this case, the stagnation region length Lt satisfies the condition of Lt≥2Lp.

When the stagnation region length Lt satisfies the condition of Lt≥2Lp, such a configuration is more desirable as the influence of collision of two-phase gas-liquid refrigerant with the upper end portion 21*b* of the header pipe 21 can be mitigated, leading to stable flow pattern and consequently greater improvement in the distribution of refrigerant.

Figure 30:
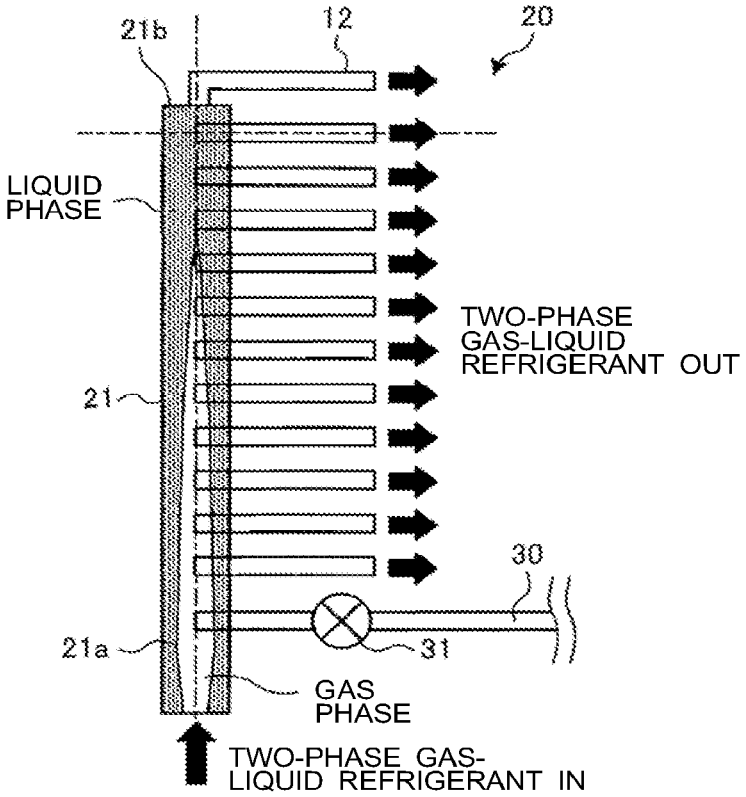
FIG. 30 is a schematic illustration of an exemplary second header, according to Embodiment 5 of the present invention.

FIG. 30 is a schematic illustration of an example of the second header 20, according to Embodiment 5 of the present invention.

As illustrated in FIG. 30, the heat transfer tube 12 may be connected to the end face of the upper end portion 21*b* of the header pipe 21. Connecting the heat transfer tube 12 to the end face of the upper end portion 21*b* helps reduce the decrease in dynamic pressure resulting from the collision of refrigerant with the upper end portion 21*b* of the header pipe 21. Such a configuration is more desirable as the flow pattern of refrigerant in the header pipe 21 can be stabilized, leading to increased efficiency of the outdoor heat exchanger 10.

According to Embodiment 5, the pitch length between two adjacent heat transfer tubes 12 or two adjacent branch tubes among the plurality of heat transfer tubes 12 or the plurality of branch tubes is defined as Lp. The distance between the upper end portion 21*b*, which is the closed end portion of the header pipe 21, and the central axis of the one of the heat transfer tubes 12 into which two-phase gas-liquid refrigerant flows last, is defined as stagnation region length Lt. In this case, the stagnation region length Lt satisfies the condition of Lt≥2LP.

This configuration reduces the influence of collision of two-phase gas-liquid refrigerant with the upper end portion 21*b* of the header pipe 21. Consequently, the flow pattern of refrigerant becomes stable, thus increasing the improvement in the distribution of refrigerant that can be provided by the protrusion of the heat transfer tube 12 or the branch tube into the header pipe 21. Consequently, the efficiency of the outdoor heat exchanger 10 can be improved.

According to Embodiment 5, at least one of the heat transfer tubes 12 or at least one of the branch tubes is connected to the end face of the upper end portion 21*b*, which is the closed end portion of the header pipe 21.

This configuration reduces the decrease in dynamic pressure resulting from the collision of refrigerant with the upper end portion 21*b* of the header pipe 21. Consequently, the flow pattern of refrigerant becomes stable, thus allowing for greater improvement in the distribution of refrigerant. Consequently, the efficiency of the outdoor heat exchanger 10 can be improved.

Embodiment 6

Embodiment 6 of the present invention will be described below. In the following, a description will not be given of features overlapping those of Embodiments 1 to 5, and portions identical or corresponding to those of Embodiments 1 to 5 will be designated by the same reference signs.

Figure 31:
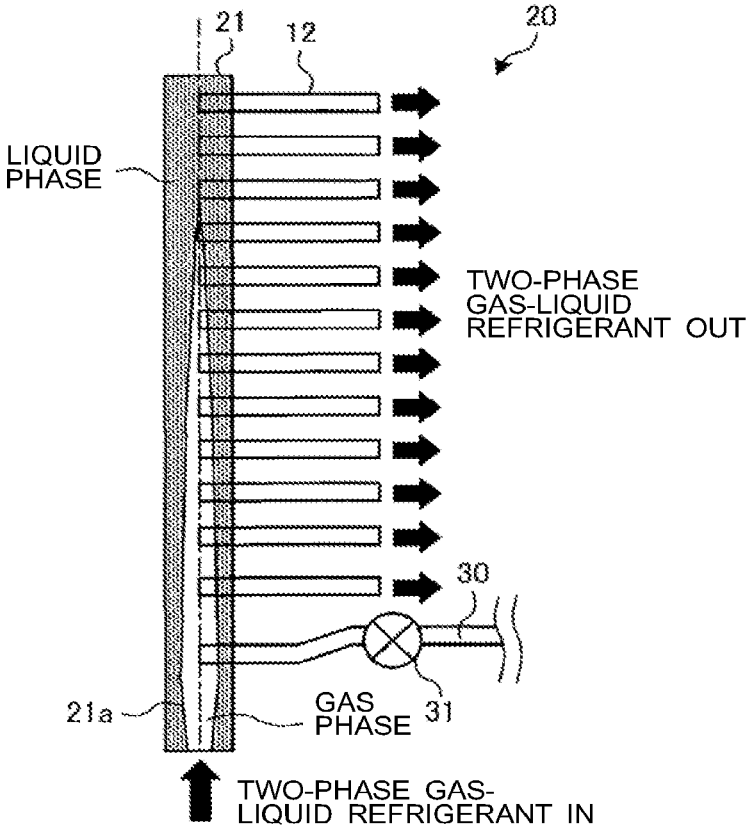
FIG. 31 is a schematic illustration of a second header, according to Embodiment 6 of the present invention.

FIG. 31 is a schematic illustration of the second header 20, according to Embodiment 6 of the present invention.

As illustrated in FIG. 31, the bypass pipe 30 bends at a portion of the bypass pipe 30 in the vertical direction. Consequently, when the outdoor heat exchanger 10 acts as an evaporator, the outlet portion of the bypass pipe 30 connected to the first header 40 is located higher than the inlet portion of the bypass pipe 30 inserted in the header pipe 21.

This configuration creates a head difference inside the bypass pipe 30, which makes it harder for liquid refrigerant to flow into the bypass pipe 30. As a result, more gas refrigerant can be preferentially directed to the bypass pipe 30. The increase in the amount of gas refrigerant directed to the bypass pipe 30 leads to a corresponding increase in the efficiency of the outdoor heat exchanger 10.

Figure 32:
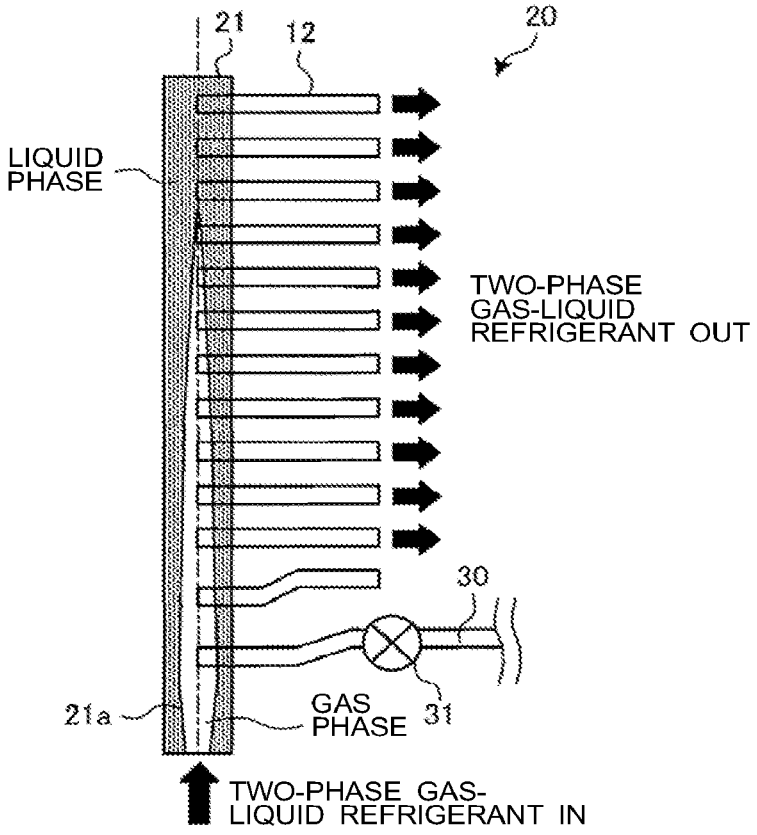
FIG. 32 is a schematic illustration of an exemplary second header, according to Embodiment 6 of the present invention.

FIG. 32 is a schematic illustration of an example of the second header 20, according to Embodiment 6 of the present invention.

As illustrated in FIG. 32, among the heat transfer tubes 12, the lowermost heat transfer tube 12 bends at a portion of the lowermost heat transfer tube 12 in the vertical direction, in the same manner as the bypass pipe 30. The lowermost heat transfer tube 12 is thus also disposed in such a manner that, when the outdoor heat exchanger 10 acts as an evaporator, the outlet portion of the lowermost heat transfer tube 12 connected to the first header 40 is located higher than the inlet portion of the lowermost heat transfer tube 12 inserted in the header pipe 21.

This configuration causes more gas refrigerant to flow into the heat transfer tube 12 due to head difference. In this regard, in the case of the fan 50 that is of a top-flow type, there is less airflow in the lower portion of the outdoor heat exchanger 10 located far from the fan 50. For this reason, when the lowermost one of the heat transfer tubes 12 is bent to create a head difference, such a configuration is more desirable as the flow rate of liquid refrigerant can be reduced in the lower portion of the outdoor heat exchanger 10 where there is less airflow, thus allowing for improved distribution of refrigerant.

The same effect as mentioned above is obtained not only when the lowermost one of the heat transfer tubes 12 is bent but also when a plurality of heat transfer tubes 12 located in the lower portion of the outdoor heat exchanger 10 are bent.

According to Embodiment 6, the bypass pipe 30 is disposed in such a manner that, when the outdoor heat exchanger 10 acts as an evaporator, the outlet portion of the bypass pipe 30 connected to the first header 40 is located higher than the inlet portion of the bypass pipe 30 connected to the entrance portion 21*a*.

This configuration creates a head difference inside the bypass pipe 30, which makes it harder for liquid refrigerant to flow into the bypass pipe 30. As a result, more gas refrigerant can be preferentially directed to the bypass pipe 30. Efficiency of the outdoor heat exchanger 10 is improved, accordingly.

According to Embodiment 6, the lowermost one of the heat transfer tubes 12 or the lowermost one of the branch tubes is disposed in such a manner that, when the outdoor heat exchanger acts as an evaporator, its outlet portion connected to the first header 40 is located higher than its inlet portion connected to the second header 20.

This configuration creates a head difference inside the lowermost heat transfer tube 12 or the lowermost branch tube, which makes it harder for liquid refrigerant to flow into the lowermost heat transfer tube 12 or the lowermost branch tube. As a result, more gas refrigerant can be preferentially directed to the lowermost heat transfer tube 12 or the lowermost branch tube. Efficiency of the outdoor heat exchanger 10 is improved, accordingly. For the fan 50 of a top-flow type, this configuration helps reduce the flow rate of liquid refrigerant in the lower portion of the outdoor heat exchanger 10 where there is less airflow, thus allowing for improved distribution of refrigerant.

Embodiment 7

Embodiment 7 of the present invention will be described below. In the following, a description will not be given of features overlapping those of Embodiments 1 to 6, and portions identical or corresponding to those of Embodiments 1 to 6 will be designated by the same reference signs.

Figure 33:
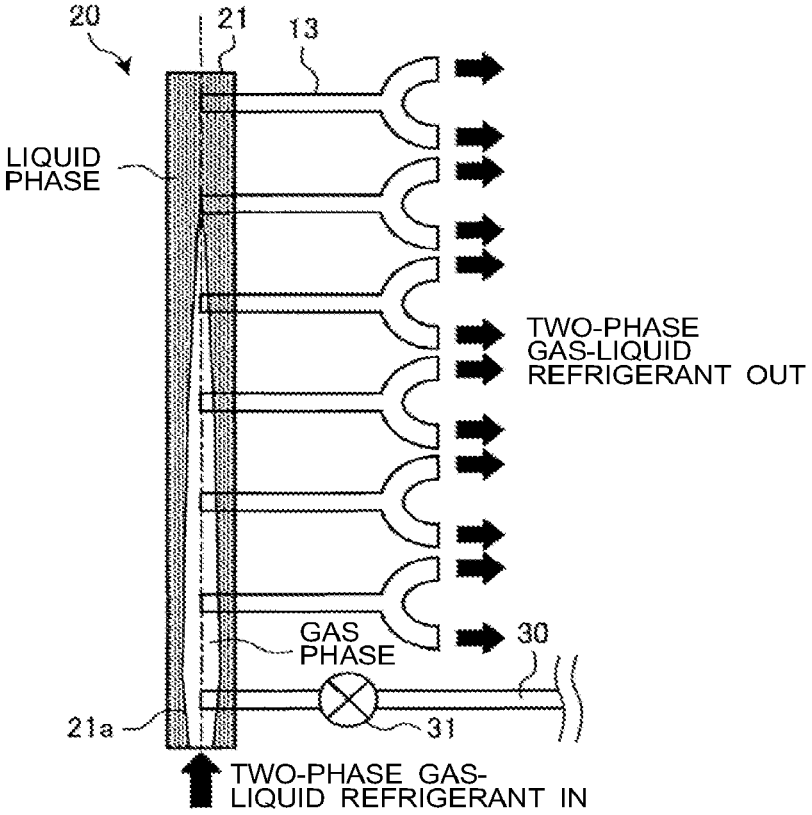
FIG. 33 is a schematic illustration of a second header, according to Embodiment 7 of the present invention.

FIG. 33 is a schematic illustration of the second header 20, according to Embodiment 7 of the present invention.

As illustrated in FIG. 33, a bifurcated tube 13 is used as each heat transfer tube. Using the bifurcated tube 13 as a heat transfer tube makes the number of tube outlets connected to the first header 40 greater than the number of tube inlets connected to the second header 20.

Such a configuration is more desirable as the decrease in dynamic pressure caused by the protrusion of the heat transfer tube or branch tube into the header pipe 21 can be reduced, thus reducing variation in the flow pattern of refrigerant, leading to enhanced efficiency of the outdoor heat exchanger 10.

The foregoing description is directed to the bifurcated tube 13 having one inlet and two outlets. However, the bifurcated tube is not limited to this configuration. Any branched tube branched in such a manner that the number of outlets is greater than the number of inlets is only required to be used as the heat transfer tube.

According to Embodiment 7, the plurality of heat transfer tubes or the plurality of branch tubes are each formed as the bifurcated tube 13 that bifurcates the exiting flow path for refrigerant when the outdoor heat exchanger 10 acts as an evaporator.

This configuration helps reduce the decrease in dynamic pressure caused by the protrusion of the heat transfer tube or branch tube into the header pipe 21, thus reducing variation in the flow pattern of refrigerant, leading to enhanced efficiency of the outdoor heat exchanger 10.

Embodiment 8

Embodiment 8 of the present invention will be described below. In the following, a description will not be given of features overlapping those of Embodiments 1 to 7, and portions identical or corresponding to those of Embodiments 1 to 7 will be designated by the same reference signs.

Figure 34:
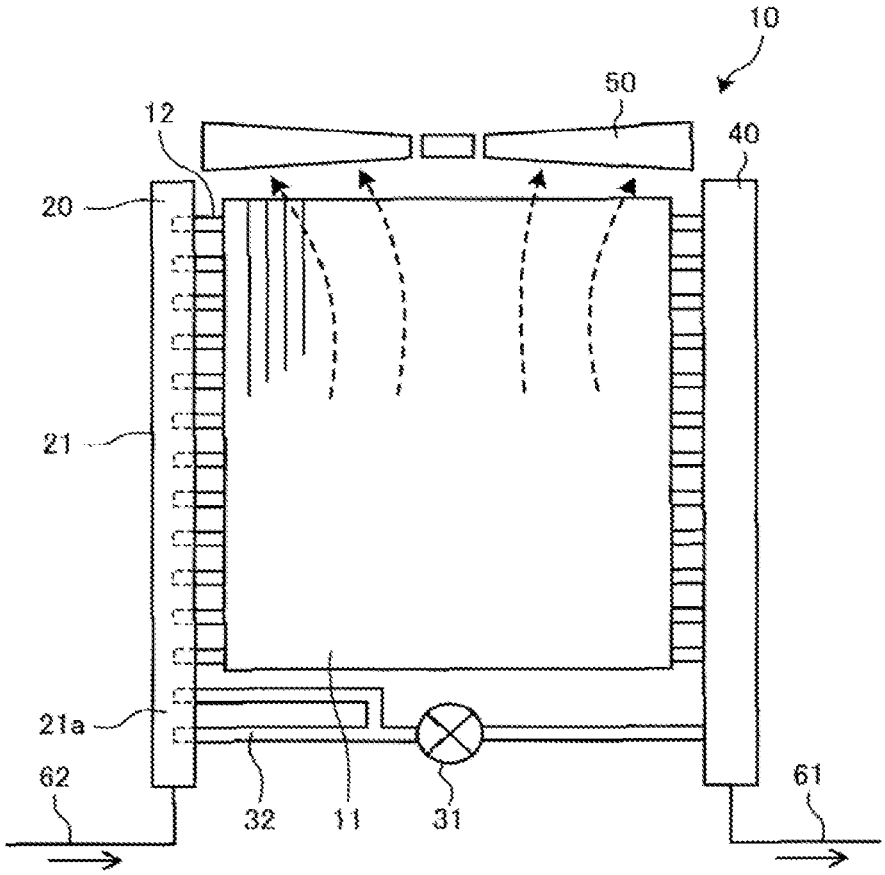
FIG. 34 is a schematic side view of an outdoor heat exchanger, according to Embodiment 8 of the present invention.

FIG. 34 is a schematic side view of the outdoor heat exchanger 10, according to Embodiment 8 of the present invention.

As illustrated in FIG. 34, the outdoor heat exchanger 10 is provided with a bypass pipe 32 that is bifurcated and has two pipe inlet portions connected to the header pipe 21. The two bifurcated branches of the bypass pipe 32 are joined into one at a portion of the bypass pipe 32. The flow control valve 31 is disposed at the portion where the branches of the bypass pipe 32 join into one. As with the heat transfer tube 12, the two bifurcated distal end portions of the bypass pipe 32 are inserted into the central portion of the header pipe 21.

The above-mentioned configuration is more desirable as the number of pipe inlets through which gas refrigerant enters the bypass pipe 32 is increased, allowing more gas refrigerant to be bypassed through the bypass pipe 32, thus allowing for greater reduction in pressure loss in the outdoor heat exchanger 10.

According to Embodiment 8, the bypass pipe 32 has two connection portions connected to the header pipe 21. The two connection portions join at a portion between a portion at which the connection portions are each connected to the header pipe 21 and a portion at which the bypass pipe 32 is connected to the first header 40.

This configuration facilitates flow of more gas refrigerant into the bypass pipe 32, thus providing greater reduction in the pressure loss in the outdoor heat exchanger 10.

The bypass pipe 32 may have three or more connection portions connected to the header pipe 21.

Embodiment 9

Embodiment 9 of the present invention will be described below. In the following, a description will not be given of features overlapping those of Embodiments 1 to 8, and portions identical or corresponding to those of Embodiments 1 to 8 will be designated by the same reference signs.

Figure 35:
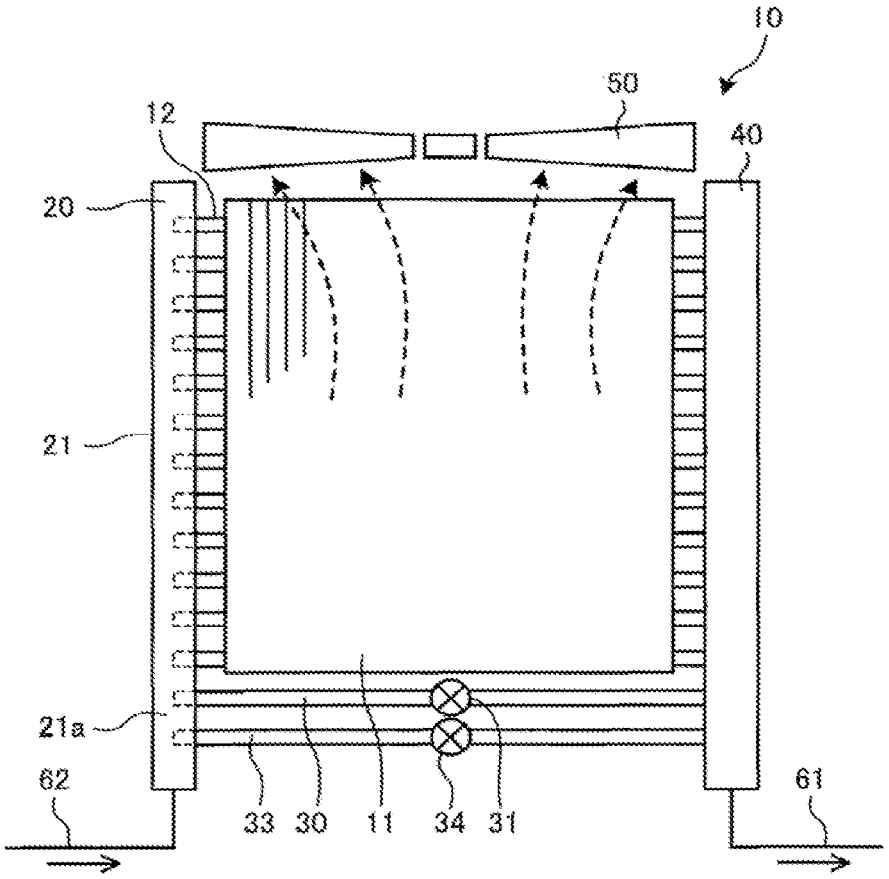
FIG. 35 is a schematic side view of an outdoor heat exchanger, according to Embodiment 9 of the present invention.

FIG. 35 is a schematic side view of the outdoor heat exchanger 10, according to Embodiment 9 of the present invention.

As illustrated in FIG. 35, one bypass pipe 30 provided with one flow control valve 31 is disposed. Further, one bypass pipe 33 provided with one flow control valve 34 similar to the flow control valve 31 is disposed. The bypass pipe 33 is identical in configuration to the bypass pipe 30 except for its height position. The flow control valves 31 and 34 are controlled so that the flow control valves 31 and 34 open when the outdoor heat exchanger 10 acts as an evaporator. The opening degree of each of the flow control valves 31 and 34 varies with operating condition. The opening degree is controlled in association with, for example, the rotation frequency of a compressor.

The number of bypass pipes and the number of flow control valves are not particularly limited to the description herein.

Providing the two bypass pipes 30 and 33 is more desirable as gas refrigerant is allowed to be preferentially bypassed with less intrusion of liquid refrigerant. Such a configuration is more desirable also as the control range of bypass flow rate is increased, allowing more gas refrigerant to be bypassed, thus allowing for greater reduction in pressure loss in the outdoor heat exchanger 10.

According to Embodiment 9, two bypass pipes 30 and 33 are provided. The flow control valves 31 and 34 are respectively provided to the bypass pipes 30 and 33.

With this configuration, the presence of the two bypass pipes 30 and 33 allows gas refrigerant to be preferentially led into the bypass pipes 30 and 33 while intrusion of liquid refrigerant is prevented. This configuration also increases the control range of the flow rate of gas refrigerant bypassed to the first header 40 from the entrance portion 21*a*, thus allowing more gas refrigerant to be bypassed. Greater pressure loss reduction for the outdoor heat exchanger 10 is thus caused.

Three or more bypass pipes may be provided. In this case, a flow control valve may be provided to each of the three or more bypass pipes.

Embodiment 10

Embodiment 10 of the present invention will be described below. In the following, a description will not be given of features overlapping those of Embodiments 1 to 9, and portions identical or corresponding to those of Embodiments 1 to 9 will be designated by the same reference signs.

Figure 36:
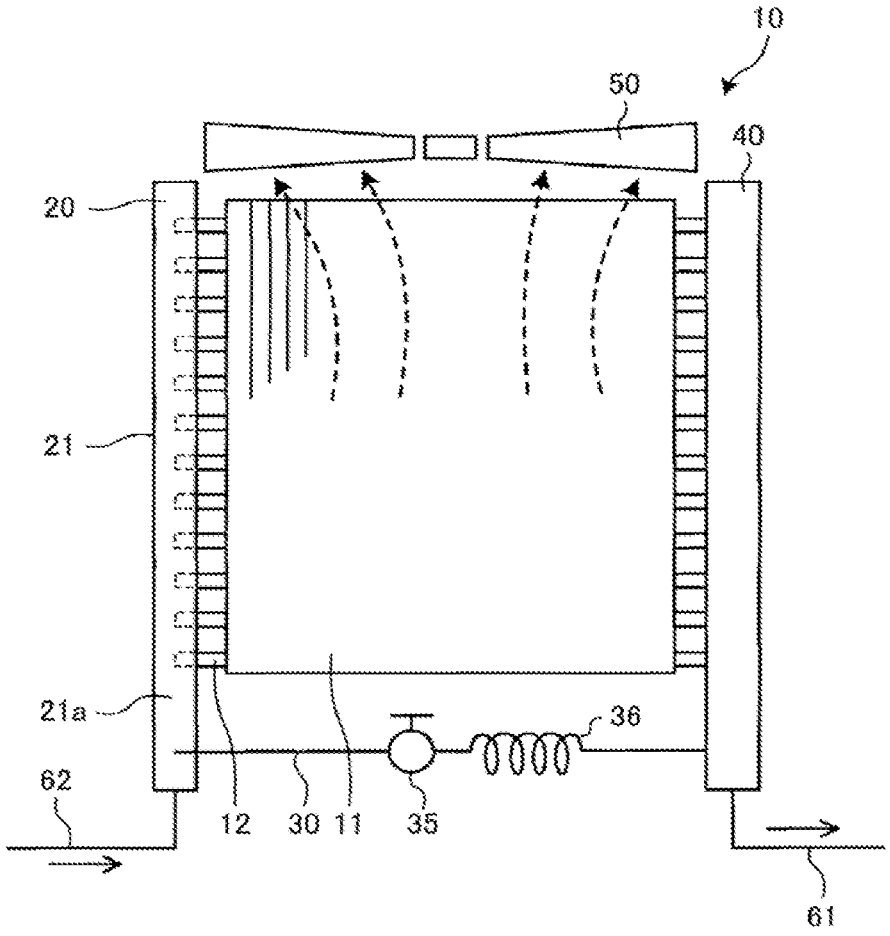
FIG. 36 is a schematic side view of an outdoor heat exchanger, according to Embodiment 10 of the present invention.

FIG. 36 is a schematic side view of the outdoor heat exchanger 10, according to Embodiment 10 of the present invention.

As illustrated in FIG. 36, an open-close valve 35 and a capillary tube 36 are used as a flow control mechanism provided to the bypass pipe 30. The bypass pipe 30 is used only when the outdoor heat exchanger acts as an evaporator. The open-close valve 35 serves to open and close the bypass pipe 30 to thereby control the passage or stoppage of refrigerant flow. The open-close valve 35 is controlled so that, for example, the open-close valve 35 opens under the condition of maximum refrigerant flow rate within the variation range of refrigerant flow rate when the outdoor heat exchanger 10 acts as an evaporator, thus allowing for reduced pressure loss in the outdoor heat exchanger 10. As for the maximum refrigerant flow rate condition, for example, its correspondence with compressor frequency is determined in advance by an experiment or other methods. The capillary tube 36 is disposed at a portion of the bypass pipe 30 closer to the first header 40 than is the open-close valve 35.

The use of the open-close valve 35 and the capillary tube 36, although control range is reduced as compared to the flow control valve, allows for reduced cost as compared to the flow control valve.

According to Embodiment 10, the flow control mechanism includes the open-close valve 35 configured to open and close the bypass pipe 30, and the capillary tube 36 disposed at a portion of the bypass pipe 30.

With this configuration, the use of the open-close valve 35 and the capillary tube 36 as the flow control mechanism, although control range is reduced, allows for reduced cost.

Embodiment 11

Embodiment 11 of the present invention will be described below. In the following, a description will not be given of features overlapping those of Embodiments 1 to 10, and portions identical or corresponding to those of Embodiments 1 to 10 will be designated by the same reference signs.

Figure 37:
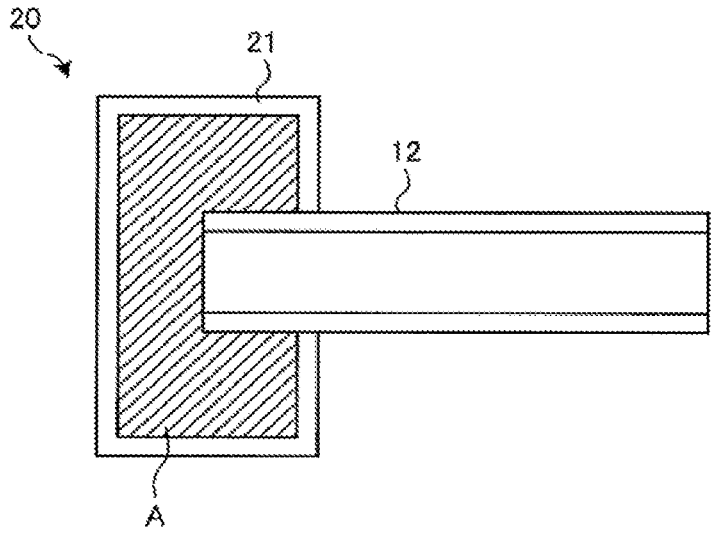
FIG. 37 illustrates a horizontal cross-section of a second header, according to Embodiment 11 of the present invention.
Figure 38:
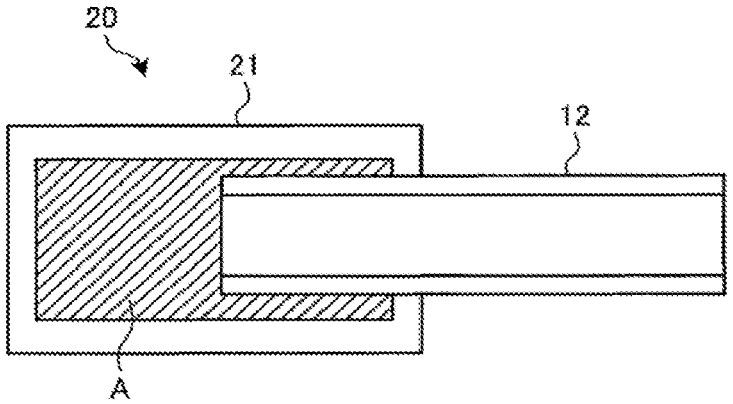
FIG. 38 illustrates an exemplary horizontal cross-section of a second header, according to Embodiment 11 of the present invention.
Figure 39:
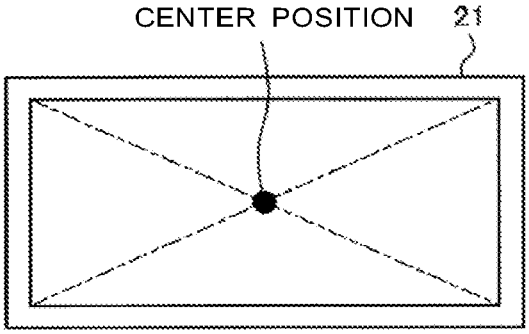
FIG. 39 illustrates the center position of a header pipe, according to Embodiment 11 of the present invention.

FIG. 37 illustrates a horizontal cross-section of the second header 20, according to Embodiment 11 of the present invention. FIG. 38 illustrates an exemplary horizontal cross-section of the second header 20, according to Embodiment 11 of the present invention. FIG. 39 illustrates the center position of the header pipe 21, according to Embodiment 11 of the present invention.

In Embodiment 11, the horizontal cross-section of the header pipe 21 has a rectangular shape. In other words, the header pipe 21 is a non-circular tube.

As illustrated in FIGS. 37 and 38, the horizontal cross-section of the header pipe 21 has a rectangular shape.

The rectangular shape of the horizontal cross-section of the header pipe 21 ensures that the braze connection surface between the heat transfer tube 12 and the header pipe 21 is flat. Such a configuration is desirable as brazing at the connection portion is thus improved. Another advantage is that the short and long sides of the header pipe 21 can be adjusted to any dimensions when it is desired to provide a sufficient channel cross-section area for the header pipe 21, thus enhancing the freedom of space. For the header pipe 21 having such a rectangular shape as well, the heat transfer tube 12 is inserted into the header pipe 21 at a position close to the center of the header pipe 21 to thereby improve refrigerant distribution performance, leading to enhanced efficiency of the outdoor heat exchanger 10.

As illustrated in FIG. 39, the center position of the header pipe 21 in the shape of a rectangle is taken as the point of intersection of the diagonals connecting the vertices at its corners. As the cross-sectional area used in determining whether the flow pattern is annular or churn, the area of the horizontal cross-section of the header pipe 21 having a rectangular shape is used.

According to Embodiment 11, the header pipe 21 is a non-circular tube.

This configuration leads to space saving for the second header 20. As the connection surface between the header pipe 21 and the heat transfer tubes 12 or the branch tubes can be made flat, the thickness of the braze layer can be made uniform, leading to enhanced durability of the second header 20.

According to Embodiment 11, the connection surface of the header pipe 21 connected with the heat transfer tubes 12 or the branch tubes is flat.

This configuration leads to space saving for the second header 20. As the connection surface between the header pipe 21 and the heat transfer tubes 12 or the branch tubes can be made flat, the thickness of the braze layer can be made uniform, leading to enhanced durability of the second header 20.

Embodiment 12

Embodiment 12 of the present invention will be described below. In the following, a description will not be given of features overlapping those of Embodiments 1 to 11, and portions identical or corresponding to those of Embodiments 1 to 11 will be designated by the same reference signs.

Figure 40:
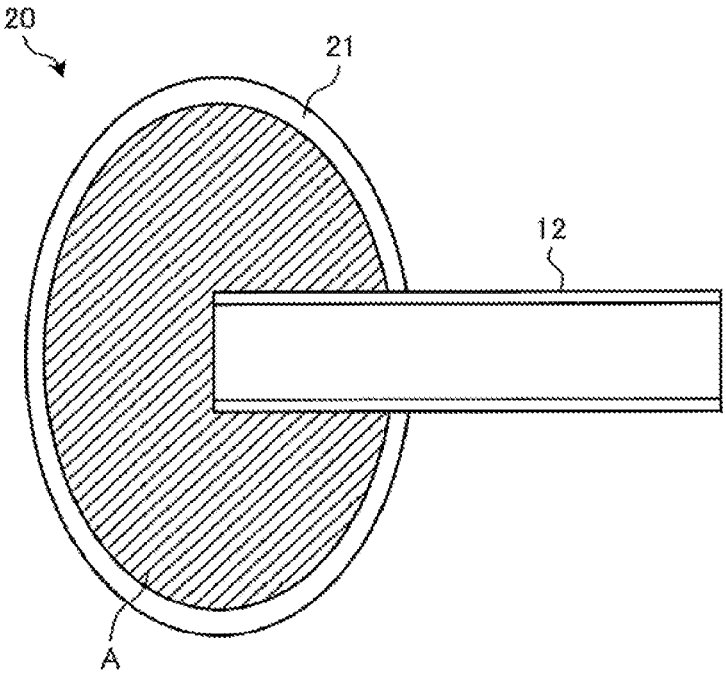
FIG. 40 illustrates a horizontal cross-section of a second header, according to Embodiment 12 of the present invention.
Figure 41:
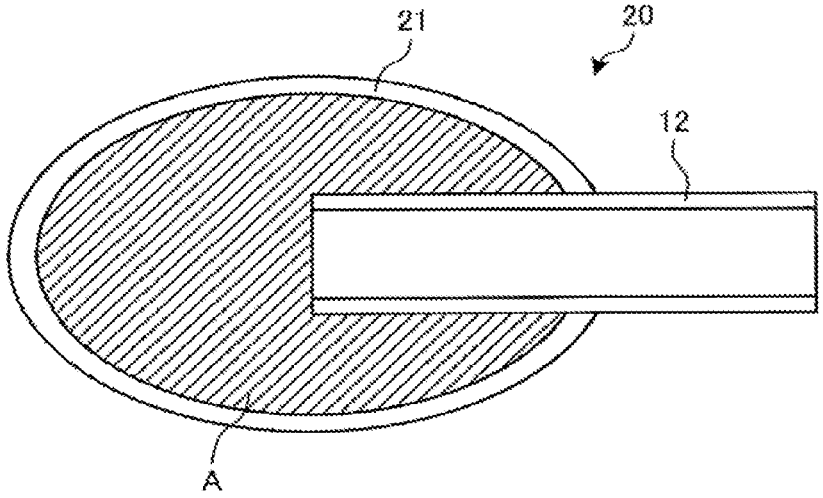
FIG. 41 illustrates an exemplary horizontal cross-section of a second header, according to Embodiment 12 of the present invention.
Figure 42:
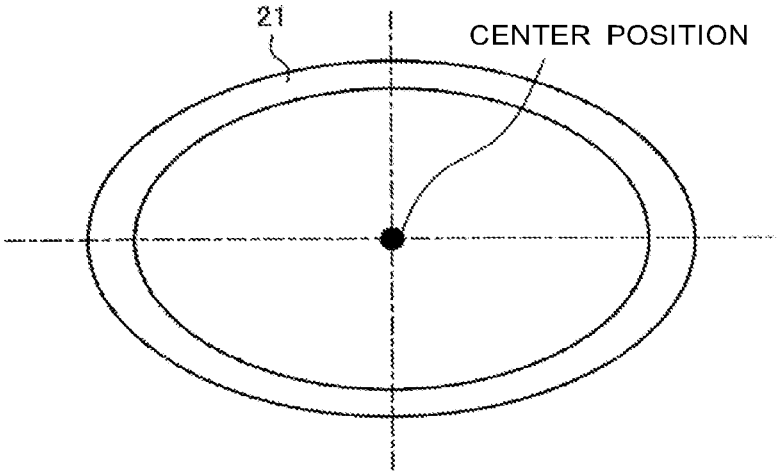
FIG. 42 illustrates the center position of a header pipe, according to Embodiment 12 of the present invention.

FIG. 40 illustrates a horizontal cross-section of the second header 20, according to Embodiment 12 of the present invention. FIG. 41 illustrates an exemplary horizontal cross-section of the second header 20, according to Embodiment 12 of the present invention. FIG. 42 illustrates the center position of the header pipe 21, according to Embodiment 12 of the present invention.

In Embodiment 12, the horizontal cross-section of the header pipe 21 has an elliptical shape. In other words, the header pipe 21 is a non-circular tube.

As illustrated in FIGS. 40 and 41, the horizontal cross-section of the header pipe 21 has an elliptical shape.

The elliptical shape of the horizontal cross-section of the header pipe 21 ensures that the braze connection surface between the heat transfer tube 12 and the header pipe 21 has a small curvature. Such a configuration is desirable as brazing at the connection portion is thus improved. As with the rectangular shape according to Embodiment 11, another advantage with this elliptical shape is that the short and long axes of the header pipe 21 can be adjusted to any dimensions when it is desired to provide a sufficient channel cross-section area for the header pipe 21, thus enhancing the freedom of space. The header pipe 21 having an elliptical shape is also desirable for its higher pressure resistance than that of the header pipe 21 having a rectangular shape, leading to reduced cost, accordingly. For the header pipe 21 having such an elliptical shape as well, the heat transfer tube 12 is inserted into the header pipe 21 at a position close to the center of the header pipe 21 to thereby improve refrigerant distribution performance, leading to enhanced efficiency of the outdoor heat exchanger 10.

As illustrated in FIG. 42, the center position of the header pipe 21 having an elliptical shape is taken as the point of intersection of its short and long axes. As the cross-sectional area used in determining whether the flow pattern is annular or churn, the area of the horizontal cross-section of the header pipe 21 having an elliptical shape is used.

Embodiment 13

Embodiment 13 of the present invention will be described below. In the following, a description will not be given of features overlapping those of Embodiments 1 to 12, and portions identical or corresponding to those of Embodiments 1 to 12 will be designated by the same reference signs.

Figure 43:
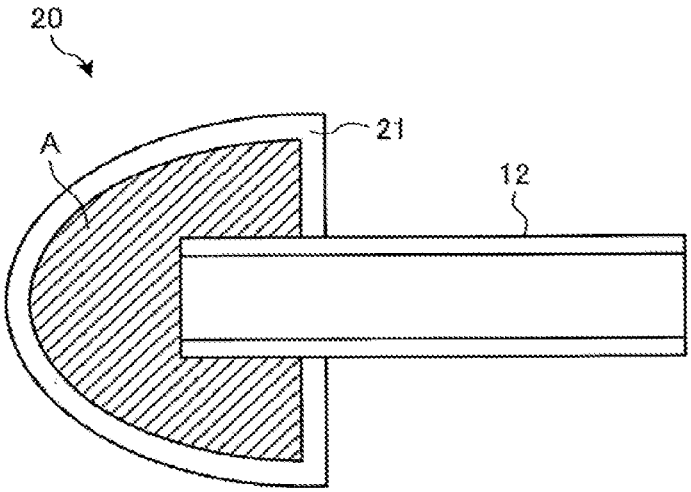
FIG. 43 illustrates a horizontal cross-section of a second header, according to Embodiment 13 of the present invention.
Figure 44:
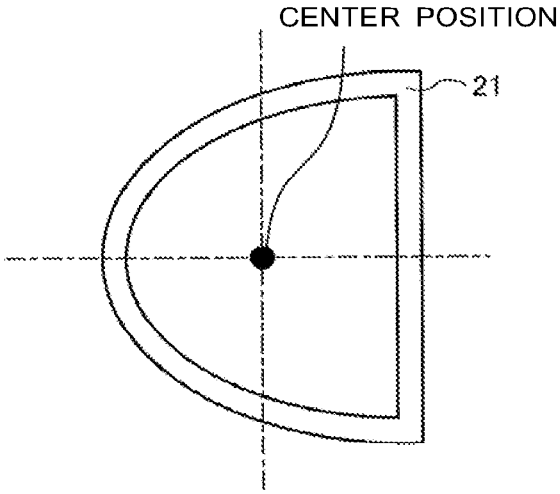
FIG. 44 illustrates the center position of a header pipe, according to Embodiment 13 of the present invention.

FIG. 43 illustrates a horizontal cross-section of the second header 20, according to Embodiment 13 of the present invention. FIG. 44 illustrates the center position of the header pipe 21, according to Embodiment 13 of the present invention.

In Embodiment 13, the horizontal cross-section of the header pipe 21 has a semicircular shape. In other words, the header pipe 21 is a non-circular tube.

As illustrated in FIG. 43, the horizontal cross-section of the header pipe 21 has the shape of a semicircle having a flat surface.

The horizontal cross-section of the header pipe 21 has the shape of a semicircle, and the heat transfer tube 12 is inserted through the flat surface of the header pipe 21. The braze connection surface between the heat transfer tube 12 and the header pipe 21 is flat. Such a configuration is desirable as brazing at the connection portion is thus improved. Another advantage is that the arcuate and flat portions of the semicircle can be adjusted to any dimensions when it is desired to provide a sufficient channel cross-section area for the header pipe 21, thus enhancing the freedom of space. For the header pipe 21 having such a semicircular shape as well, the heat transfer tube 12 is inserted into the header pipe 21 at a position close to the center of the header pipe 21 to thereby improve refrigerant distribution performance, leading to enhanced efficiency of the outdoor heat exchanger 10.

As illustrated in FIG. 44, the center position of the header pipe 21 having the shape of a semicircle is taken as the point of intersection between the line connecting the midpoint of the arcuate portion and the midpoint of the flat surface portion, and the line that intersect the midpoint of the mentioned line at right angles. As the cross-sectional area used in determining whether the flow pattern is annular or churn, the area of the horizontal cross-section of the header pipe 21 having a semicircular shape is used.

Embodiment 14

Embodiment 14 of the present invention will be described below. In the following, a description will not be given of features overlapping those of Embodiments 1 to 13, and portions identical or corresponding to those of Embodiments 1 to 13 will be designated by the same reference signs.

Figure 45:
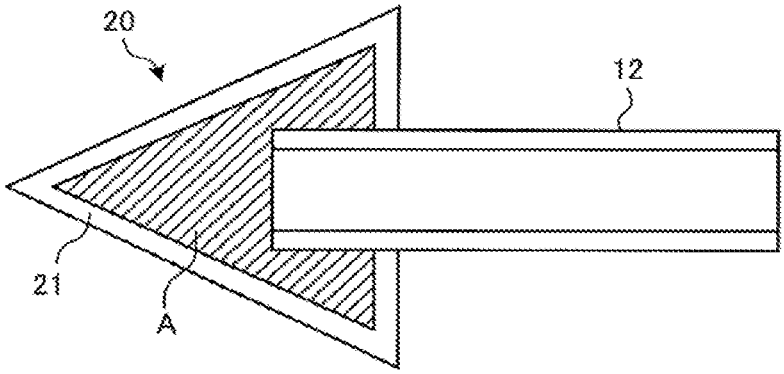
FIG. 45 illustrates a horizontal cross-section of a second header, according to Embodiment 14 of the present invention.
Figure 46:
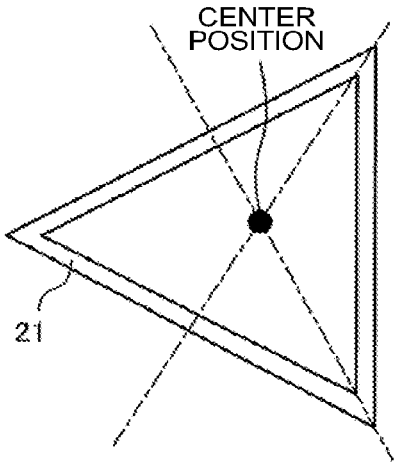
FIG. 46 illustrates the center position of a header pipe, according to Embodiment 14 of the present invention.

FIG. 45 illustrates a horizontal cross-section of the second header 20, according to Embodiment 14 of the present invention. FIG. 46 illustrates the center position of the header pipe 21, according to Embodiment 14 of the present invention.

In Embodiment 14, the horizontal cross-section of the header pipe 21 has a triangular shape. In other words, the header pipe 21 is a non-circular tube.

As illustrated in FIG. 45, the horizontal cross-section of the header pipe 21 has the shape of a triangle with a flat surface.

The horizontal cross-section of the header pipe 21 has the shape of a triangle, and the heat transfer tube 12 is inserted through the flat surface of the header pipe 21. The braze connection surface between the heat transfer tube 12 and the header pipe 21 is flat. Such a configuration is desirable as brazing at the connection portion is thus improved. Another advantage is that the three sides of the header pipe 21 can be adjusted to any dimensions when it is desired to provide a sufficient channel cross-section area for the header pipe 21, thus enhancing the freedom of space. For the header pipe 21 having such a triangular shape as well, the heat transfer tube 12 is inserted into the header pipe 21 at a position close to the center of the header pipe 21 to thereby improve refrigerant distribution performance, leading to enhanced efficiency of the outdoor heat exchanger 10.

As illustrated in FIG. 46, the center position of the header pipe 21 having the shape of a triangle is taken as the center of gravity of the triangle representing the shape of the horizontal cross-section of the header pipe 21. As the cross-sectional area used in determining whether the flow pattern is annular or churn, the area of the horizontal cross-section of the header pipe 21 having a triangular shape is used.

Embodiment 15

Embodiment 15 of the present invention will be described below. In the following, a description will not be given of features overlapping those of Embodiments 1 to 14, and portions identical or corresponding to those of Embodiments 1 to 14 will be designated by the same reference signs.

Figure 47:
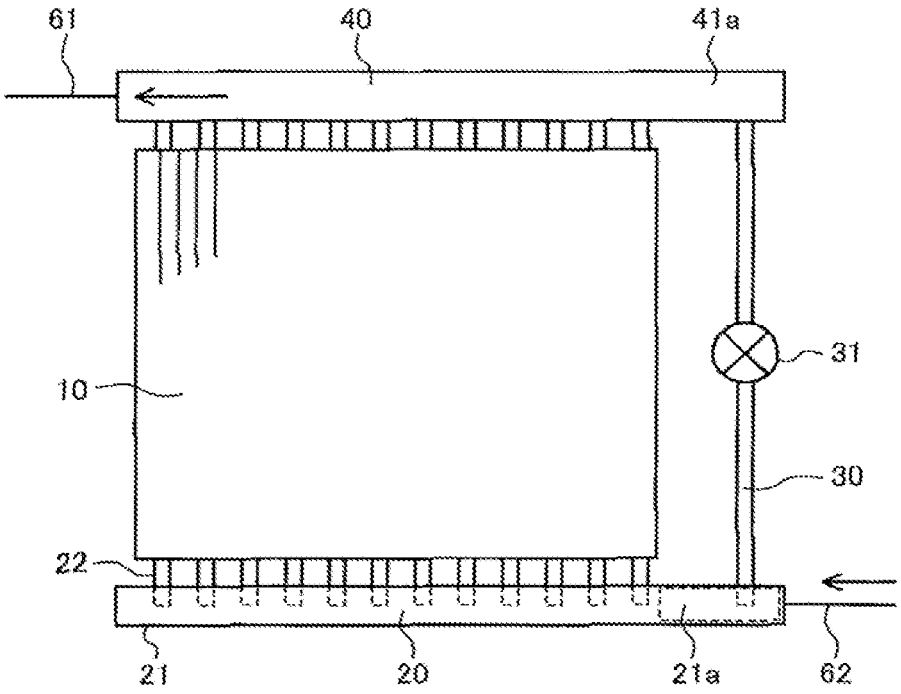
FIG. 47 is a schematic side view of an outdoor heat exchanger, according to Embodiment 15 of the present invention.

FIG. 47 is a schematic side view of the outdoor heat exchanger 10, according to Embodiment 15 of the present invention.

As illustrated in FIG. 47, with the outdoor heat exchanger 10 according to Embodiment 15, the header pipe 21 of the second header 20 extends in the horizontal direction. The header pipe 41 of the first header 40 extends in the horizontal direction, at a position above the header pipe 21 with the outdoor heat exchanger 10 interposed between the header pipe 41 and the header pipe 21. That is, each of the second header 20 and the first header 40 is a horizontal header extending in the horizontal direction.

For the header pipe 21 extending in the horizontal direction as well, the bypass pipe 30 is disposed between the entrance portion 21*a* and the first header 40. The bypass pipe 30 extends straight in the vertical direction. The distal end portion of the bypass pipe 30 is connected to penetrate the liquid phase of refrigerant flowing in the entrance portion 21*a*.

According to Embodiment 15, the second header 20 is a horizontal header that extends in the horizontal direction.

This configuration allows gas refrigerant to be preferentially bypassed from the second header. Gas refrigerant, which does not contribute to heat exchanger, is thus bypassed. Consequently, pressure loss in the outdoor heat exchanger 10 can be reduced, leading to enhanced efficiency of the outdoor heat exchanger 10.

Embodiment 16

Embodiment 16 of the present invention will be described below. In the following, a description will not be given of features overlapping those of Embodiments 1 to 15, and portions identical or corresponding to those of Embodiments 1 to 15 will be designated by the same reference signs.

In Embodiment 16, the outdoor heat exchanger 10, which is equipped to the outdoor unit 100 of the air-conditioning apparatus described above with reference to each of the above-mentioned embodiments, is connected to a compressor 71, an expansion device 72, and an indoor heat exchanger 73 by refrigerant pipes to form a refrigeration cycle circuit, thereby forming an air-conditioning apparatus 200 capable of heating operation.

Figure 48:
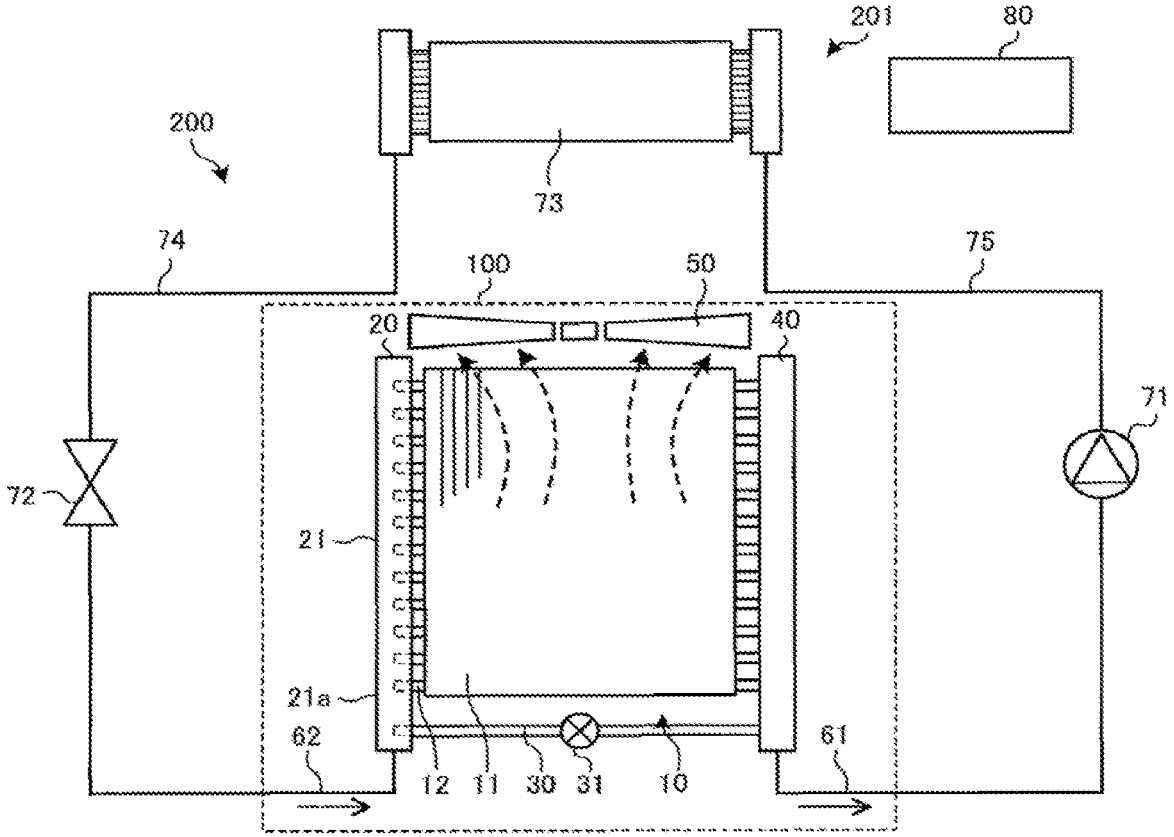
FIG. 48 illustrates a configuration of an air-conditioning apparatus, according to Embodiment 16 of the present invention.

FIG. 48 illustrates a configuration of the air-conditioning apparatus 200, according to Embodiment 16 of the present invention.

In the air-conditioning apparatus 200 illustrated in FIG. 48, the outdoor unit 100 including the outdoor heat exchanger 10 is connected to an indoor unit 201.

The expansion device 72 such as an expansion valve is disposed upstream of the inlet pipe 62 of the outdoor heat exchanger 10. The expansion device 72 and the indoor unit 201 are connected by a connecting pipe 74. The indoor unit 201 and the compressor 71 are connected by a connecting pipe 75. Refrigerant from the outdoor heat exchanger 10 flows into the compressor 71 through the outlet pipe 61.

In the outdoor heat exchanger 10, the bypass pipe 30 is disposed between the entrance portion 21*a* of the second header 20 and the first header 40 and configured to bypass refrigerant. The bypass pipe 30 is provided with the flow control valve 31 to control the flow rate of refrigerant.

Further, a controller 80 is provided. During rated heating operation, the controller 80 controls the compressor 71 or the expansion device 72 so that the quality x of refrigerant entering the second header 20 falls within the range of $0.05 \leq x \leq 0.30$.

The controller 80 has a microcomputer including components such as a CPU, a ROM, a RAM, and an input-output port.

The controller 80 is connected with various sensors via a wireless or wired control signal line in such a manner that the controller 80 can be allowed to receive detection values. The controller 80 is connected in such a manner that the controller 80 can be allowed to control the rotation frequency of the compressor 71 or the opening degree of the expansion device 72 via a wireless or wired control signal line.

The type or configuration of the indoor unit 201 is not limited to the description herein. However, the indoor unit 201 typically includes the indoor heat exchanger 73, a fan (not illustrated), and the expansion device 72 such as an expansion valve. In the indoor unit 201, an indoor-unit header is connected on either side of the indoor heat exchanger 73 and refrigerant flows through the heat transfer tubes of the indoor heat exchanger 73.

Next, with reference to FIG. 48, the following describes the flow of refrigerant during heating operation of the air-conditioning apparatus 200 according to Embodiment 16.

Each solid arrow in FIG. 48 represents the flow of refrigerant during heating operation. Gas refrigerant compressed by the compressor 71 to high temperature and high pressure passes through the connecting pipe 75 into the indoor unit 201. The refrigerant having entered the indoor unit 201 flows into the indoor-unit header, and then flows into the indoor heat exchanger 73 while being distributed to a plurality of heat transfer tubes of the indoor heat exchanger 73. In the indoor heat exchanger 73, individual refrigerant streams reject heat to the ambient air, and flow in a liquid single-phase state or in a two-phase gas-liquid state into the indoor-unit header where the refrigerant streams are combined. After the refrigerant streams are combined in the indoor-unit header, the resulting refrigerant travels through the connecting pipe 74 into the expansion device 72. In the expansion device 72, the refrigerant changes to low-temperature and low-pressure refrigerant that is in a two-phase gas-liquid state or in a liquid single-phase state. The resulting refrigerant passes through the inlet pipe 62 into the second header 20.

The refrigerant in a two-phase gas-liquid state flows into the lower portion of the second header 20. Then, from the entrance portion 21*a*, part of gas refrigerant is bypassed to the first header 40 through the bypass pipe 30. The resulting refrigerant in a two-phase gas-liquid state, whose quality satisfies the condition of $0.05 \leq x \leq 0.30$ and whose flow pattern has become annular or churn, travels toward the upper portion of the header pipe 21 while being distributed to each of the heat transfer tubes 12. The distributed refrigerant receives heat from the air flowing outside the heat transfer tube 12 and thus changes its phase from liquid to gas. The resulting refrigerant exits to the first header 40. In the first header 40, the refrigerant streams from the heat transfer tubes 12 are combined. The resulting refrigerant then exits from the lower portion of the first header 40 to the outlet pipe 61, and then flows into the compressor 71 again.

In this regard, the frequency of the compressor 71 varies with the capacity of the indoor heat exchanger 73 required in the indoor unit 201.

FIG. 48 depicts a configuration with one indoor unit 201 connected to one outdoor unit 100. However, the number of the indoor units 201 and the outdoor units 100 to be connected is not limited to this configuration.

Further, FIG. 48 depicts a configuration with a header-type distribution unit connected at either end of each heat transfer tube of the indoor heat exchanger 73 of the indoor unit 201. However, the type of the distribution unit used is not limited to this configuration. For example, a distributor-type (collision-type) distribution unit may be connected to each heat transfer tube of the indoor heat exchanger 73.

The opening degree of the expansion device 72 is controlled so that during rated heating operation, the quality x of refrigerant entering the second header 20 is in the range of $0.05 \leq x \leq 0.30$. One exemplary method to achieve this control is to store, in advance, a table of optimum opening degrees of the expansion device 72 for varying with rotation frequencies of the compressor 71. Another exemplary control method is to optimize the opening degree of the expansion device 72 suitably to the number of operating indoor units connected or suitably to the operation mode. Through such control, an improvement in distribution performance can be obtained over a wide range of operating conditions by protruding the heat transfer tube 12 into the second header 20.

The opening degree of the flow control valve 31 is controlled by the controller 80 to control the flow rate of gas refrigerant through the bypass pipe 30. This configuration ensures that, even for cases where the opening degree of the expansion device 72 is adjusted and the quality x of refrigerant entering the second header 20 does not fall within the range of $0.05 \leq x \leq 0.30$, the quality x of refrigerant entering the lowermost heat transfer tube 12 connected to the second header 20 can be controlled so that the quality x of refrigerant falls within the range of $0.05 \leq x \leq 0.30$, and the flow of refrigerant can be controlled so that the flow of refrigerant follows an annular or churn flow pattern.

According to Embodiment 16, the air-conditioning apparatus 200 includes the compressor 71, the indoor heat exchanger 73, the expansion device 72, and the outdoor heat exchanger 10, and has a refrigeration cycle circuit in which refrigerant circulates. The outdoor heat exchanger 10 is the heat exchanger according to any one of Embodiments 1 to 15.

This configuration makes it possible to obtain stable improvement in the distribution performance of the second header 20, leading to improved efficiency of the outdoor heat exchanger 10 and consequently enhanced energy efficiency.

According to Embodiment 16, the air-conditioning apparatus 200 includes the compressor 71, the indoor heat exchanger 73, the expansion device 72, and the outdoor heat exchanger 10, and has a refrigeration cycle circuit in which refrigerant circulates. The outdoor heat exchanger 10 is the heat exchanger according to any one of Embodiments 1 to 15. The air-conditioning apparatus 200 includes the controller 80 that, during rated heating operation, controls the compressor 71, the expansion device 72, or the flow control valve 31 so that the quality x of refrigerant flowing through the header pipe 21 falls within the range of $0.05 \leq x \leq 0.30$.

This configuration makes it possible to obtain stable improvement in the distribution performance of the second header 20 over a wide range of operating conditions, leading to improved efficiency of the outdoor heat exchanger 10 and consequently enhanced energy efficiency.

Embodiment 17

Figure 49:
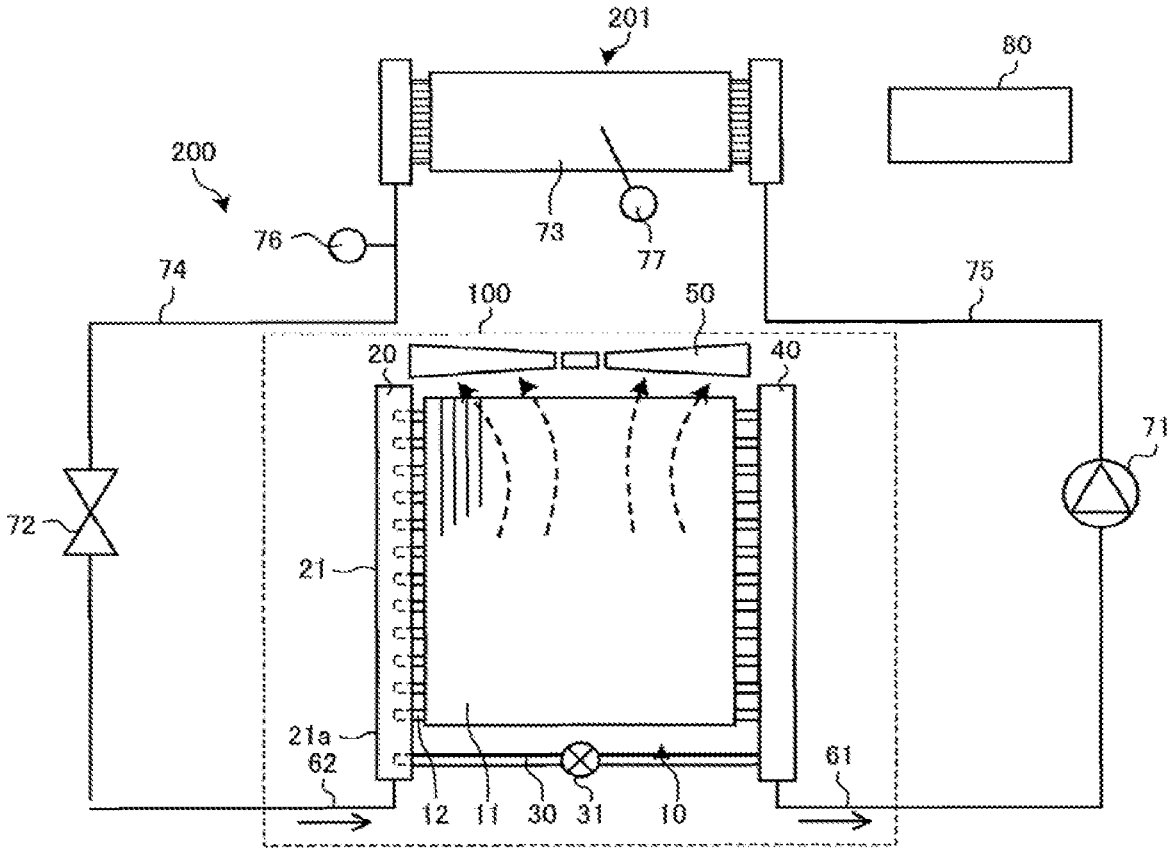
FIG. 49 illustrates a configuration of an air-conditioning apparatus, according to Embodiment 17 of the present invention.

FIG. 49 illustrates a configuration of the air-conditioning apparatus 200, according to Embodiment 17 of the present invention. In the following, a description will not be given of features overlapping those of Embodiment 16, and portions identical or corresponding to those of Embodiment 16 will be designated by the same reference signs.

In Embodiment 17, the air-conditioning apparatus 200 according to Embodiment 15 includes a first temperature sensor 76 provided to the connecting pipe 74 to measure the temperature of refrigerant at the outlet of the indoor unit. The air-conditioning apparatus 200 also includes a second temperature sensor 77 provided to the indoor heat exchanger 73 to measure the temperature of refrigerant flowing through the heat transfer tubes of the indoor heat exchanger 73.

In heating operation, the controller 80 measures the condensing saturation temperature of refrigerant, Tc, by the second temperature sensor 77, and measures refrigerant temperature at a condenser outlet, TRout, by the first temperature sensor 76 disposed at the outlet of the indoor unit. Consequently, the controller 80 detects S.C. at a condenser outlet (=Tc−TRout, which is also called outlet temperature difference), and controls the quality x of refrigerant entering the second header 20 so that the quality x falls within the range of $0.05 \leq x \leq 0.30$.

The control of S.C. at this time is performed by adjusting the opening degree of the expansion device 72. This adjustment can be performed by, for example, previously determining the relationship between the frequency of the compressor 71, S.C., and the refrigerant quality. Another exemplary control method is to optimize the opening degree of the expansion device 72 suitably to the number of operating indoor units connected or suitably to the operation mode. Through such control, an improvement in distribution performance can be obtained over a wide range of operating conditions by protruding the heat transfer tube 12 into the second header 20.

The opening degree of the flow control valve 31 is controlled by the controller 80 to control the flow rate of gas refrigerant through the bypass pipe 30. This configuration ensures that, even for cases where the opening degree of the expansion device 72 is adjusted and the quality x of refrigerant entering the second header 20 does not fall within the range of $0.05 \leq x \leq 0.30$, the quality x of refrigerant entering the lowermost heat transfer tube 12 connected to the second header 20 can be controlled so that the quality x of refrigerant falls within the range of $0.05 \leq x \leq 0.30$, and the flow of refrigerant can be controlled so that the flow of refrigerant follows an annular or churn flow pattern.

According to Embodiment 17, the air-conditioning apparatus 200 includes the compressor 71, the indoor heat exchanger 73, the expansion device 72, and the outdoor heat exchanger 10, and has a refrigeration cycle circuit in which refrigerant circulates. The outdoor heat exchanger 10 is the heat exchanger according to any one of Embodiments 1 to 15. The air-conditioning apparatus 200 includes the first temperature sensor 76 attached downstream of the indoor heat exchanger 73 in heating operation. The air-conditioning apparatus 200 includes the second temperature sensor 77 attached to the indoor heat exchanger 73. The air-conditioning apparatus 200 includes the controller 80 that, during heating operation, calculates the outlet temperature difference S.C. (=Tc−TRout) for the indoor heat exchanger 73 on the basis of a temperature measured by the first temperature sensor 76 (condenser outlet temperature TRout) and a temperature measured by the second temperature sensor 77 (condensing saturation temperature Tc), and during rated heating operation, controls the compressor 71, the expansion device 72, or the flow control valve 31 so that the quality x of refrigerant flowing through the header pipe 21 falls within the range of $0.05 \leq x \leq 0.30$.

This configuration makes it possible to obtain stable improvement in the distribution performance of the second header 20 over a wide range of operating conditions, leading to improved efficiency of the outdoor heat exchanger 10 and consequently enhanced energy efficiency.

Embodiment 18

Figure 50:
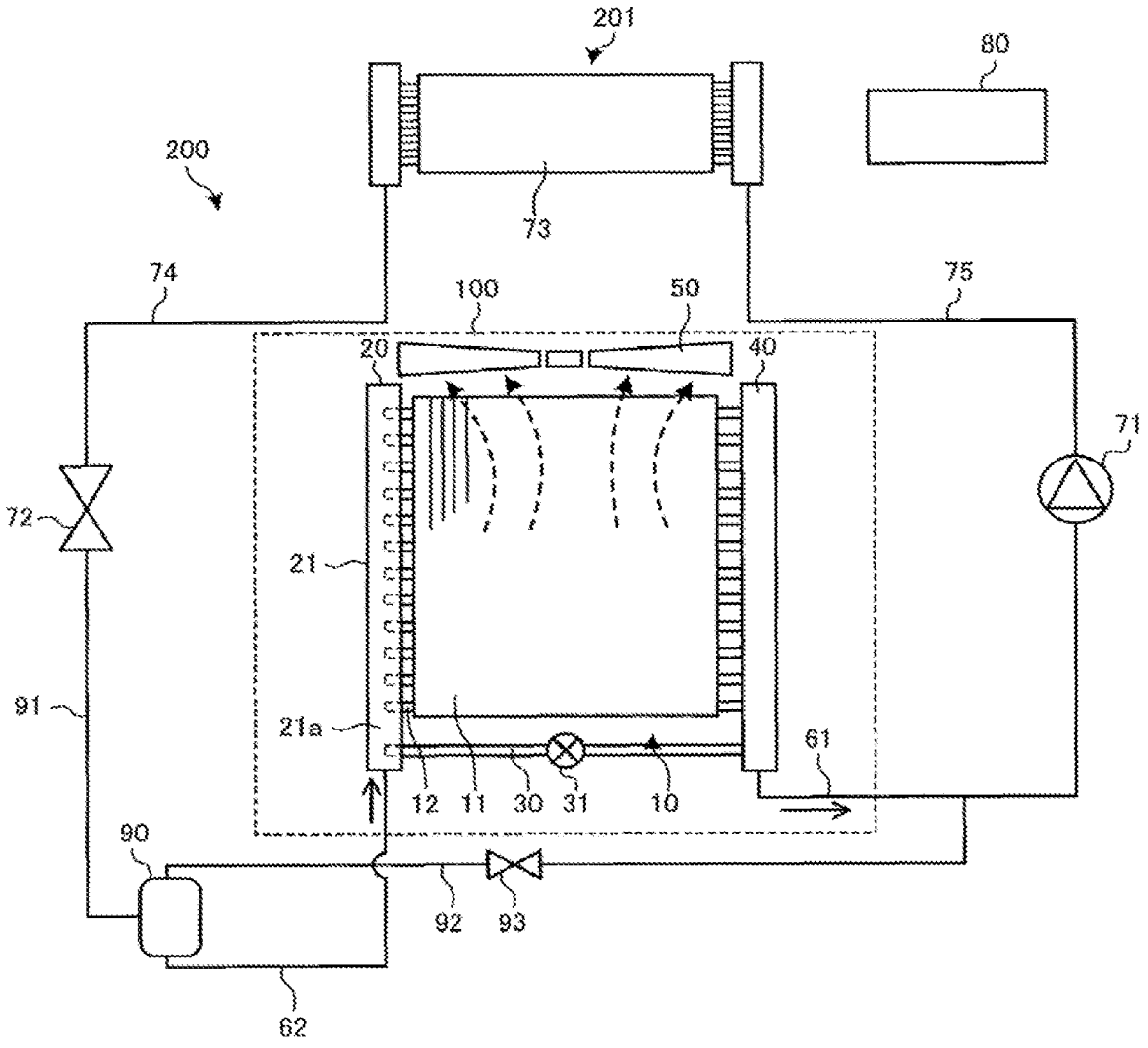
FIG. 50 illustrates a configuration of an air-conditioning apparatus, according to Embodiment 18 of the present invention.

FIG. 50 illustrates a configuration of the air-conditioning apparatus 200, according to Embodiment 18 of the present invention. In the following, a description will not be given of features overlapping those of Embodiments 16 and 17, and portions identical or corresponding to those of Embodiments 16 and 17 will be designated by the same reference signs.

In Embodiment 18, a gas-liquid separator 90 is disposed between the second header 20 and the expansion device 72 of the air-conditioning apparatus 200 according to any one of Embodiments 16 and 17. The expansion device 72 and the gas-liquid separator 90 are connected by a connecting pipe 91. The gas-liquid separator 90 and the outlet pipe 61 are connected by a gas bypass pipe 92. The gas bypass pipe 92 serves to bypass refrigerant separated by the gas-liquid separator 90 to the compressor 71. A gas bypass control valve 93 is disposed at a portion of the gas bypass pipe 92. The opening degree of the gas bypass control valve 93 can be changed by the controller 80. The gas-liquid separator 90 and the second header 20 are connected by the inlet pipe 62.

The controller 80 controls the opening degree of the gas bypass control valve 93 suitably to the operating condition so that the quality x of refrigerant entering the second header 20 is within the range of $0.05 \leq x \leq 0.30$.

Through such control, an improvement in the refrigerant distribution performance of the second header 20 can be obtained over a wide range of operating conditions by protruding the heat transfer tube 12 into the header pipe 21.

In addition, bypassing part of gas refrigerant from the outdoor heat exchanger 10 by using the gas bypass pipe 92 makes it possible to reduce pressure loss in the outdoor heat exchanger 10, leading to improved efficiency of the outdoor heat exchanger 10.

As the gas bypass control valve 93 with a variable opening degree, a valve such as an electronic expansion valve whose opening degree is adjustable can also be used. However, the gas bypass control valve 93 may be substituted for by, for example, a combination of a solenoid valve and a capillary tube or by the use of a check valve and the flow resistance in the gas bypass pipe 92. That is, the type of the gas bypass control valve 93 is not particularly limited.

Figure 51:
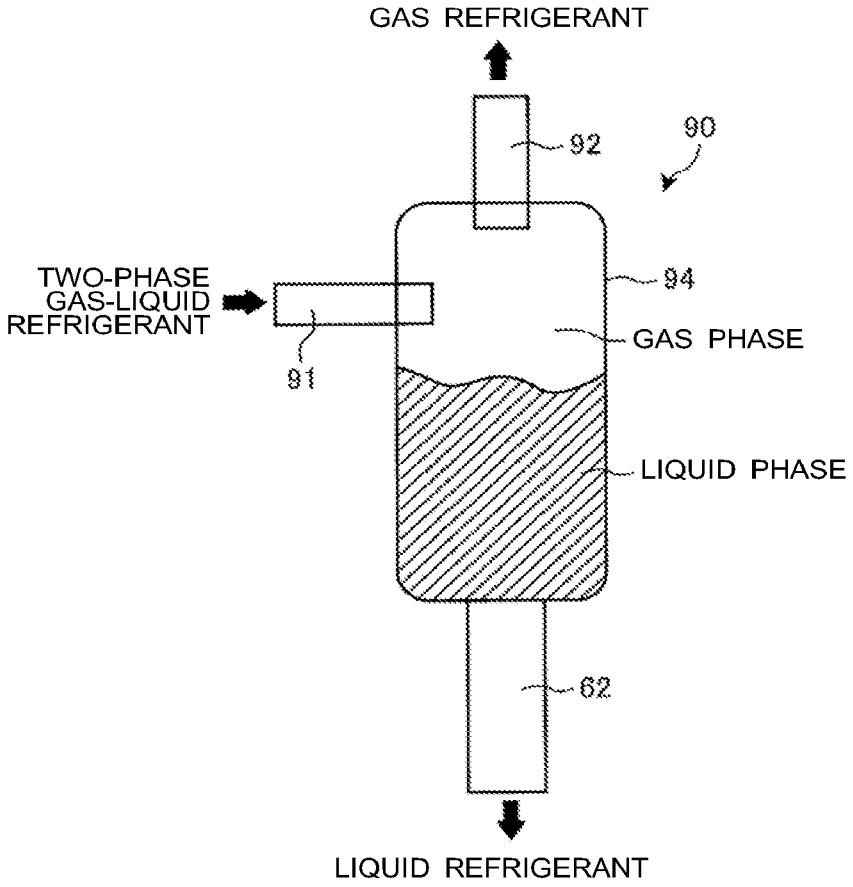
FIG. 51 illustrates a configuration of a gas-liquid separator, according to Embodiment 18 of the present invention.
Figure 52:
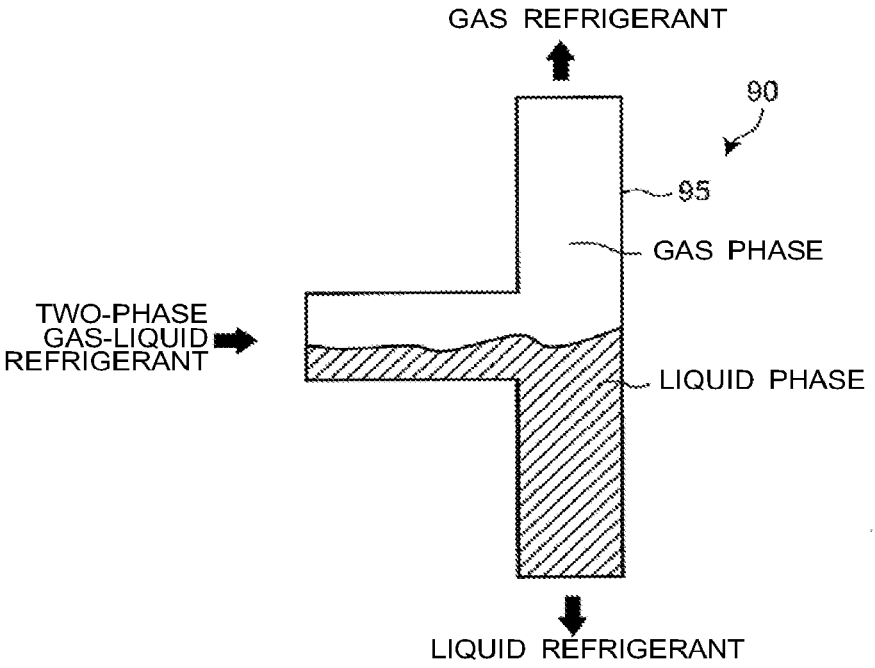
FIG. 52 illustrates an exemplary configuration of a gas-liquid separator, according to Embodiment 18 of the present invention.
Figure 53:
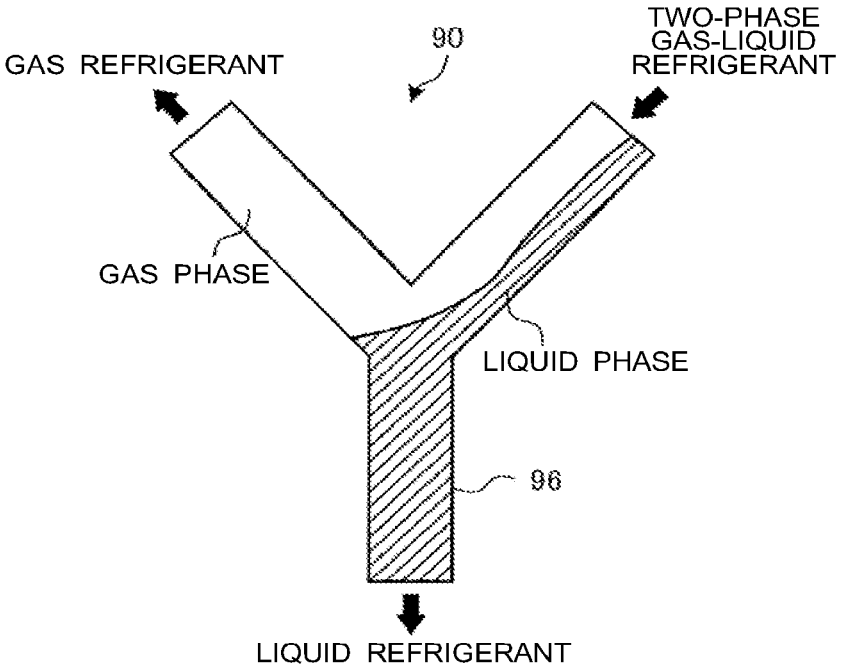
FIG. 53 illustrates another exemplary configuration of a gas-liquid separator, according to Embodiment 18 of the present invention.

FIG. 51 illustrates a configuration of the gas-liquid separator 90, according to Embodiment 18 of the present invention. FIG. 52 illustrates an exemplary configuration of the gas-liquid separator 90, according to Embodiment 18 of the present invention. FIG. 53 illustrates another exemplary configuration of the gas-liquid separator 90, according to Embodiment 18 of the present invention.

As illustrated in FIG. 51, the gas-liquid separator 90 is typically constructed from a gas-liquid separator vessel 94. However, the gas-liquid separator 90 is not limited to this configuration.

For example, the gas-liquid separator 90 with a simple configuration that utilizes the orientation of a refrigerant pipe, such as a T-shaped branched pipe 95 illustrated in FIG. 52 and a Y-shaped branched pipe 96 illustrated in FIG. 53, may be used.

In one exemplary control by the controller 80, for example, during rated heating operation, the quality x of refrigerant is controlled so that the quality x of refrigerant is in the range of $0.05 \leq x \leq 0.30$. Alternatively, a more desirable control is to open the gas bypass control valve 93 during rated heating operation, and close the gas bypass control valve 93 under other conditions. As for the degree to which the gas bypass control valve 93 is to be opened, for example, the relationship between the rotation frequency of the compressor 71 and the optimum opening degree is determined in advance.

The opening degree of the flow control valve 31 is controlled by the controller 80 to control the flow rate of gas refrigerant through the bypass pipe 30. This configuration ensures that, even for cases where the opening degree of the expansion device 72 is adjusted and the quality x of refrigerant entering the second header 20 does not fall within the range of $0.05 \leq x \leq 0.30$, the quality x of refrigerant entering the lowermost heat transfer tube 12 connected to the second header 20 can be controlled so that the quality x of refrigerant falls within the range of $0.05 \leq x \leq 0.30$, and the flow of refrigerant can be controlled so that the flow of refrigerant follows an annular or churn flow pattern.

The controller 80 controls the gas bypass control valve 93 and the flow control valve 31 so that the gas bypass control valve 93 and the flow control valve 31 open during rated heating operation. Such a configuration is more desirable as the control range of refrigerant quality is increased.

Although the gas-liquid separator 90 is depicted to be located outside the outdoor unit 100 in FIG. 50, the location of the gas-liquid separator 90 is not particularly limited to this configuration. For example, the gas-liquid separator 90 may be located inside the outdoor unit 100.

According to Embodiment 18, the air-conditioning apparatus 200 includes the compressor 71, the indoor heat exchanger 73, the expansion device 72, and the outdoor heat exchanger 10, and has a refrigeration cycle circuit in which refrigerant circulates. The outdoor heat exchanger 10 is the heat exchanger according to any one of Embodiments 1 to 15. The air-conditioning apparatus 200 includes the gas-liquid separator 90 disposed between the outdoor heat exchanger 10 and the expansion device 72. The air-conditioning apparatus 200 includes the gas bypass pipe 92 configured to bypass gas refrigerant separated by the gas-liquid separator 90 to the compressor 71. The air-conditioning apparatus 200 includes the gas bypass control valve 93 provided to the gas bypass pipe 92. The air-conditioning apparatus 200 includes the controller 80 that controls the gas bypass control valve 93 or the flow control valve 31 suitably to the operating condition so that the quality x of refrigerant flowing through the header pipe 21 falls within the range of $0.05 \leq x \leq 0.30$.

This configuration provides an improvement in the distribution performance of the second header 20 over a wide range of operating conditions, leading to improved efficiency of the outdoor heat exchanger 10 and consequently enhanced energy efficiency.

Embodiment 19

Figure 54:
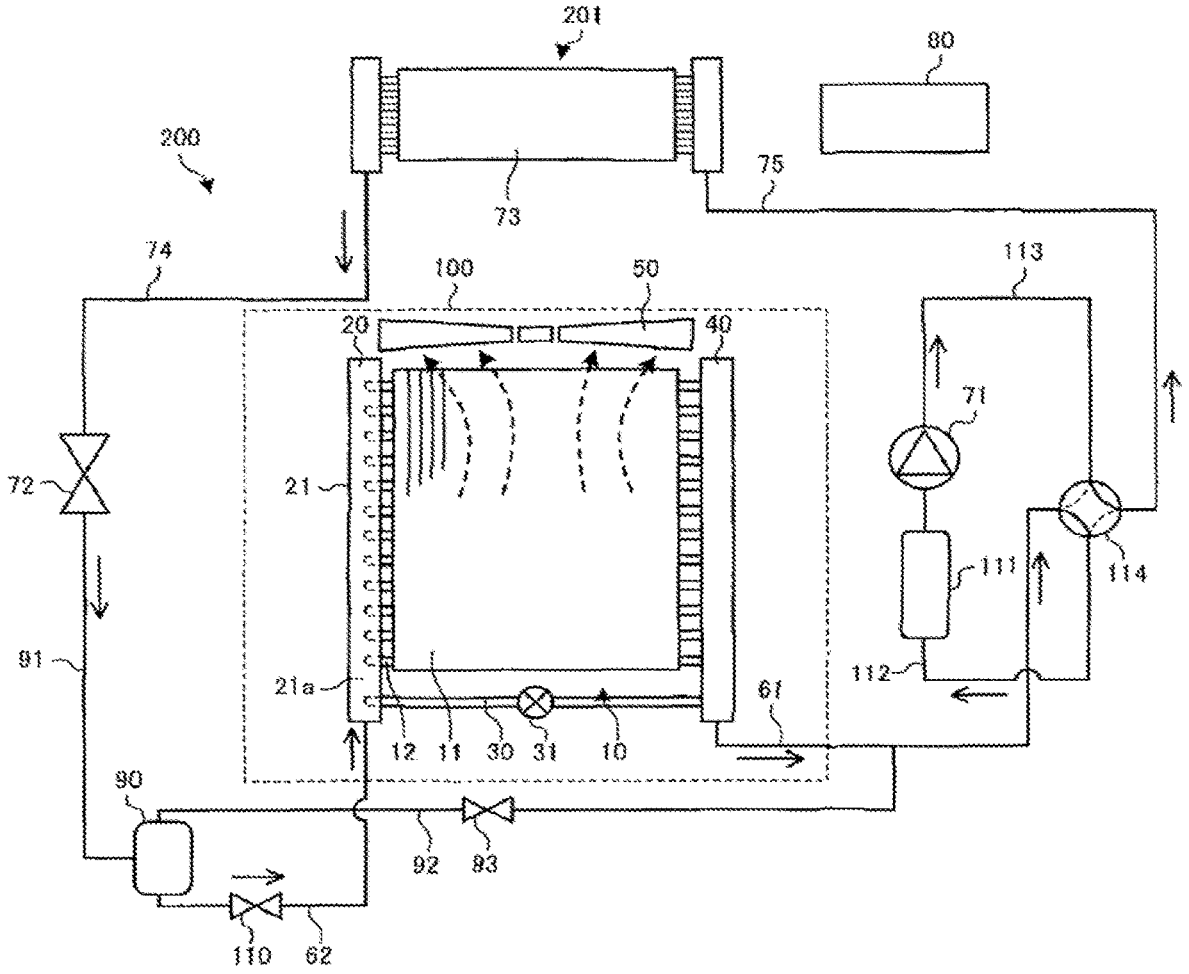
FIG. 54 illustrates a configuration of an air-conditioning apparatus during heating operation, according to Embodiment 19 of the present invention.
Figure 55:
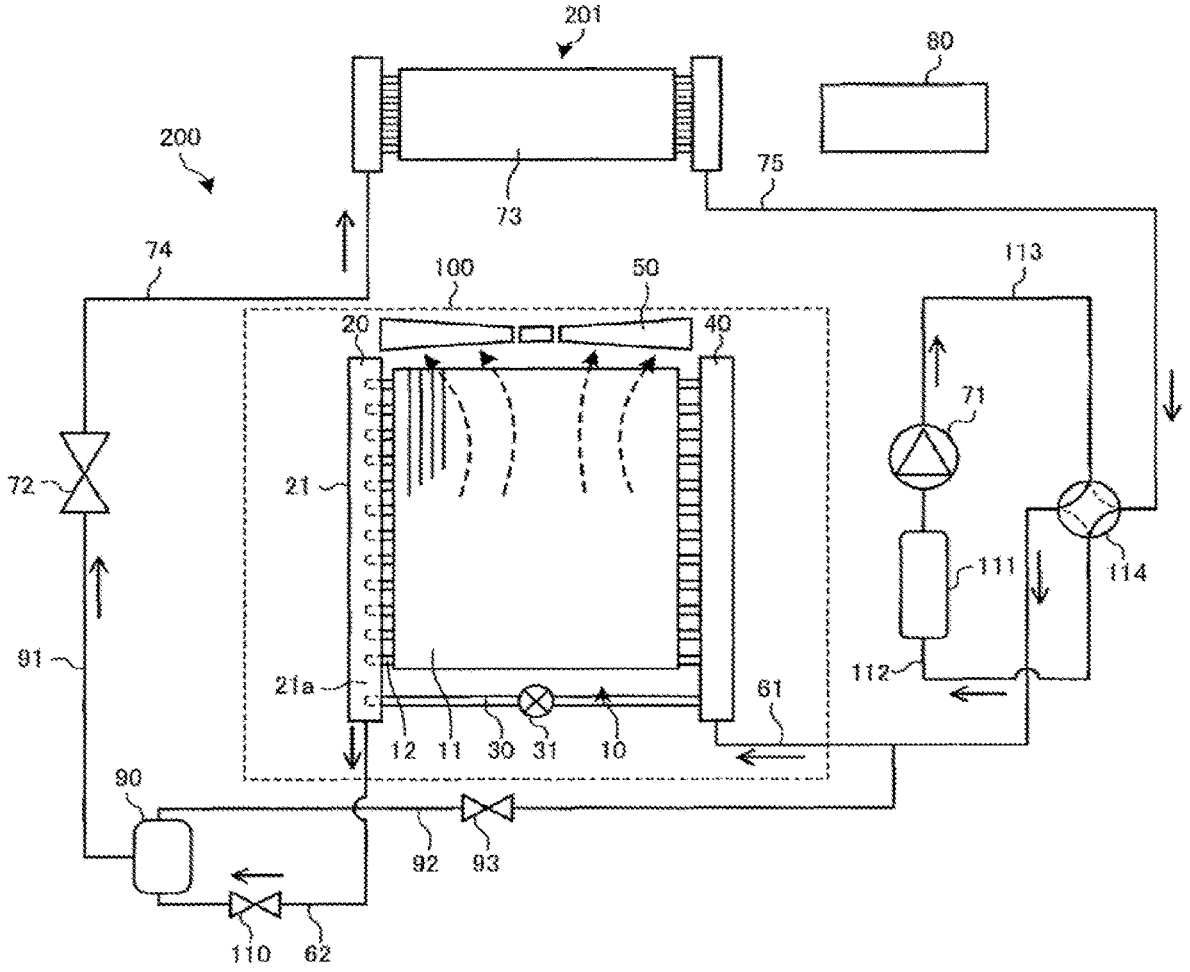
FIG. 55 illustrates a configuration of an air-conditioning apparatus during cooling operation, according to Embodiment 19 of the present invention.

FIG. 54 illustrates a configuration of the air-conditioning apparatus 200 during heating operation, according to Embodiment 19 of the present invention. Each solid arrow in FIG. 54 represents the flow of refrigerant during heating operation. FIG. 55 illustrates a configuration of the air-conditioning apparatus 200 during cooling operation, according to Embodiment 19 of the present invention. Each solid arrow in FIG. 55 represents the flow of refrigerant during cooling operation. In the following, a description will not be given of features overlapping those of Embodiments 16 to 18, and portions identical or corresponding to those of Embodiments 15 to 17 will be designated by the same reference signs.

In Embodiment 19, a pre-header regulating valve 110 is disposed at a portion of the inlet pipe 62 between the gas-liquid separator 90 and the second header 20 according to Embodiment 18. Further, an accumulator 111 is disposed upstream of the compressor 71. An accumulator inlet pipe 112 is disposed upstream of the accumulator 111. A compressor discharge pipe 113 is disposed on the discharge portion of the compressor 71. Further, a four-way valve 114 is disposed to switch the flows of refrigerant depending on whether the operation is cooling or heating.

The controller 80 controls the opening degree of the pre-header regulating valve 110 to prevent, under low refrigerant flow rate conditions, the quality x of refrigerant from falling within the range of $x<0.05$ as a result of liquid refrigerant being completely separated by the gas-liquid separator 90. This effect ensures that, over a wide operation range, a stable improvement in the efficiency of the outdoor heat exchanger 10 is obtained due to improved distribution performance, leading to enhanced energy efficiency.

Further, the accumulator 111 is disposed upstream of the compressor 71 to reduce intrusion of liquid refrigerant into the compressor 71 or to accumulate excess refrigerant. In this regard, the controller 80 controls the opening degree of the expansion device 72 and the opening degree of the pre-header regulating valve 110 so that a portion of the inlet pipe 62 that are located between the expansion device 72 and the pre-header regulating valve 110, the connecting pipe 91, and the gas-liquid separator 90 can be used as a liquid reservoir. Using these components as a liquid reservoir as mentioned above is more desirable as the accumulator 111 is allowed to be reduced in volume, accordingly.

The following problem occurs when the flow rate of refrigerant is high during heating operation. That is, even when gas refrigerant is separated by the gas-liquid separator 90 to decrease the quality of refrigerant, pressure loss associated with the passage of refrigerant through the pre-header regulating valve 110 causes a decrease in pressure, which in turn causes part of liquid refrigerant to gasify, resulting in increased refrigerant quality. In such a case, the controller 80 opens the flow control valve 31 so that gas refrigerant is bypassed to the first header 40 through the bypass pipe 30 connected to the entrance portion 21*a* of the header pipe 21 of the second header 20. Such a configuration is more desirable as the flow of refrigerant entering the branch portion between the header pipe 21 and the lowermost heat transfer tube 12 can be adjusted to an annular or churn flow pattern.

During cooling operation, the controller 80 causes the pre-header regulating valve 110 to fully open so that liquid refrigerant can be accumulated in the inlet pipe 62, a portion of the gas bypass pipe 92, the gas-liquid separator 90, and the connecting pipe 91. Such a configuration is desirable as S.C. at the outlet of the outdoor heat exchanger 10 can be reduced, leading to improved efficiency of the outdoor heat exchanger 10 and consequently enhanced energy efficiency also during cooling operation.

The flow of refrigerant in cooling operation will be described below.

As illustrated in FIG. 55, after leaving the compressor 71, refrigerant travels in a high-temperature and high-pressure gaseous state through the compressor discharge pipe 113, the four-way valve 114, and the outlet pipe 61, and flows into the first header 40. In the first header 40, the refrigerant is distributed by a plurality of branches into the heat transfer tubes 12. In the outdoor heat exchanger 10, individual refrigerant streams thus distributed reject heat to the surroundings and are combined at the second header 20 as refrigerant in a two-phase gas-liquid state or liquid state. The resulting refrigerant then exits through the inlet pipe 62. Subsequently, the refrigerant passes through the pre-header regulating valve 110 and then through the gas-liquid separator 90 and the connecting pipe 91 into the expansion device 72, which then throttles the refrigerant, causing the refrigerant to expand and change to low-pressure refrigerant in a two-phase gas-liquid state or in a liquid single-phase state. The resulting refrigerant then flows into the indoor unit 201. The refrigerant having entered the indoor unit 201 removes heat from the surroundings at the indoor heat exchanger 73 of the indoor unit 201. This configuration causes the refrigerant to evaporate and change to refrigerant in a gas single-phase state or to refrigerant in a two-phase gas-liquid state containing a large amount of gas refrigerant. The resulting refrigerant then passes through the header and the connecting pipe 75, travels through the four-way valve 114, the accumulator inlet pipe 112, and the accumulator 111, and then enter the compressor 71 again.

Next, the following describes why controlling the pre-header regulating valve 110, the expansion device 72, the gas bypass control valve 93, and the flow control valve 31 according to Embodiment 19 makes it possible to enhance the efficiency of the outdoor heat exchanger 10 both for heating operation and cooling operation.

In heating operation, the controller 80 controls the opening degree of the expansion device 72 to change refrigerant into a two-phase gas-liquid state. At this time, the controller 80 causes the pre-header regulating valve 110 to fully open and causes the gas bypass control valve 93 to open so that the flow rate of gas refrigerant into the second header 20 can be reduced. Consequently, the quality x of refrigerant entering the second header 20 can be made to fall within the range of $0.05 \leq x \leq 0.30$. This effect makes it possible to obtain an improvement in distribution performance by the protrusion of the heat transfer tube 12 into the header pipe 21, leading to improved efficiency of the outdoor heat exchanger 10 and consequently enhanced energy efficiency.

The following problem sometimes occurs when the flow rate of refrigerant is high during heating operation. That is, under such a condition, even when gas refrigerant is separated by the gas-liquid separator 90 to decrease the quality of refrigerant, pressure loss associated with the passage of refrigerant through the pre-header regulating valve 110 causes a decrease in pressure, which in turn causes part of liquid refrigerant to gasify, resulting in increased refrigerant quality. In such a case, the controller 80 opens the flow control valve 31 so that gas refrigerant is bypassed to the first header 40 through the bypass pipe 30 connected to the entrance portion 21*a* of the header pipe 21 of the second header 20. As a result, the quality x of refrigerant entering the branch portion between the header pipe 21 and the lowermost heat transfer tube 12, in other words, the quality x of refrigerant flowing through the header pipe 21 is made to fall within the range of $0.05 \leq x \leq 0.30$. Consequently, the flow of refrigerant can be adjusted to follow an annular or churn flow pattern, thus allowing distribution performance to be improved by protrusion of the heat transfer tube 12 into the header pipe 21. This effect helps improve the efficiency of the outdoor heat exchanger 10, leading to enhanced energy efficiency.

During cooling operation, for conditions that require large refrigerant flow, the controller 80 causes the gas bypass control valve 93 to fully close, and causes refrigerant to change into a low-pressure and two-phase gas-liquid state by the pre-header regulating valve 110 to thereby increase a two-phase gas-liquid region in the air-conditioning apparatus 200. Further, the controller 80 causes the flow control valve 31 to fully close so that refrigerant is not allowed to pass through the bypass pipe 30. This configuration allows for optimized control of refrigerant flow, leading to enhanced efficiency of the air-conditioning apparatus 200. By contrast, under conditions with an excess amount of refrigerant, the controller 80 causes the pre-header regulating valve 110 to fully open to thereby increase the region of liquid refrigerant, thus making it possible to reduce the liquid refrigerant region in the outdoor heat exchanger 10. Heat transfer region in a liquid single-phase state is thus reduced, thus improving the efficiency of the outdoor heat exchanger 10.

The following describes the mechanism with which the improved efficiency of the outdoor heat exchanger 10 is accomplished by reducing the liquid refrigerant region.

Figure 56:
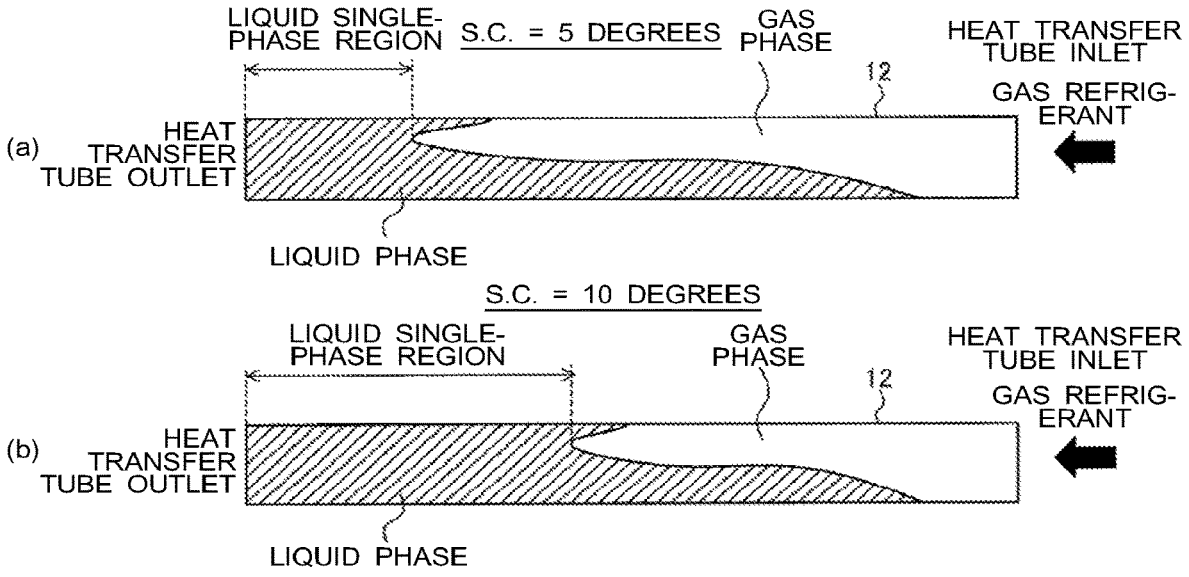
FIG. 56 represents schematic illustrations according to Embodiment 19 of the present invention, collectively depicting how refrigerant flows in a heat transfer tube, of which FIG. 56(*a*) illustrates a case of S.C. at a heat transfer tube outlet=5 degrees, and FIG. 56(*b*) illustrates a case of S.C. at the heat transfer tube outlet=10 degrees.

FIG. 56 represents schematic illustrations according to Embodiment 19 of the present invention, collectively depicting how refrigerant flows in the heat transfer tube 12, of which FIG. 56(*a*) illustrates a case of S.C. at the heat transfer tube outlet=5 degrees, and FIG. 56(*b*) illustrates a case of S.C. at the heat transfer tube outlet=10 degrees.

S.C. is defined as the difference at the heat transfer tube outlet between refrigerant saturation temperature and refrigerant temperature. A greater value of S.C. represents a greater amount of liquid refrigerant region in the heat transfer tube 12.

A greater amount of liquid refrigerant region results in a greater amount of liquid single-phase region in the heat transfer tube 12. The heat transfer coefficient in the liquid single-phase region in the tube is smaller than the heat transfer coefficient for refrigerant in a two-phase gas-liquid state. Consequently, an increase in the amount of the liquid single-phase region in the heat transfer tube 12 causes a decrease in the efficiency of the outdoor heat exchanger 10.

It is to be noted that during cooling operation, the controller 80 controls the flow control valve 31 disposed at a portion of the bypass pipe 30 so that the flow control valve 31 fully closes.

According to Embodiment 19, the air-conditioning apparatus 200 includes the gas-liquid separator 90 disposed between the outdoor heat exchanger 10 and the expansion device 72. The air-conditioning apparatus 200 includes the gas bypass pipe 92 configured to bypass gas refrigerant separated by the gas-liquid separator 90 to the compressor 71. The air-conditioning apparatus 200 includes the gas bypass control valve 93 provided to the gas bypass pipe 92.

This configuration provides an improvement in the distribution performance of the second header 20. Consequently, for both cooling operation and heating operation conditions, the efficiency of the outdoor heat exchanger 10 can be improved, leading to enhanced energy efficiency.

According to Embodiment 19, the air-conditioning apparatus 200 includes the compressor 71, the four-way valve 114, the indoor heat exchanger 73, the expansion device 72, and the outdoor heat exchanger 10, and has a refrigeration cycle circuit in which refrigerant circulates. The four-way valve 114 switches the flows of refrigerant to enable heating operation and cooling operation. The outdoor heat exchanger 10 is the heat exchanger according to any one of Embodiments 1 to 15. The air-conditioning apparatus 200 includes the gas-liquid separator 90 disposed between the outdoor heat exchanger 10 and the expansion device 72. The air-conditioning apparatus 200 includes the gas bypass pipe 92 configured to bypass gas refrigerant separated by the gas-liquid separator 90 to the compressor 71. The air-conditioning apparatus 200 includes the gas bypass control valve 93 provided to the gas bypass pipe 92. The air-conditioning apparatus 200 includes the pre-header regulating valve 110 that is positioned downstream of the gas-liquid separator 90 in heating operation. The air-conditioning apparatus 200 includes the controller 80. In heating operation, the controller 80 controls the expansion device 72, the gas bypass control valve 93, the pre-header regulating valve 110, or the flow control valve 31 so that the quality x of refrigerant flowing through the header pipe 21 falls within the range of $0.05 \leq x \leq 0.30$, and in cooling operation, the controller 80 controls the pre-header regulating valve 110 so that the gas-liquid separator 90 is used as a liquid reservoir.

This configuration provides an improvement in the distribution performance of the second header 20 over a wide range of operating conditions. Consequently, for both cooling operation and heating operation conditions, the efficiency of the outdoor heat exchanger 10 can be improved, leading to enhanced energy efficiency.

Suitable combinations of features described in the above-mentioned embodiments are also contemplated by the inventors from the beginning. The embodiments disclosed herein are illustrative in all respects, and the present invention is not limited to the embodiments. The scope of the present invention is intended to be defined not by the above description of the embodiments but by the claims, and to include all equivalents and modifications that fall within the scope of the claims.

REFERENCE SIGNS LIST

10 outdoor heat exchanger 11 fin 12 heat transfer tube 12*a* partition 13 bifurcated tube 20 second header 21 header pipe 21*a* entrance portion 21*b* upper end portion 22 branch tube 23 tube-shape transforming joint 30 bypass pipe 31 flow control valve 32 bypass pipe 33 bypass pipe 34 flow control valve 35 open-close valve 36 capillary tube 40 first header 41 header pipe 41*a* entrance portion 42 branch tube 43 tube-shape transforming joint 50 fan 61 outlet pipe 62 inlet pipe 71 compressor 72 expansion device 73 indoor heat exchanger 74 connecting pipe 75 connecting pipe 76 first temperature sensor 77 second temperature sensor 80 controller 90 gas-liquid separator 91 connecting pipe 92 gas bypass pipe 93 gas bypass control valve 94 gas-liquid separator vessel 95 branched pipe 96 branched pipe 100 outdoor unit 101 casing 102 air inlet 103 air outlet 104 fan guard 110 pre-header regulating valve 111 accumulator 112 accumulator inlet pipe 113 compressor discharge pipe 114 four-way valve 200 air-conditioning apparatus 201 indoor unit

The invention claimed is:

1. A heat exchanger, comprising:

a plurality of heat transfer tubes;

a first header connected to one end portion of each of the plurality of heat transfer tubes;

a second header connected to an other end portion of each of the plurality of heat transfer tubes; and a plurality of fins joined to each of the plurality of heat transfer tubes, the heat exchanger constituting a portion of a refrigeration cycle circuit in which a refrigerant is configured to circulate, the second header including a header pipe, the header pipe defining a flow space, the flow space being communicated with the plurality of heat transfer tubes and, when the heat exchanger acts as an evaporator, allowing refrigerant in a two-phase gas-liquid state to pass through the flow space and to flow out into the plurality of heat transfer tubes, the header pipe having an entrance portion, the entrance portion of the header pipe being a portion of the header pipe between a connection end portion of the second header that is connected to a refrigerant pipe and one of the plurality of heat transfer tubes into which the refrigerant in the two-phase gas-liquid state first flows, a bypass pipe being disposed between the entrance portion of the header pipe in the second header and the first header and configured to bypass the refrigerant, the bypass pipe protruding into the header pipe to be connected to the header pipe, the bypass pipe being provided with a flow control mechanism configured to control a flow rate of refrigerant, the flow control mechanism including a valve, the entrance portion of the header pipe having an entrance distance L [m] between the connection end portion of the second header that is connected to the refrigerant pipe and a central axis of a connection of the bypass pipe to the header pipe, the entrance distance L [m] of the entrance portion satisfying a condition of $L \geq 5di$, where di is an inner diameter [mm] of the flow space of the header pipe on an orthogonal plane orthogonal to a direction of refrigerant flow, where a center position of the flow space of the header pipe on the orthogonal plane orthogonal to the direction of refrigerant flow is defined as 0%, a wall surface position of the flow space of the header pipe on a horizontal plane is defined as ±100%, and a distal end portion of the bypass pipe inserted in the header pipe being located within an area of ±50%, the distal end portion of the bypass pipe being inserted in the flow space of the entrance portion of the header pipe at a position where the gas phase of refrigerant is configured to be distributed.

2. The heat exchanger of claim 1, wherein the distal end portion of the bypass pipe is connected in such a manner that the distal end portion penetrates a liquid phase of the refrigerant in the two-phase gas-liquid state flowing in the header pipe and reaches a gas phase of the refrigerant, wherein a thickness δ [m] of the liquid phase is defined as $\delta = G \times (1-x) \times D/(4\rho_L \times U_{LS})$, where $U_{LS}$ is liquid apparent velocity [m/s] at a maximum value within a variation range of refrigerant flow rate $M_R$ that is a flow rate [kg/h] of the refrigerant through the flow space of the header pipe, x is refrigerant quality, G is refrigerant flow velocity [kg/(m$^2$s)], $\rho_L$ is refrigerant liquid density [kg/m$^3$], and D is an inner diameter [m] of the flow space of the header pipe on an orthogonal plane orthogonal to a direction of refrigerant flow wherein the liquid apparent velocity $U_{LS}$ [m/s] is defined as $U_{LS} = G(1-x)/\rho_L$, and wherein the refrigerant flow velocity G [kg/(m$^2$s)] is defined as $G = M_R/(3{,}600 \times (D/2)^2 \times 3.14)$.

3. The heat exchanger of claim 1, wherein the flow controller is configured to allow the refrigerant to pass through the bypass pipe when the heat exchanger acts as an evaporator and not to allow the refrigerant to pass through the bypass pipe when the heat exchanger acts as a condenser.

4. The heat exchanger of claim 1, wherein a center position of the flow space of the header pipe on an orthogonal plane orthogonal to a direction of refrigerant flow is defined as 0%, a wall surface position of the flow space of the header pipe on the orthogonal plane is defined as ±100%, a direction of insertion of the bypass pipe on the orthogonal plane is defined as X-direction, and a width direction of the bypass pipe orthogonal to the X-direction on the orthogonal plane is defined as Y-direction, the distal end portion of the bypass pipe is located within an area of ±50% in the X-direction, and a central axis of the bypass pipe is located within an area of ±50% in the Y-direction.

5. The heat exchanger of claim 1, wherein a center position of the flow space of the header pipe on an orthogonal plane orthogonal to a direction of refrigerant flow is defined as 0%, a wall surface position of the flow space of the header pipe on the orthogonal plane is defined as ±100%, a direction of insertion of the plurality of heat transfer tubes on the orthogonal plane is defined as X-direction, and a width direction of the plurality of heat transfer tubes orthogonal to the X-direction on the orthogonal plane is defined as Y-direction, distal end portions of at least half of the plurality of heat transfer tubes are located within an area of ±50% in the X-direction, and central axes of at least half of the plurality of heat transfer tubes are located within an area of ±50% in the Y-direction.

6. The heat exchanger of claim 1, wherein at least one of the plurality of heat transfer tubes is connected to an end face of a closed end portion of the header pipe.

7. The heat exchanger of claim 1, wherein the bypass pipe has a plurality of connection portions each connected to the header pipe, the plurality of connection portions joining each other at a portion between a portion at which the plurality of connection portions are each connected to the header pipe and a portion at which the bypass pipe is connected to the first header.

8. The heat exchanger of claim 1, wherein the bypass pipe comprises a plurality of bypass pipes and wherein the flow controller is provided to each bypass pipe of the plurality of bypass pipes.

9. The heat exchanger of claim 1, wherein the flow controller includes an open-close valve configured to open and close the bypass pipe, and a capillary tube disposed at a portion of the bypass pipe.

10. The heat exchanger of claim 1, wherein the header pipe comprises a non-circular tube.

11. The heat exchanger of claim 10, wherein the header pipe has a connection surface to which the plurality of heat transfer tubes are connected, the connection surface comprising a flat surface.

12. The heat exchanger of claim 1, wherein each heat transfer tube of the plurality of heat transfer tubes is in a form of a flat tube.

13. The heat exchanger of claim 12, wherein each heat transfer tube of the plurality of heat transfer tubes is in a form of a flat perforated tube.

14. The heat exchanger of claim 1, wherein the second header includes a plurality of branch tubes, and each second header in the plurality of branch tubes is connected to a corresponding one of the plurality of heat transfer tubes, and wherein the flow space of the header pipe is communicated with the plurality of branch tubes.

15. The heat exchanger of claim 14, wherein a tube-shape transforming joint is disposed between each heat transfer tube of the plurality of heat transfer tubes and a corresponding one of the plurality of branch tubes to transform a tube shape of each heat transfer tube of the plurality of heat transfer tubes into a tube shape of a distal end portion of a corresponding one of the plurality of branch tubes inserted in the header pipe.

16. The heat exchanger of claim 1, wherein the second header extends in a vertical direction.

17. The heat exchanger of claim 1, wherein the second header extends in a horizontal direction.

18. An air-conditioning apparatus, comprising a compressor, an indoor heat exchanger, an expansion device including a valve, and an outdoor heat exchanger, the air-conditioning apparatus having a refrigeration cycle circuit in which refrigerant circulates, wherein the outdoor heat exchanger is the heat exchanger of claim 1.

19. The air-conditioning apparatus of claim 18, comprising:

a gas-liquid separator disposed between the outdoor heat exchanger and the expansion device in the air-conditioning apparatus, a gas bypass pipe configured to bypass gas refrigerant separated by the gas-liquid separator to the compressor; and a gas bypass control valve provided to the gas bypass pipe.

20. The heat exchanger of claim 1, wherein a longest dimension of the second header extends in an extending direction, and the header pipe of the second header extends in the extending direction.

21. The heat exchanger of claim 1, wherein the second header is directly connected to each of the plurality of heat transfer tubes.

22. The heat exchanger of claim 1, wherein the bypass pipe protrudes perpendicularly into the header pipe.

23. The heat exchanger of claim 1, wherein the entrance portion is configured as a straight tube having a same diameter as a portion of the heat transfer tube where the gas-liquid two-phase refrigerant first flows into the header pipe is connected, and the tip of the bypass pipe is inserted through the pipe wall of the entrance portion in a direction intersecting the axis of the entrance portion.

* * * * *